US006217803B1

(12) United States Patent
Uozumi

(10) Patent No.: US 6,217,803 B1
(45) Date of Patent: Apr. 17, 2001

(54) FORMING METHOD AND FORMING SYSTEM

(75) Inventor: Minoru Uozumi, Aichi-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/142,741

(22) PCT Filed: Mar. 13, 1997

(86) PCT No.: PCT/JP97/00803

§ 371 Date: Sep. 15, 1998

§ 102(e) Date: Sep. 15, 1998

(87) PCT Pub. No.: WO97/34717

PCT Pub. Date: Sep. 25, 1997

(30) Foreign Application Priority Data

Mar. 19, 1996 (JP) ..... 8-62248

(51) Int. Cl.[7] ..... B29C 39/00; B22D 11/04

(52) U.S. Cl. ..... 264/40.7; 65/86; 65/187; 164/418; 164/459; 264/164; 264/167; 264/166; 264/571; 425/130; 425/145; 425/224

(58) Field of Search ..... 164/459, 418, 164/460–61, 484, 483, 488; 65/86, 88, 187, 188; 264/164, 40.7, 167, 166, 571; 425/130, 145, 224

(56) References Cited

U.S. PATENT DOCUMENTS

| | | | | |
|---|---|---|---|---|
| 3,915,662 | * | 10/1975 | Labelle et al. | 264/164 |
| 3,919,378 | * | 11/1975 | Smarook | 264/164 |
| 4,627,887 | * | 12/1986 | Sachs | 156/608 |
| 4,861,416 | * | 8/1989 | Morrison | 156/608 |
| 5,370,078 | * | 12/1994 | Kou et al. | 156/608 |

* cited by examiner

*Primary Examiner*—Jan H. Silbaugh
*Assistant Examiner*—Mark Eashoo
(74) *Attorney, Agent, or Firm*—Pillsbury Winthrop LLP

(57) ABSTRACT

A partition member having partition walls arranged in a lattice is disposed in the vicinity of an upper surface of a molten metal mass. The upper surface is divided by the partition walls into a multiplicity of segmental surfaces. A forming starter member is brought into contact with the partition member so that the molten material adheres to a starter surface of the forming starter member, and is then separated from the partition member. The molten metal is drawn from each of the segmental surfaces, and the drawn metal is solidified to form a piece which has a cross sectional shape corresponding to the shape of the starter surface. With the use of forming starter members having respective starter surfaces which are different in shape from each other, it is possible to form pieces having various cross sectional shapes which correspond to the shapes of the starter surfaces.

29 Claims, 20 Drawing Sheets

(a)

(b)

(c)

FORMING METHOD AND FORMING SYSTEM

TECHNICAL FIELD

The present invention relates in general to a forming method of forming a piece and a forming system for forming a piece. More particularly, the invention is concerned with a forming method and a forming system in which a piece is formed from a molten material without using a casting mold.

BACKGROUND ART

There is disclosed, in JP-A-2-205232, a forming method of forming a piece from a molten material without using a casting mold. This forming method is a modification of a so-called continuous casting method. In the continuous casting method, a molten metal is first solidified in a mold cavity formed through the casting mold which is positively cooled, and the solidified molten metal is then continuously drawn out from the mold cavity, whereby a piece having a large length is cast. In the forming method disclosed in the above publication, on the other hand, a restrictor frame is used in place of the casting mold. This disclosed forming method may be referred to as a continuous-drawing-up method. The restrictor frame is identical with the casting mold of the continuous casting method in that the restrictor frame has a mold cavity formed therethrough. However, in the disclosed forming method, the molten metal is solidified not in the mold cavity, but in a position located above the mold cavity.

The restrictor frame is a plate-like member having the mold cavity formed therethrough, and is disposed on the surface of the molten metal. Into the mold cavity of the restrictor frame, a comparatively narrow dummy bar made of the same material as the molten metal is introduced. This dummy bar is drawn up through the mold cavity, when the molten metal in the vicinity of the dummy bar is solidified into a forming starter member having a cross sectional shape which corresponds to the mold cavity. As the forming starter member is drawn together with the dummy bar upward through the mold cavity, the molten metal is also drawn owing to its surface tension so as to be located between the lower end of the forming starter member and the restrictor frame. That is, the drawn molten metal is located between the upper surface of the molten metal and a starter surface which is the lower end face of the forming starter member. In the initial period of the drawing process, the drawn molten metal is cooled indirectly through the forming starter member, thereby causing the drawn molten metal to be solidified gradually from the portion nearer to the forming starter member. In the subsequent period of the drawing process, the drawn molten metal is cooled indirectly through a formed piece which has been solidified from the drawn molten metal, thereby causing the drawn molten metal to be solidified gradually from the portion nearer to the formed piece. Thus, the drawn molten metal is solidified into the formed piece, which is then cooled by water and gas (for example, a nitrogen gas) respectively sprayed from a water spray nozzle and a gas spray nozzle. The drawn molten metal is continuously drawn upward, while being cooled as described above, so that the length of the formed piece is enlarged whereby a long piece is obtained.

In this continuous-drawing-up method in which the drawn molten metal located between the formed piece and the restrictor frame is solidified into the formed piece, the formed piece has a cross sectional shape corresponding to the cross sectional shape of the mold cavity of the restrictor frame. The continuous casting method in which the drawn molten metal is solidified in the casting mold, suffers from a drawback that friction between the formed piece and the casting mold causes the formed piece to be scratched at its surfaces, or causes the casting mold to be worn out. The continuous-drawing-up method in which the drawn molten metal is solidified into the formed piece outside the restrictor frame, on the other hand, is free from the above drawback encountered in the continuous casting method. Further, in the continuous-drawing-up method, since the drawn molten metal is solidified when the draw molten metal is not in contact with the restrictor frame, it is possible to obtain a high-quality piece constituted by column or structure formed as a result of solidification in one direction. Still further, in the continuous-drawing-up method, where the drawing velocity of the formed piece is held within an optimum range, it is possible to obtain a straight piece having cross sectional dimensions which are not diversified as viewed in the longitudinal direction. An increase in the drawing velocity provides a piece having a diameter which is reduced as viewed in a direction toward the top end of the piece. A reduction in the drawing velocity provides a piece having a diameter which is increased as viewed in the direction toward the top end of the piece.

However, the continuous-drawing-up method has a drawback that it is impossible to form a piece having a cross sectional shape which is other than the shape of the mold cavity formed through the restrictor frame. Namely, the restrictor frame has to be changed every time when the cross sectional shape of the formed piece to be formed is changed.

The invention of the present application has an object of obtaining a forming method and a forming system in which it is possible to easily form pieces having various cross sectional shapes, without changing the restrictor frame.

DISCLOSURE OF INVENTION

The above object may be achieved by a forming method according to the following modes having respective features. The modes are numbered for identification and their dependency from each other is indicated in the same manner as in the claims, to clarify possible combinations of the features of the modes.

(1) A forming method of forming a piece between a surface of a mass of a molten material and a starter surface of a forming starter member by gradually separating the surface of the mass and the starter surface from each other, after the starter surface has been brought into contact with the surface of the mass, the forming method being characterized by:

covering at least a portion of the surface of the mass which portion is wider than the starter surface, by a partition member having a plurality of partition walls which are spaced apart from each other by a spacing interval permitting the partition walls to divide a corresponding surface partially constituting the above-described portion and corresponding to the starter surface, into a plurality of segmental surfaces, and then separating the partition member and the forming starter member from each other while keeping the partition member in a state for dividing the corresponding surface into the plurality of segmental surfaces, after the surface of the mass and the starter surface have been brought into contact with each other with the starter surface being held in contact with or proximity to the partition member.

One example will be explained on the basis of FIGS. 32 and 33. The reference numerals 600, 602 in the figures denote a partition member and a forming starter member, respectively. The partition member 600 is adapted to normally cover a portion of a molten material mass surface 606 which portion is wider than a starter surface 604 of the forming starter member 602. This portion of the molten material mass surface 606 includes a corresponding surface which corresponds to the starter surface 604 and which is divided into segmental surfaces 611–622. The forming starter member 602 is spaced apart from the partition member 600. It is noted that FIGS. 32 and 33 schematically show the relationship between the forming starter member 602 and the partition member 600. The forming starter member 602 is actually considerably larger than each of the segmental surfaces 611–622, 630, whereby the corresponding surface is actually divided into a larger numbers of the segmental surfaces. The actual distance between the starter surface 604 and the partition member 600 is much smaller than the distance shown in FIG. 33.

The forming starter member 602 is brought into contact with the partition member 600. The partition member 600 and the forming starter member 602 are moved downward by a short distance, whereby the molten material mass surface 606 is relatively raised to be brought into contact with the starter surface 604 so that the molten material adheres to the starter surface 604. For improving an accuracy of the cross sectional dimensions of the formed piece, it is not desirable that the molten material providing each segmental surface moves across the partition wall to be connected to that providing the adjacent segmental surface, although the molten material providing each segmental surface protrudes upwardly from the partition member. Further, it is not desirable that the molten material adheres to the side faces of the forming starter member 602 as well as to the starter surface 604. After the molten material mass surface 606 has been brought into contact with the starter surface 604, the partition member is slightly raised while the forming starter member is separated from the partition member by a short distance, so that a drawn molten material 608 is formed between the starter surface 604 and the molten material mass surface 606. The drawn molten material 608 is then cooled by the forming starter member 602, whereby a portion of the drawn molten material 608 which is in proximity to the forming starter member 602 is solidified into a formed piece 610.

As described above, as the starter surface 604 and the molten material mass surface 606 are separated from each other after they have been once brought into contact with each other, the molten material is drawn from the segmental surfaces 611–622 corresponding to the starter surface 604. However, the molten material is not drawn from the other starter surfaces 630. As shown in FIG. 33, partition walls 632 divide the molten material mass surface 606 into the segmental surfaces 611, 615, 618, 622, so that each of the partition walls 632 is subjected to the drawing of the molten material on its opposite sides. A partition wall 634 which divides the molten material mass surface 606 into the segmental surface 611 and the segmental surface 630 adjacent to the segmental surface 611, is subjected to the drawing of the molten material on one of its opposite sides Namely, the molten material is drawn from the segmental surface 611 which is the one of the opposite sides, but is not drawn from the segmental surface 630 which is the other side. Similarly, a partition wall 635 which divides the molten material mass surface 606 into the segmental surfaces 622, 630, is subjected to the drawing of the molten material on only one of its opposite sides, i.e., on the segmental surface 622. A partition wall 636 which divides the molten material mass surface 606 into the segmental surfaces 630, on the other hand, is not subjected to the drawing of the molten material on either of its opposite sides. Namely, the molten material is not drawn from either of the segmental surfaces 630. Thus, the partition walls are classified into the following groups: a group of partition walls (such as the partition wall 632) each of which is subjected to the drawing of the molten metal on its opposite sides; a group of partition walls (such as the partition walls 634, 635) each of which is subjected to the drawing of the molten metal 12 on only one of its opposite sides; and a group of partition walls (such as the partition wall 636) each of which is not subjected to the drawing on either of its opposite sides.

A contour line 640 of the starter surface 604 crosses the segmental surfaces 611, 622, when the forming starter member 602 is in contact with or proximity to the partition member 600. The molten material which is drawn from the segmental surface 611 describes a curved line convexed inwardly from the partition wall 634 toward the contour line 640, due to a surface tension of the molten material. Similarly, the molten material which is drawn from the segmental surface 622 describes a curved line convexed inwardly from the partition wall 635 toward the contour line 640. The molten material 608 drawn from these segmental surfaces 611, 622 are solidified to form the periphery of the formed piece 610. As is clear from the figures, where the outer side surface of the drawn molten material 608 is solidified in the vicinity of the molten material mass surface 606, the cross sectional area of the formed piece 610 is made larger. Where the outer side surface of the drawn molten material 608 is solidified in a position remote from the molten material mass surface 606, the cross sectional area of the formed piece 610 is made smaller. The solidification position of the outer side surface of the drawn molten material 608 can be expressed by a distance m (hereinafter referred to as drawing distance m) between the solidification position of the outer side surface and the molten material mass surface 606 of the drawn molten material 608. The cross sectional area of the formed piece 610 decreases with an increase in the drawing distance m, and increases with a decrease in the drawing distance m. Therefore, the cross sectional area of the formed piece 610 can be kept constant by keeping the drawing distance m constant. The drawing distance m can be considered also as a distance between the outer periphery of a solidification surface 642 and the molten material mass surface 606.

The contour line of the cross section of the formed piece 610 does not necessarily coincide with the contour line 640 of the starter surface 604. However, the cross sectional area of formed piece 610 is substantially in proportion to that of the starter surface 604. As far as the drawing distance m is kept constant during the forming process, the maximum possible difference of each cross sectional dimension of the formed piece 610 with respect to the cross sectional dimension of the starter surface 604 does not exceed the dimension of each segmental surface multiplied by two (two times the spacing interval between the adjacent partition walls). (In other words, the above maximum possible difference as viewed on one of opposite sides does not exceed the dimension of each segmental surface.) Therefore, the maximum possible difference of the cross sectional dimension of the formed piece 610 is reduced with a decrease of each segmental surface, i.e., with a decrease of the spacing interval between the adjacent partition walls.

Where various pieces having different cross section contours and areas need to be formed, the forming starter member is replaced by other forming starter members whose starter surfaces having different cross sectional shapes and areas, and the pieces can be formed in the same manner as described above. With the shape of the starter surface being changed, the molten material may no longer be drawn from some of the segmental surfaces 611–622 from which the molten material has been drawn, while the molten material may be drawn from some of the segmental surfaces 630 from which the molten material has not been drawn. However, as described above, any partition walls can belong to any one of the group of partition walls each of which is subjected to the drawing of the molten material on its opposite sides; the group of partition walls each of which is subjected to the drawing of the molten material on only one of its opposite sides; and the group of partition walls each of which is not subjected to the drawing on either of its opposite sides. Accordingly, the partition member does not have to be changed, unlike the restrictor frame in the prior art, even where the cross sectional shape or area of the starter surface is changed. The partition walls are evenly arranged over the entirety of the partition wall 600, thereby permitting the starter surface to be brought into contact with or proximity to any position of the partition wall 600.

There is a case wherein the molten material is drawn from those ones of the segmental surfaces which are located close to the contour line of the starter surface but which the contour line does not cross, or a case wherein the molten material is not drawn from those ones of the segmental surfaces which the contour line slightly crosses. These cases will take place depending upon the spacing interval between the adjacent partition walls, the shapes of the partition walls, a viscosity of the molten material, a degree of wettability (affinity) of the partition member with respect to molten material, the relative height of the partition member and the molten material mass surface upon contact of the molten material mass surface with the starter surface, and other factors. However, the molten material is necessarily drawn from segmental surfaces which are entirely inside the contour line, and the molten material is never drawn from segmental surfaces which are completely outside the contour line, irrespective of the above factors. As a result, even if the above-described cases happen, the shape of the formed piece is substantially the same as that of the starter surface. Where the above-described cases happen, the maximum possible difference of the cross sectional dimensions of the formed piece with respect to the starter surface is reduced by reducing each segmental surface, i.e., the spacing interval between the adjacent partition walls.

While there has been described a forming method in which the molten material is drawn upward from the molten material mass, the molten material may be drawn downward. Namely, the present mode can be embodied such that the forming starter member and the molten material mass surface are separated from each other so that the molten material is drawn upward or downward. At least one of the upward movement of the forming starter member and the downward movement of the molten material mass surface (upper surface) is effected so that the molten material is drawn upward. For lowering the molten material mass surface, the entirety of the accommodation container may be lowered, or alternatively the amount of the molten material within the accommodation container may be reduced. At least one of the downward movement of the forming starter member and the upward movement of the molten material mass surface (lower surface) is effected so that the molten material is drawn downward.

In the present mode, the partition member covers the portion of the molten material mass surface which portion is wider than the starter surface. The partition member has the partition walls, which are spaced apart from each other so as to divide the corresponding surface corresponding to the starter surface, into the plurality of segmental surfaces. Thus, the molten material is drawn through the partition member. The molten material mass surface and the starter surface are brought into contact with each other while the forming starter member and the starter surface are kept in contact with or proximity to each other, whereby the molten material adheres to the starter surface. At least one of the starter member, the partition member and the molten material mass surface is then moved, whereby the starter surface and the partition member are separated from each other, and whereby the starter surface and the molten material mass surface are separated from each other, so that the molten material is drawn so as to generate a column shape between the starter surface and the molten material mass surface while at least a portion of the molten material mass surface in the vicinity of the starter surface is divided by the partition walls into the segmental surfaces. Therefore, the entirety of the molten material providing each of the segmental surfaces adheres to the starter surface so as to constitute a portion of the drawn molten material, or alternatively remains as a portion of the molten material mass which has been parted from the starter surface. It is not possible that a portion of the molten material providing each segmental surface adheres to the starter surface while the other portion remains as a portion of the molten material mass. In other words, the spacing interval between the adjacent partition walls is determined such that the segmental surface has such a suitable area. The cross sectional area of the drawn molten material is changed in steps by a unit equal to the area of the segmental surface.

The molten material which has been drawn as described above is cooled by the forming starter member, thereby causing the drawn molten metal to be solidified gradually from the portion nearer to the forming starter member. The forming starter member and the partition member are progressively separated from each other, whereby the molten material is continuously drawn through the partition member, so as to be subsequently solidified into the formed piece having a cross sectional shape substantially equal to that of the starter surface. After the formed piece has grown to a predetermined length by the separation of the forming starter member and the molten material mass surface from each other, the forming starter member may be parted from the formed piece, so that the formed piece is further grown by separation of the formed piece and the molten material mass surface from each other. It is noted that the partition member through which the molten material is drawn serves as a kind of filter, preventing release of foreign substances into the formed piece.

The starter surface of the forming starter member is brought into contact with or proximity to the partition member, so that the molten material adheres to the starter surface. Where the forming starter member is in contact with the partition member, the molten material adheres to the starter surface with the level of the molten material mass surface being equalized to that of one of opposite surfaces of the partition member which is closer to the starter surface. Even where the forming starter member is spaced apart from the partition member, the molten material adheres to the starter surface if the molten material mass surface passes the partition member so as to be moved toward the starter surface. Namely, the forming starter member may be in contact with or proximity to the partition member so that the molten material adheres to the starter surface, and it is not necessary to accurately control the position of the forming starter member relative to the partition member in which the forming starter member is in contact with or proximity to the partition member. Where the starter surface is brought into contact with the partition member so that the molten material adheres to the starter surface, the partition member functions as a positioning member which positions the forming starter member.

As described above, the partition member is adapted to cover the portion of the molten material mass surface which portion is wider than the starter surface, while the cross sectional shape of the formed piece is determined depending upon the shape of the starter surface of the forming starter member. In other words, where a piece having a different cross sectional shape is required to be formed, the forming starter member has to be replaced by another suitable one, but the partition member does not have to be replaced. During the forming process, the partition walls are classified into the following groups: the group of partition walls each of which is subjected to the drawing of the molten metal on its opposite sides; the group of partition walls each of which is subjected to the drawing of the molten metal on only one of its opposite sides; and a group of partition walls each of which is not subjected to the drawing on either of its opposite sides. The grouping of the partition walls is not previously determined, but is determined depending upon the shape of the forming starter member. A circumferential wall defining the mold cavity of the conventional restrictor frame in the prior art has the same function as the partition wall which is subjected to the drawing of the molten material on only one of its opposite sides. However, in the prior art, there is not a member functionally equivalent to the partition wall which is subjected to the drawing of the molten metal on its opposite sides, nor a member functionally equivalent to the partition wall each of which is not subjected to the drawing on either of its opposite sides.

The segmental surfaces are classified depending upon the shape of the starter surface, into a group of segmental surfaces from which the molten material is drawn and a group of segmental surfaces from which the molten material is not drawn. The molten material is drawn from the segmental surface having at least a portion, which is brought into contact with or proximity to the starter surface while the forming starter member is kept in contact with or proximity to the partition member. The molten material is not drawn from the segmental surface which is not brought into contact with or into proximity to the starter surface. Therefore, the contour of the cross section of the drawn molten material is basically defined by aggregation of the segmental surfaces which the contour line of the starter surface crosses. However, the elevational shape of the drawn molten material is determined by the surface tension of the molten material and the length of the drawn molten material, while the cross sectional dimensions of the formed piece are determined by the solidification position of the drawn molten material. Where the molten material is solidified at a position near to the molten material mass surface, the cross sectional dimensions of the formed piece are made larger. Where the molten material is solidified at a position remote from the molten material mass surface, the cross sectional dimensions of the formed piece are made smaller. Thus, the cross sectional dimensions of the formed piece are not necessarily equal to those of the starter surface, but close to those of the starter surface. Where the length of the drawn molten material and the solidification position are kept in constant, for example, it is possible to obtain a formed piece whose cross sectional dimensions are not changed in the longitudinal direction.

(2) A forming method according to mode (1), characterized by forming the piece by solidifying the molten material which has been drawn through the partition member, while controlling a distance between the surface of the mass and the molten material which has been drawn through the partition member such that the distance has a predetermined value.

The cross sectional dimensions of the formed piece decrease with an increase in the drawing distance m, and increase with a decrease in the drawing distance m. Therefore, the cross sectional dimensions of the formed piece can be controlled to predetermined values, by controlling the drawing distance m to a predetermined value. The cross sectional dimensions of the formed piece can be kept constant in the drawing direction, by keeping the drawing distance m constant throughout the forming process.

(3) A forming method according to mode (1) or (2), characterized by separating the forming starter member and the partition member from each other while keeping the starter surface of the forming starter member and a material exit surface of the partition member parallel to each other, the starter surface and the material exit surface being brought into contact with or proximity to each other upon initiation of a forming process.

Where the forming starter member and the partition member are separated from each other while the starter surface and the material exit surface are held parallel to each other, as described in the present mode, a piece extending in the vertical direction is formed. Where the forming starter member and the partition member are separated from each other in a direction inclined with respect to the material exit surface, a piece having inclined side surfaces is formed. Where the starter surface and the material exit surface are rotated relative to each other about an axis extending perpendicularly to the material exit surface while the starter surface and the material exit surface are separated from each other in a direction parallel to the axis, a piece having a twisted shape or a spiral shape is formed. If the axis passes the center of the starter surface, the formed piece has a twisted shape. If the axis passes a position offset from the center of the starter surface, the formed piece has a spiral shape.

Where the forming starter member and the partition member are separated from each other in the direction inclined with respect to the material exit surface, the forming operation has to be carried out such that the molten material on the inclined side does not move across the partition walls of the partition member.

(4) A forming method according to mode (1) or (2), characterized by separating the forming starter member and the partition member from each other while rotating the forming starter member and the partition member relative to each other from a parallel state in which the starter surface of the forming starter member and a material exit surface of the partition member are parallel to each other, to a non-parallel state in which the starter surface and the material exit surface are inclined with respect to each other, the starter surface and the material exit surface being brought into contact with or proximity to each other upon initiation of a forming process.

In the present mode in which the forming starter member and the partition member are separated from each other while the forming starter member and the partition member are rotated relative to each other from the above-described parallel state to the above-described non-parallel state, a piece having curved side surfaces is formed.

(5) A forming method according to mode (4), characterized by cooling the molten material which has been drawn through the partition member, such that one of opposite sides of the molten material on which the starter surface and the material exit surface are separated from each other at a velocity higher than that on the other of said opposite sides is cooled at a velocity higher than that of the other of the opposite sides.

Where the forming starter member and the partition member are separated from each other while the forming starter member and the partition member are rotated relative to each other from the above-described parallel state to the above-described non-parallel state, if the opposite sides of the drawn molten material are evenly cooled, the drawing distance m on the one of the opposite sides on which the movement velocity is higher is made larger while the drawing distance m on the other side on which the movement velocity is lower is made smaller. Accordingly, the cross sectional dimensions of the formed piece on the one of the opposite sides on which the movement velocity is higher are reduced, while the cross sectional dimensions of the formed piece on the other side on which the movement velocity is lower are increased, whereby the curved side surfaces of the formed piece does not accurately follow the path described by the starter surface. If the forming starter and the partition member are separated from each other such that the movement velocity on the above-described other side has a suitable velocity, the above-described one side of the drawn molten material may possibly be torn apart. Further, there is a drawback that it is difficult to obtain a flatness on the solidification surface. In the present mode, the drawn molten material is cooled such that the side of the drawn molten material on which the movement velocity is higher is cooled at a velocity higher than the other side on which the movement velocity is lower. This equalizes the respective drawing distances m on the opposite sides of the drawn molten material to each other, thereby permitting the formed piece to have the curved side surfaces whose curvature accurately follows the path taken by the starter surface. Further, the present mode is effective to prevent tearing of the drawn molten material on the side on which the movement velocity is higher, and also makes it easy to obtain a flatness on the solidification surface.

(6) A forming method according to any one of modes (1)–(5), wherein the forming starter member is a hollow cylindrical member having a cylindrical wall portion and a bottom wall portion which closes one of opposite open ends of the hollow cylindrical member, the forming method being characterized by including a step of lowering a pressure in a space between the surface of the above-described mass and the bottom wall portion so as to introduce the molten material into the space, after the forming starter member and the partition member have been brought into contact with or proximity to each other thereby bringing an end face of the cylindrical wall portion and the surface of the mass into contact with each other.

(7) A forming method according to mode (6), characterized by lowering the pressure in the space located between the surface and the bottom wall portion, immediately after the end face of the cylindrical wall portion and the surface of the mass have been brought into contact with each other.

(8) A forming method according to mode (6), characterized by forming a piece having a cylindrical shape by separating the cylindrical wall portion and the surface of the above-described mass from each other after the end face of the cylindrical wall portion and the surface of the mass have been brought into contact with each other, and then lowering the pressure in the space located between the surface of the mass and the bottom wall.

Where the pressure in the space located between the molten material mass surface and the bottom wall portion is lowered after the end face of the cylindrical wall portion and the molten material mass surface have been brought into contact with each other, as described in mode (6), the molten material is introduced from those ones of the segmental surfaces which correspond to the space, into the space.

Where the step of lowering the above-described pressure is implemented upon initiation of the forming process, as described in mode (7), the shape of the end face of the formed piece does not correspond to that of the end face of the cylindrical wall portion, but is determined principally by the molten metal which is introduced into and solidified in the space. Therefore, with separation of the forming starter member and the partition member from each other, the piece is formed as a solid body.

However, a portion of the piece formed of the solidified molten metal which has been drawn into the space by the lowered pressure tends to have a composition different from that of a portion of the piece formed of the solidified molten metal which has been drawn by the separation of the forming starter member and the partition member from each other. In this case, the formed piece may be treated by a plastic working after the forming process, so as to make the formed piece homogeneous. If the velocity of the drawing of the molten metal by the lowered pressure is substantially equal to that of the drawing of the molten metal by the separation of the forming starter member and the partition member, the formed piece is substantially homogeneous, whereby the plastic working is not necessary. If the velocity of the drawing of the molten metal by the lowered pressure is considerably higher than that of the drawing of the molten metal by the separation of the forming starter member and the partition member, on the other hand, the formed piece is likely to be heterogeneous.

The portion of the piece formed of the solidified molten metal which has been drawn into the space by the lowered pressure may be cut off after the forming process. After this portion has been cut off, the end face of the formed piece (the shape of the cut surface) has a flat shape, which does not correspond to that of the end face of the cylindrical wall portion of the forming starter member, but is determined principally by the molten metal which is introduced into and solidified in the space.

The shape of the end face of the piece can be controlled by controlling the level of the lowered pressure in the initial period of the forming process. Where the pressure in the above-described space is so lowered that the space is filled with the molten material, the end face of the formed piece has a shape corresponding to the space. Where the pressure in the space is not so lowered, the end face of the formed piece has a shape corresponding to a portion of the space which portion is occupied by the solidified molten metal. If at least one projecting portion is provided to the inner surface of the cylindrical wall portion or the inner surface of the bottom wall portion such that the molten metal introduced into the space exerts a force on the projecting portion after having been solidified, the adhesion of this molten metal to the forming starter member is strengthened, preventing the removal from the forming starter member.

Where the step of lowering the pressure in the space is implemented after the piece having the cylindrical shape has been formed by the separation of the forming starter member and the partition member from each other, as described in mode (8), a hollow cylindrical piece having a bottom wall portion which closes an axial end of the piece is formed. After the length of the hollow cylindrical piece has increased to a predetermined value, the pressure is lowered with or without further separation of the forming starter member and the partition member, whereby the molten material is introduced into the space so as to form the bottom wall portion. That is, the end face of the formed piece does not have an annular shape but has a plane shape. In the process of forming the hollow cylindrical piece, the pressure in the space (inside the cylindrical wall portion) is desirably kept at the atmospheric pressure or a level slightly higher than the atmospheric pressure, in order to prevent the molten metal from being introduced into the space from those ones of the segmental surfaces which correspond to the space .

As described above, the use of the hollow-cylindrical-shaped forming starter member having the bottom wall portion and the suitable adjustment of the pressure in the space make it possible to selectively form the solid piece, or the hollow cylindrical piece having the bottom wall portion. The end face of the formed piece can have an annular shape corresponding to the shape of the end face of the cylindrical wall portion, or alternatively a shape determined principally by the molten metal which is introduced into and solidified in the space. The step of lowering the pressure in the space can be considered an end-face-shape changing step or a cross-sectional-shape changing step.

(9) A forming method according to any one of modes (1)–(8), characterized by advancing a shielding member into a position located between the partition member and at least a portion of the molten material which has been drawn through the partition member.

According to the present mode, the shielding member separates at least a portion of the drawn molten material and the partition member from each other, whereby the shielding member prevents the molten material from being continuously drawn through the partition member from the segmental surfaces which are covered by the shielding member. The cross sectional area of the formed piece after the activation of the shielding member is reduced, becoming smaller than that before the activation of the shielding member by an amount corresponding to the area of the separated portion. Where the shielding member is progressively moved toward the advanced position as the forming process progresses, the cross sectional area of the formed piece is progressively changed. Where the shielding member is rapidly moved toward the advanced position, the cross sectional area of the formed piece is changed in steps. In any case, a change in the shape of the portion separated by the shielding member leads to a change in the shape of a reduction surface which is provided on the formed piece, thereby making it possible to diversify the shape of the reduced cross section of the formed piece. Namely, it is possible to form pieces having different shapes in their respective reduced cross sections even if the pieces had the same cross sectional shapes before the reduction in their cross sections. The forming method of the present invention in which the cross sectional area of the formed piece is thus reduced can be referred to as a cross-section-reduction forming method.

If the entirety of the drawn molten material is separated by the shielding member from the partition member, the formed piece is made cut off. In this case, the present step can be referred to as a formed-piece cutting-off step. The use of the shielding member for cutting off the formed piece with a predetermined length thereof saves the molten material, thereby improving the yield rate. Namely, it is more effective to save the molten material than where a piece having a long-length piece is first formed and then cut into pieces each having a desired length.

(10) A forming method according to any one of modes (1)–(9), characterized by positioning an auxiliary starter member having a first surface and a second surface which is adjacent to the first surface, in an auxiliary start position in which the first surface contacts the molten material drawn through the partition member while the second surface contacts or is in proximity to the partition member, so that the second surface is brought into contact with the surface of the above-described mass, and then implementing a step of separating the auxiliary starter member and the partition member from each other at a velocity substantially equal to a velocity at which the forming starter member and the partition member are moved relative to each other.

The auxiliary starter member is moved to the auxiliary start position so that the first surface is brought into contact with the drawn molten material while the second surface adjacent to the first surface is brought into contact with the partition member. Ones of the segmental surfaces corresponding to the starter surface of the forming starter member and ones of the segmental surfaces corresponding to the second surface of the auxiliary starter member are adjacent to each other. The auxiliary starter member and the partition member are separated from each other at a velocity substantially equal to that of the movement of the forming starter member and the partition member relative to each other, the drawn molten material between the solidification surface and the partition member and the drawn molten material between the starter surface of the auxiliary starter member and the partition member are solidified integrally with each other. The cross sectional area of the formed piece is increased by an amount corresponding to the area of the second surface, to a value almost equal to a sum of the respective areas of the starter surface and the second surface. The second surface can be referred to as an auxiliary starter surface, while the present step can be referred to as a cross-section expansion step.

A change in the shape of the second surface leads to a change in the shape of the expansion surface, thereby making it possible to diversify the shape of the expanded cross section of the formed piece. Namely, it is possible to form pieces having different shapes in their respective expanded cross sections even if the pieces had the same cross sectional shapes before the expansions in their respective cross sections. After the molten material drawn by the formed piece and the molten material drawn by the auxiliary starter member have been solidified integrally with each other into an integrally formed piece, further molten material is drawn by the solidification surface of the integrally formed piece. After the initiation of the drawing by the solidification surface of the integrally formed piece, at least one of the forming starter member and the auxiliary starter member may be parted from the integrally formed piece, and is no longer moved with the integrally formed piece.

(11) A forming method according to any one of modes (1)–(10), wherein the molten material is accommodated in a plurality of accommodation containers, the forming method being characterized by bringing the piece formed by the molten material accommodated in one of the plurality of accommodation containers, into contact with or proximity to the partition member of the other of the plurality of accommodation containers, and implementing a step of separating the partition member of the other of the plurality of accommodation containers and the formed piece from each other, so as to add a newly formed piece to the previously formed piece.

In the present method, it is possible to extend the formed piece in the forming direction by repeatedly adding a newly formed piece to the early formed piece. In this case, the end face of the formed piece which is brought into contact with or proximity to the partition member, serves as the starter surface. The formed piece and the forming starter member may be separated together with each other from the partition member, or alternatively, the forming starter member is removed from the formed piece while the formed piece is separated from the partition member.

(12) A forming method according to mode (11), characterized in that the molten material accommodated in the above-described one of the plurality of accommodation containers and the molten material accommodated in the above-described other of the plurality of accommodation containers are of the same kind.

In the present method, it is possible to form a piece having a large length. Where the piece is formed by using molten material accommodated in a single accommodation container, the maximum possible length of the formed piece depends upon the capacity of the accommodation container. Where the plurality of accommodation containers are available to accommodate the molten material therein, the maximum possible length of the piece is larger than where the piece is formed by using the molten material accommodated in the single accommodation container.

(13) A forming method according to mode (11), characterized in that the molten material accommodated in the above-described one of the plurality of accommodation containers and the molten material accommodated in the above-described other of the plurality of accommodation containers are of different kinds.

In the present method, it is possible to form a piece whose material is changed in steps as viewed in the forming direction. In other words, it is possible to obtain a formed piece similar to a piece made by connecting pieces which have been individually formed of respective different kinds of molten materials.

The present forming method is effective to form a piece having longitudinal portions which are exposed to different environments. Where the piece is entirely formed of a single kind of material, the material should withstand the severest environment. If the material is expensive, and the overall cost of the formed piece is increased. If this material is hard to be formed, the operation efficiency is reduced. Where only the portion which is used under the severest environment is formed of a suitable material, the cost is reduced while the operation efficiency is improved.

(14) A forming method according to any one of mode (1)–(13), characterized by disposing the partition member in the vicinity of an upper surface of the mass provided by the molten material, and separating the partition member and the forming starter member from each other while controlling a relative height of the partition member and the upper surface to a predetermined value.

The partition member disposed in the vicinity of the upper surface and the forming starter member are separated from each other, so that the molten material is drawn upward from the upper surface of the molten material mass. The drawn molten material is solidified into a piece. The present forming method in which the piece is formed by drawing the molten material upward can be referred to as an drawing-up method.

During the forming process, the relative height of the partition member and the upper surface of the molten material mass is controlled so as to have the predetermined value. For instance, the height of the upper surface relative to the partition member is desirably held constant during the forming process, so that the molten material is constantly drawn up thereby stabilizing the cross sectional dimensions of the formed piece. In the initial period of the forming process, the height of the upper surface relative to the partition member is desirably controlled such that the upper surface is slightly higher than the material exit surface. When the upper surface is thus located slightly higher than the material exit surface, the upper surface protrudes upwardly from the material exit surface owing to surface tension of the molten material. Accordingly, with the forming starter member being in contact with or proximity to the partition member, ones of the segmental surfaces corresponding to the starter surface are surely brought into contact with the starter surface. After that, the height of the upper surface relative to the partition member is desirably controlled such that the upper surface is lower than the material exit surface, for thereby stabilizing the shape of the molten material adhering to the starter surface.

(15) A forming method according to any one of modes (1)–(13), wherein the partition member constitutes at least a portion of a bottom wall of the accommodation container which accommodates therein the molten material, the forming method being characterized by separating the partition member and the forming starter member from each other, while controlling at least one of pressures in respective upper space and lower space such that the pressure in the upper space is lower than the pressure in the lower space by a value satisfying a predetermined condition, the upper space being located above the molten material accommodated in the accommodation container, the lower space being located below the partition member.

The partition member is provided so as to constitute a portion of the bottom wall of the accommodation container which accommodates the molten material therein, while the pressure in the upper space is made lower than the pressure in the lower space by a suitable value (which is substantially equal to a head pressure of the molten material acting downward owing to a gravity), so that a leakage of the molten material from the accommodation container is prevented. After the starter surface of the forming starter member and the lower surface of the molten material mass have been brought into contact with each other, the forming starter member and the partition member is separated from each other, so that the molten material is drawn downward from the lower surface, and the drawn molten material is solidified from the portion nearer to the forming starter member, so as to form a piece. Thus, this forming process of the present invention in which the molten material is drawn downward can be referred to as a drawn-down method.

For making the pressure in the upper space lower than the pressure in the lower space by a value satisfying a predetermined condition, any one of the pressures in the respective upper and lower space may be controlled, or alternatively both of the pressures in the respective upper and lower spaces may be controlled.

Where the difference between the pressure in the upper space and the pressure in the lower space is small, the position of the lower surface of the molten material mass becomes closer to the material exit surface of the partition member. Where the difference is large, the position of the lower surface becomes further away from the material exit surface. That is, the relative position of the lower surface of the molten material mass and the partition member is controlled by controlling the difference between the pressures in the respective upper and lower spaces.

Specifically described, where the pressure in the upper space is lower than the pressure in the lower space by a value equal to the head pressure of the molten material accommodated in the accommodation container (where the pressure difference is equal to the head pressure), the lower surface is located at substantially the same position as the material exit surface of the partition member. Where the pressure in the upper space is lower than the pressure in the lower space by a value higher than the head pressure (where the pressure difference is higher than the head pressure), the lower surface is located above the material exit surface of the partition member. Where the pressure in the upper space is lower than the pressure in the lower space by a value lower than the head pressure (where the pressure difference is lower than the head pressure), the lower surface is located below the material exit surface. Also in the last case, the pressure difference needs to be controlled such that the molten material does not drip from the material exit surface, and such that the lower surface does not excessively protrude downwardly owing to the surface tension.

In the initial period of the forming process, the pressure difference is controlled to be smaller than the head pressure so that the lower surface of the molten material protrudes downward, while the starter surface is brought into contact with or proximity to the partition member, whereby the molten material surely adheres to the starter surface. The pressure difference is then controlled to be larger than the head pressure while the starter surface is separated from the partition member, whereby the shape of the drawn molten material is stabilized. The stabilization of the shape of the drawn molten material throughout the forming process assures a formation of a piece having high accuracy in its cross sectional dimensions. In the initial period of the forming process, before the separation of the starter surface and the partition member from each other, it is preferable that the starter surface be brought into contact with or close proximity to the partition member so that the molten material is drawn through the partition member. In this instance, however, the starter surface may be simply made close to the partition member while the pressure difference is made smaller than the head pressure.

(16) A forming method according to any one of modes (1)–(15), wherein the forming starter member and the partition member are separated from each other, while a temperature of the molten material which has been drawn through the partition member is adjusted.

(17) A forming method according to any one of modes (1)–(16), wherein the forming starter member and the partition member are separated from each other, while outer side surfaces of the molten material which has been drawn through the partition member is cooled.

(18) A forming method according to any one of modes (1)–(17), wherein the forming starter member and the partition member are separated from each other, while outer side surfaces of the molten material which has been drawn through the partition member is heated.

(19) A forming method according to any one of modes (1)–(18), wherein the molten material is solidified into the formed piece, while a velocity at which the forming starter member and the partition member are moved relative to each other is controlled.

(20) A forming method according to any one of modes (1)–(19), wherein the molten material is solidified into the formed piece, while a distance between the molten material which has been drawn and the surface of the above-described mass is held substantially constant.

The shape of the solidification surface, solidification velocity, forming velocity, cross sectional area of the formed piece (distance between the drawn molten material and the molten material mass surface), and composition of the formed piece can be controlled, by adjusting the temperature of the drawn molten material and/or controlling the velocity of the relative movement of the forming starter member and the partition member.

For adjusting the temperature of the drawn molten material, the drawn molten material may be directly cooled or heated, or alternatively, may be indirectly cooled or heated by cooling or heating the formed piece. Further, the temperature of the drawn molten material at its end face or outer side surfaces may be adjusted. Still further, the cooling temperature, heating temperature, cooling position, and/or heating position may be adjusted.

The shape of the solidification surface of the molten material is desirably concave or flat. If the solidification surface has a convex shape, the molten material is solidified within the partition member, possibly making it difficult to draw the molten material through the partition member. This problem can be solved, for example, by cooling the outer side surfaces of the drawn molten material. A formed piece 730 is cooled at its portion located in the vicinity of a partition member 732, as shown in FIG. 34, so that the outer side surfaces of a drawn molten material 734 is cooled. In this arrangement, the outer portion of the drawn molten material 734 is solidified earlier than the inner portion of the drawn molten material 734, whereby a solidification surface 736 is made concave. The temperature at the outer portion is normally made lower than that at the inner portion, even without cooling particularly the outer side surfaces, so that the outer portion is solidified earlier than the inner portion. However, where the outer side surfaces are positively cooled, the solidification surface is made concave with higher stability than where the outer side surfaces are not cooled, thereby making it possible to increase the solidification velocity.

It is desirable that the solidification surface be held flat at least when the formed piece is cut off. The solidification surface can be made flat, for example, by heating the outer side surfaces of the drawn molten material 734. The difference between the respective temperatures at the outer and inner portions of the drawn molten material 734 is reduced by heating the outer side surfaces of the drawn molten material 734, whereby the solidification surface is made substantially flat. It is noted that the temperature difference can be held minimized by simply keeping the temperature constant at the outer side surfaces, namely, preventing the temperature at the outer side surfaces from being lowered. In this case, keeping the temperature constant is considered one form of heating. Where a portion of the formed piece 730 which has been separated from the partition member 732 is cooled at its end face as well as at its outer side surfaces, the temperature at the inner portion of the drawn molten material 736 may be possibly made lower than the temperature at the outer portion of the drawn molten material 736, whereby the solidification surface 736 may be convex. That is, the solidification surface 736 can be made flat by adjusting the cooling position of the formed piece 730 and the cooling temperature.

The cooling velocity is increased by lowering the cooling temperature. The increase in the cooling velocity can make the solidification velocity increased. Thus, where the velocity of the relative movement of the forming starter member and the partition member is controlled in view of the increase in the solidification velocity, the forming velocity can be increased.

The distance between the drawn molten material and the molten material mass surface can be controlled so as to have a predetermined value, as described in mode (2), by controlling conditions for controlling the temperature of the formed piece or drawn molten material such as the heating position, heating temperature, cooling position and cooling temperature, and/or by controlling the velocity of the relative movement of the forming starter member and the partition member. Since the drawing distance can be thus controlled, the cross sectional area (cross sectional contour) of the formed piece can be controlled. It is also possible to hold the drawing distance constant, as in the forming method as described in mode (20), whereby the cross sectional area of the formed piece can be held constant. The forming method of mode (20) corresponds to a case in which the predetermined value is constant in the forming method of mode (2).

Further, by controlling the solidification velocity and the temperature condition of the drawn molten material, it is possible to control a solidification process of the formed piece, so as to adjust physical characteristics of the formed piece.

(21) A forming method according to any one of modes (1)–(20), wherein the forming starter member and the partition member are separated from each other while the molten material is stirred.

The stirring of the molten material during the forming process is effective to form a homogeneous piece. The molten material generally includes various kinds of substances. Thus, when the molten material is drawn through the partition member so as to form a piece, these various kinds of substances are not evenly drawn through the partition member. In this instance, ones of the substances which are easily solidificable and ones of the substances each having a higher degree of wettability with respect to the partition member are drawn and solidified earlier than the other substances. Accordingly, in the accommodation container, a portion of the molten material located in the vicinity of the partition member and a portion of the molten material located remote from the partition member tend to have respective compositions different from each other. Further, the formed piece tends to have a variation in its composition as viewed in the forming direction. In view of these tendencies, the molten material accommodated in the accommodation container is stirred to as to promote even distribution of the components of the molten metal, and thereby minimizing a variation in the composition of the formed piece in the forming direction.

The stirring of the molten material is also effective to reduce a local variation in the temperature of the molten material. Without the stirring of the molten material, the temperature of the molten metal in the lower portion of the accommodation container is lowered, owing to convection, than the temperature in the upper portion.

(22) A forming method according to any one of modes (1)–(21), wherein the forming starter member and the partition member are separated from each other, while a space surrounding the molten material is supplied with a gas.

The above-described space is supplied with the gas, for the purpose of preventing oxidation of the molten material as well as cooling the molten material. To this end, the gas is adapted to exclude at least oxygen, and is supplied to the drawn molten material and the molten material mass surface. In the forming method of the present mode, even if the molten material generally has a high degree of reactivity, the oxidation of the molten material can be prevented thereby obtaining a formed piece having a high quality (Such a molten material constituted by a single substance which has a high degree of reactivity, or constituted by a plurality of substances at least one of which has a high degree of reactivity is referred to as molten material "generally having a high degree of reactivity"). Even if the molten material includes an activated metal thereby having a considerably high degree of reactivity, it is possible to form a piece while preventing the oxidation of the molten material. Further, since the above-described space surrounding the molten material is slightly pressurized with the supply of the gas to the space, the forming process can be satisfactorily performed even if the molten material has a high vapor pressure or containing a large volume of gases.

As the gas to be supplied to the space, a suitable inert gas such as beryllium and argon, or a suitable nitrogen gas is preferably used. The use of the nitrogen gas is effective to reduce the operation cost, while the use of the inert gas is effective to prevent the molten from reacting with substances other than oxygen.

(23) A forming method according to any one of modes (1)–(22), wherein the molten material is solidified into the formed piece, while a relative position of the partition member and the surface of the molten material mass is controlled to a predetermined position.

It is desirable that the relative position of the partition member and the surface of the molten material mass be held constant during the forming process, except particular cases, which will be described in mode (76), such as a case where the partition member includes an inclined portion. Holding the relative position constant is effective to stabilize the drawing of the molten material thereby stabilizing the cross sectional shape of the formed piece and preventing variation in the shape of the formed piece in the forming direction.

Specifically described, in the drawing-up method as described in mode (14), the relative position of the partition member and the upper surface of the molten material mass is controlled so as to correspond to a predetermined position. In the drawing-down method as described in mode (15), the difference between the pressures in the respective upper and lower spaces is controlled so as to correspond to a predetermined value.

(24) A forming method according to mode (23), including a step of controlling a relative position of the surface of the above-described mass and a material exit surface which is one of opposite sides of the partition member that is closer to the forming starter member, such that the relative position corresponds to a predetermined position, after the forming starter member has been brought into contact with or proximity to the partition member while the surface of the mass has been moved toward the material exit surface, whereby the surface of the mass has been brought into contact with the starter surface of the forming starter member.

The movement of the molten material mass surface toward the material exit surface of the partition member permits the molten material mass surface to surely contact the starter surface of the forming starter member, so that the molten material surely adheres to the starter surface. The molten material mass surface is then backed away from the material exit surface while the forming starter member and the partition member are separated from each other in a short distance, for thereby inducing a necking which facilitates the stabilization of the shape of the molten material adhering to the forming starter member. During the forming process, the molten material mass surface is made to have substantially the same position as the material exit surface, thereby stabilizing the drawing of the molten material and accordingly the shape of the formed piece. The above-described predetermined position may be, for example, substantially equal to the position of the material exit surface. For inducing the necking, the forming starter member may be separated from the partition member without backing the molten material mass surface away from the material exit surface, or alternatively the molten material mass surface may be backed away from the material exit surface without separating the forming starter member from the partition member.

In the drawing-up method, for example, the partition member is lowered such that the molten material mass surface is located slightly higher than the material exit surface, while the forming starter member is brought into contact with or proximity to the partition member. After the molten material has adhered to the starter surface, the partition member is raised such that the molten material mass surface is located lower than the material exit surface of the partition member, while the forming starter member is slightly moved upward. During the forming process, the position of the molten material mass surface is held substantially the same level as, is or slightly lower than that of the material exit surface.

In the drawing-down method, the forming starter member is brought into contact with or proximity to the partition member whereby the starter surface contacts the molten material mass surface, while the difference between the pressures in the respective upper and lower spaces is made slightly smaller than the head pressure so that the molten material mass surface slightly protrudes downward from the material exit surface of the partition member. The pressure difference is then increased so as to be slightly larger than the head pressure, while the forming starter member is moved downward by a short distance. In this instance, both of the increase of the pressure difference and the downward movement of the forming starter member do not necessarily have to be effected, but at least one of them may be effected. During the forming process, the pressure difference is held substantially equal to the head pressure. The molten material should not be dripped from the partition member due to the surface tension when the pressure difference is decreased to be smaller than the head pressure.

The step described in the present mode is a preliminary step which is implemented upon initiation of the forming process.

(25) A forming process according to any one of modes (1)–(24), including a step of simultaneously giving the forming starter member and the partition member a vertical motion in which the forming starter member and the partition member are vertically separated from each other while the starter surface and a material exit surface of the partition member are held parallel to each other, and at least one additional motion other than the vertical motion, the starter surface and the material exit surface being brought into contact with or proximity to each other upon initiation of the forming process.

During the forming process, normally, the forming starter member and the partition member are separated from each other in the vertical direction while the starter surface and the material exit surface are held parallel to each other. However, it is possible to form a piece having a shape other than a simple bar shape, where the forming starter member and the partition member are provided with not only the vertical motion away from each other but also other motions. The other motions are classified into a parallel keeping motion in which the forming starter member and the partition member are moved relative to each other while the starter surface and the material exit surface are held parallel to each other, and a non-parallel motion in which the two members are moved relative to each other while the two surfaces are not held parallel to each other. Further, the two members can be three-dimensionally moved relative to each other.

(26) A forming method according to any one of modes (1)–(25) including a step of horizontally moving the forming starter member and the partition member relative to each other.

In the present mode, the forming starter member and the partition member may be horizontally moved relative to each other at the same time while the two members are vertically separated from each other with the starter surface and the material exit surface held parallel to each other. Or alternatively, the horizontal relative movement may be provided to the two members before or after the vertical motion away from each other. In the former case where the horizontal relative movement and the vertical motion are simultaneously provided to the two members, this horizontal relative movement corresponds to one of the at least one motion other than the vertical motion described in mode (25), and belongs to the above-described parallel keeping movement. Where the forming starter member and the partition member are moved relative to each other in the horizontal direction while the two members are separated from each other in the vertical direction, a piece having an inclined shape is formed.

(27) A forming method according to any one of modes (1)–(25) including a step of rotating the forming starter member and the partition member relative to each other.

As in the forming method of mode (26), where the relative rotation and the vertical motion are simultaneously provided to the two members, this relative rotation corresponds to one of the at least one motion other than the vertical motion described in mode (25), and belongs to the above-described parallel keeping movement. Where a piece to be formed has in its cross section a non-circular shape, a twisted bar or wire is obtained as the formed piece if the center of the relative rotation is located at the center of the cross section of the piece. If the center of the relative rotation is located at a position offset from the center of the cross section of the piece, a spiral bar or wire is obtained as the formed piece whether the cross section is circular or not. That is, where the forming starter member and the partition member are rotated relative to each other about a rotation axis passing a point which is unevenly distant from points lying on the contour line of the cross section, a piece having a diversified contour can be formed. In particular, where the rotation axis passes outside the contour of the cross section, a coil can be obtained as the formed piece. In this case, if the cross section is tubular, a hollow coil can be obtained.

(28) A forming method according to any one of modes (1)–(27) including a step of moving the partition member and the forming starter member relative to each other at a velocity which permits the drawn molten material to be torn into two parts.

As described above, by increasing the velocity of the relative movement of the forming starter member and the partition member, the drawn molten material can be torn apart, so that the formed piece can be cut off. In this case, the drawn molten material and the molten material within the partition member, i.e., the molten material accommodated in the accommodation container are separated from each other.

The forming starter member and the partition member may be moved relative to each other in the vertical direction, or the horizontal direction, or alternatively in a direction perpendicular to these directions. Before the partition member and the forming starter member are moved relative to each other, it is desirable that the molten material mass surface be moved in a direction away from the material exit surface toward the other side of the partition member. Namely, in the forming-up method, the molten material mass surface is desirably made lower than the material exit surface of the partition member, before the relative movement of the partition member and the forming starter member. In the forming-down method, the molten material mass surface is desirably made higher than the material exit surface of the partition member, before the relative movement of the partition member and the forming starter member. The step of the present mode can be referred to as a formed-piece cutting-off step. The method including this formed-piece cutting-off step can be referred to as a high-velocity-relative-movement-cutting-off method.

The velocity of the relative movement of the forming starter member and the partition member in the vertical direction for tearing the drawn molten material is determined by a degree of the surface tension of the molten material and other factors. In the constant temperature condition of the drawn molten material, the drawing distance m is increased with an increase in the velocity of the relative movement. If the surface tension of the molten material is large enough to maintain the shape of drawn molten material between the partition walls and the formed piece, the drawn molten material is not torn apart even when the drawing distance m is large. If the drawing distance m is too large for the molten metal to maintain its shape owing to the surface tension, the drawn molten metal is torn apart. Therefore, if the velocity of the relative movement is too high for the molten material to maintain its shape owing to the surface tension, the drawn molten material is torn apart.

Where the forming starter member and the partition member are horizontally moved relative to each other for thereby cutting off the formed piece, the velocity of the relative movement in the horizontal direction has to be considerably larger than that of the movement in the vertical movement. (For example, the velocity of the horizontal movement has to be equal to or larger than thirty times of that of the vertical movement.) In this view, the maximum movement stroke in the horizontal direction has to be wider than the thickness of the piece to be formed.

The partition member and the forming starter member may be rotated relative to each other, for cutting off the formed piece. In this case, the center of the relative rotation is desirably located outside the area of the formed piece.

(29) A forming method according to any one of modes (9), (16)–(28) including a step of separating the shielding member together with the forming starter member from the partition member, after the shielding member has been advanced into the draw molten material.

Where the shielding member is separated together with the forming starter member away from partition member, a portion of the molten material located in one of opposite sides of the shielding member which is closer to the formed piece is solidified, whereby a reduction surface is provided to the formed piece. For example, in the drawing-up method, if the shielding member were not moved with the formed piece, a portion of the molten material which has not yet solidified possibly drips in a direction away from the formed piece. Particularly, where the solidification surface has a concave shape, the unsolidified portion of the molten material is more likely to drip. This results a recessing on the corresponding part (on the reduction surface) due to insufficiency of the molten material. In the present mode, on the other hand, the movement of the shielding member together with the formed piece prevents the dripping of the molten material and accordingly the recessing on the reduction surface due to insufficiency of the molten material.

(30) A forming method according to any one of modes (9), (16)–(28) including a step of separating the forming starter member and the partition member from each other while leaving the shielding member in a position proximate to the partition member, after the shielding member has been advanced into the drawn molten material.

For example, in the drawing-down method, even if the shielding member is not moved together with the formed piece, the molten material does not drip whereby the recessing due to insufficiency of the molten material is not provided to the reduction surface. Thus, the shielding member does not have to be moved with the formed piece relative to partition member.

While the forming starter member and the partition member are separated from each other, the shielding member may be held stationary, or alternatively may be moved in a direction intersecting the forming direction. The shielding member is usually advanced into the drawn molten material without interrupting the relative movement of the forming starter member and the partition member. That is, the latter case is usually selected. The selection of the two ways also depends upon the shape of the shielding member. Where the shielding member has a plate-like shape having a width larger than that of the formed piece, the shielding member is usually held stationary. Where the shielding member has a rod-like shape, the shielding member is usually moved.

(31) A forming method according to any one of modes (1)–(30) including a step of moving a shielding member to a position so that the shielding member traverses an entirety of the cross section of the drawn molten material.

Where the entirety of the cross section of the drawn molten material is traversed by the shielding member, the molten material is completely divided into a portion thereof still accommodated in the partition member and a portion thereof located on one of opposite sides of the shielding member which is closer to the formed piece, so that the formed piece is cut off. The present step can be referred to as a cutting-off-by-shielding-member step.

For example, if the shielding member has a plate-like shape whose cross sectional area is larger than the cross sectional area of the drawn molten material, the entirety of the cross section of the drawn molten material can be traversed by the shielding member when the shielding member has been moved to the advanced position. If the shielding member has a rod-like shape whose cross sectional area is smaller than the cross sectional area of the drawn molten material, the shielding member is moved in a suitable direction from the advanced position after being moved to the advanced position, so as to traverse the entire cross section of the drawn molten material, or alternatively cooperates with another or other rod-like shaped shielding member or members which has also been moved to the advanced position so as to cover the entire cross section of the drawn molten material.

(32) A forming method according to any one of modes (10), (16)–(31), including a step of separating the auxiliary starter member and the partition member from each other at a velocity substantially equal to a velocity at which at least two formed pieces and the partition member are moved relative to each other, after the auxiliary starter member has been moved to a connection auxiliary start position in which the auxiliary starter member is in contact with at least one of side surfaces of the formed pieces and the drawn molten material while being in contact with or in proximity to the partition member.

In the present step, a U-shaped piece can be obtained by connecting the at least two formed pieces. Thus, the step of the present mode can be referred to as a formed-piece connecting step, while the forming method including the present step can be referred to as a U-shaped-piece forming method.

The above-described at least two pieces may be pieces which have been previously formed, or alternatively may be pieces which are in the process of formation. In the former case in which the pieces have been previously formed, the auxiliary starter member contacts the formed pieces in the connection auxiliary start position. In the later case in which the pieces are in the process of formation, the connection auxiliary starter member usually contacts the drawn molten material as well as the formed pieces in the auxiliary start position.

(33) A forming method according to any one of modes (1)–(32) including a step of lowering a pressure in an internal space within a shape adding member having a first surface and a second surface which is adjacent to the first surface, after the shape adding member has been positioned in a shape adding position in which the first surface is in contact with the drawn molten material while the second surface is in contact with or proximity to the partition member, the internal space being open in the first surface and the second surface.

After the shape adding member has been positioned in the shape adding position, the pressure in the internal space is lowered, so that the molten material is introduced into and solidified in the internal space. As a result, the solidified molten material is combined with the formed piece. In other words, a formed part having a shape corresponding to a shape of the internal space is added to the formed piece. As in the above-described cases of the modes (6) and (8), since the composition of the portion which has been added by the lowered pressure is possibly different from that of the portion which has been formed by the relative movement of the forming starter member and the partition member, the thus obtained piece is preferably subjected to a forging or other suitable plastic working process after the forming process, so as to make the formed piece homogeneous.

(34) A forming method according to any one of modes (14), (16)–(33), wherein the partition member and the forming starter member are separated from each other, while a distance between the partition member and a bottom wall of the accommodation container which accommodates the molten material therein is controlled so as to have a predetermined value.

The height of the upper surface of the molten material relative to the partition member can be controlled by controlling the distance between the partition member and the bottom wall of the accommodation container accommodating therein the molten material. Where the amount of the molten material mass is constant, the above-indicated height is reduced with an increase in the above-indicated distance while the height is increased with a decrease in the distance.

(35) A forming method according to any one of modes (14), (16)–(34), wherein the partition member and the forming starter member are separated from each other, while a relative height of the partition member and the upper surface of the above-described mass is held constant.

For example, the above-described relative height can be held constant, by decreasing the distance between the partition member and the bottom wall of the accommodation container as the molten material is drawn (as the forming process is progressed) in the method of mode (34).

(36) A forming method according to any one of modes (15)–(34), wherein the forming starter member and the partition member are moved relative to each other, while at least one of the pressures in the respective upper and lower spaces is controlled such that the pressure in the upper space is lower than the pressure in the lower space by a value substantially equal to a head pressure of the molten material accommodated in the accommodation container, the upper space being located above the molten material accommodated in the accommodation container, the lower space being located below the partition member.

By holding the difference between the pressures in the respective upper and lower spaces substantially equal to the head pressure, the position of the material exit surface of the partition member and that of the molten material mass surface can be held substantially equal to each other, so that the molten material is stably drawn through the partition member without dripping of the molten material.

(37) A forming method according to any one of modes (1)–(36), wherein the piece is formed while the molten material is supplied to an accommodation container which accommodates the molten material therein.

Where the piece is formed while the molten material is supplied to the accommodation container, the molten material may be intermittently supplied, or alternatively may be continuously supplied to the accommodation container. Namely, for example, the molten material may be supplied to the accommodation container when the amount of the molten metal accommodated in the accommodation container is decreased to a predetermined value, or alternatively may be always supplied to the accommodation container. Without supplying the accommodation container with the molten material, the maximum possible size of the formed piece depends upon the capacity of the accommodation container. However, the supply of the molten material to the accommodation makes it possible to form a piece having a large size or a large length even if the accommodation container has a small capacity for accommodating the molten material therein.

The piece having a large size or a large length can be formed by the method, as described in mode (12) in which the piece is formed by using the molten material accommodated in the plurality of the accommodation containers. However, the method of mode (12) is inconvenient for forming a piece having a considerably large length. In the method of the present mode, on the other hand, the piece having a considerably large length also can be easily formed.

(38) A forming method according to mode (37), wherein the molten material is supplied to the accommodation container such that an amount of the molten material accommodated in the accommodation container is held constant.

For example, in the drawing-up method, at least one of the partition member and the bottom wall of the accommodation container has to be moved so that the relative position of the partition member and the upper surface of the molten material mass is controlled to have a predetermined position. In the present mode, none of the partition member and the bottom wall has to be moved, since the amount of the molten material in the accommodation container is held constant.

In the drawing-down method, both of the pressures in the respective upper and lower spaces have to be controlled such that the difference between the respective pressures corresponds to a predetermined value. In the present mode there is a case in which the pressure in the upper space is held constant. In such a case, only the pressure in the lower space has to be controlled.

(39) A forming method according to any one of modes (1)–(38), wherein a plurality of forming starter members and at least one partition member are simultaneously separated from each other.

Where the plurality of forming starter members and the at least one partition member are simultaneously separated from each other, a plurality of pieces can be simultaneously formed, thereby improving the efficiency of the production.

The plurality of forming starter members may have respective starter surfaces whose shape are the same, or may have respective starter surfaces whose shape are different from each other. In the forming method of the present invention, the partition member need not be replaced by another one for forming a piece having a different shape. Thus, it is possible to simultaneously form various kinds of pieces by employing the single partition member.

The forming method of the present mode includes also a case where each of a plurality of partition members which are disposed in a single accommodation container, and the corresponding one of the plurality of forming starter members are separated from each other. Where the accommodation container has a large area at its opening, for example, the partition member should have an accordingly large so as to cover the large area. However, it is difficult to produce the partition member having a large size, while assuring a certain degree of strength of the partition member. For this reason, the plurality of partition members are disposed in the single accommodation container.

The forming method of the present mode can be referred to as a plural-piece simultaneously forming method. This forming method can be applicable to a forming system including a plurality of accommodation containers.

The above-described object may be achieved by a forming system according to the following modes having respective features.

(40) A forming system which separates a surface of a mass of a molten material and a forming starter member which has been brought into contact with the surface, from each other, so that the molten material is drawn owing to a surface tension of the molten material, whereby the molten material is solidified into a piece, the forming system being characterized by including a partition member having partition walls which divide the surface of the above-described mass.

Each of the partition walls of the partition member may have any shape which permits the partition walls to divide the molten material mass surface into the segmental surfaces. The partition wall may extend perpendicularly to the molten material mass surface, or may be inclined with respect to the molten material mass surface. Further, the partition wall may have a flat-plate shape, or may have a curved-plate shape. The partition walls may be arranged linearly so as to be parallel to each other, or may alternatively be arranged in a radial pattern, in a concentric pattern, or in a spiral pattern. Further, the partition walls may be arranged in a combination of these patterns, or may be irregularly arranged. Each of the partition walls does not have to have a constant shape.

(41) A forming system according to mode (40), characterized by including a molten-material-drawing-distance control device which controls a distance between the surface of the above-described mass and a solidification surface of the molten material which has been drawn through the partition member such that the distance has a predetermined value, while the surface of the mass and the forming starter member are separated from each other.

As described above, the cross sectional dimensions of the formed piece are decreased with an increase in the drawing distance of the drawn molten material, while being increased with a decrease in the drawing distance. Therefore, the cross sectional dimensions of the formed piece can be controlled by controlling the drawing distance, and the cross sectional dimensions can be held constant in the drawing direction by holding the drawing distance constant.

(42) A forming system according to mode (40) or (41), characterized in that the partition member has at least four partition walls per each line segment having a length of 100 mm.

(43) A forming system according to any one of modes (40)–(42), characterized in that at least 16 perforations each of which is defined by the partition walls are located within an area of 10000 $mm^2$ in the partition member.

The spacing interval between the adjacent partition wall is suitably determined depending upon the purpose. However, the spacing interval is desirably adapted such that at least four partition walls can be disposed over a length of 100 mm, and more desirably adapted such that at least six partition walls can be disposed over the same length. Where a corresponding surface corresponding to the starter surface is divided by the partition walls into the segmental surfaces each having a small area, the difference of the cross sectional dimensions of the formed piece 610 shown in FIGS. 32, 33 with respect to the starter surface is prevented from being excessively enlarged. The spacing interval between the adjacent partition walls may or may not be constant over the entire area of the partition member.

Where the partition walls are formed in a lattice, or constituted by portions defining a multiplicity of holes which are regularly formed through a plate, so as to be regularly arranged, each of the perforations defined by the partition walls has a constant shape, such as a square shape, other polygonal shape, or a circular shape. Where the partition member is formed by combining particle substances with each other, each of the perforations has an inconstant shape in its cross section. Each of the perforations is open in one of the opposite sides of the partition member, i.e., the material exit surface which is brought into contact or proximity to the starter member, and in the other side, so as to communicate the opposite sides of the partition member. The perforations need not be independent of each other, but may intersect or communicate each other. The perforations are desirably defined by the partition walls so as to be independent of each other at least on the material exit surface. Where the partition member is formed of the combination of the particle substances, for example, the plurality of perforations are likely to communicate with each other on the material exit surface, with the result that each of the segmental surfaces has an elongated shape. Even in such a case, however, the dimensional accuracy of the formed piece remains better than where the partition member is not employed. Where the perforations are independent of each other on the material exit surface, preferably at least 16 perforations, or more preferably at least 36 perforations are located within an area of 10000 $mm^2$ in the partition member, as in mode (43).

The thickness of each of the partition walls may be small or large as long as the partition walls divide the molten material mass surface into the segmental surfaces. However, an excessively large thickness possibly deteriorates the dimensional accuracy, while an excessively small thickness possibly permits the molten material to be drawn from ones of the segmental surfaces from which ones the molten material should not be drawn. In this view, the thickness of the partition walls is desirably ranged from 0.2 mm to 3.0 mm where the piece to be formed has a small cross sectional area, while the thickness is desirably ranged from 0.5 mm to 5.0 mm where the piece to be formed has a large cross sectional area. Further, the thickness of the partition walls may be suitably determined depending upon the size of each of segmental surfaces, the velocity of the relative movement of the forming starter member and the partition member, a degree of the wettability of the partition member with respect to the molten material, and other factors.

In general, the partition member is desirably made of a material having a comparatively low degree of wettability with respect to the molten material. A considerably high degree of wettablity of the partition member with respect to the molten material reduces a partition effect of the partition member. Since the molten material is contracted so as to be solidified, the molten material should be immediately supplied upon solidification of the molten material, otherwise a shrinkage cavity possibly appears. In view of the contract of the molten material upon its solidification, it is desirable that the partition member has a comparatively high degree of wettablity with respect to the molten material. However, once the molten material begins to be drawn by the forming starter member, the molten material is continuously drawn owing to its surface tension, without suffering from the problematic shrinkage cavity. Thus, the degree of wettability of the partition member with respect to the molten material is desirably determined principally in view of the partition effect.

However, the material of the partition member used in the drawing-down method of mode (15) desirably has a lower degree of wettability with respect to the molten material, than that used in the drawing-up method of mode (14), because the lower degree of wettability prevents dripping of the molten material from the partition member. The material of the partition member need have a low degree of reactivity with respect to the molten material, and a low possibility of being deformed under molten temperature.

(44) A forming system according to any one of modes (40)–(43), characterized by including a parallel separating device which separates the partition member and the forming starter member from each other while holding the partition member and the forming starter member in parallel to each other.

The parallel separating device includes at least one of a vertically parallel separating device which separates the forming starter member and the partition member from each other in a direction perpendicular to the material exit surface of the partition member, and a horizontally parallel separating device which separates the forming starter member and the partition member from each other in a horizontal direction which is parallel to the material exit surface. The parallel separating device may include the vertically parallel separating device and a relative rotation device which rotates the forming starter member and the partition member relative to each other about an axis perpendicular to the material exit surface.

With the use of the parallel separating device which is adapted to separate the forming starter member and the partition member from each other while keeping the two members parallel to each other, it is possible to form, for example, a piece extending in the direction perpendicular to the material exit surface, or in a direction inclined with respect to the material exit surface.

(45) A forming system according to any one of modes (40)–(44), characterized by including a non-parallel separating device which separates the forming starter member and the partition member from each other, while rotating the forming starter member and the partition member relative to each other, from a parallel state in which a starter surface of the forming starter member and a material exit surface of the partition member are parallel to each other, to a non-parallel state in which the starter surface and the material exit surface are inclined with respect to each other, the starter surface and the material exit surface being brought into contact with or proximity to each other upon initiation of a forming process.

With the use of the non-parallel separating device which is adapted to rotate the forming starter member and the partition member relative to each other, it is possible to form a piece having curved side surfaces. In such a case where the forming starter member and the partition member are rotated relative to each other, the forming system is desirably provided with an uneven-cooling-velocity applying device which cools the molten material such that one of opposite sides of the molten material on which the velocity of the separation of the starter surface and the material exit surface from each other is higher than on the other side is cooled at a velocity higher than the other side, as described below in mode (46).

(46) A forming system according to mode (45), characterized by including an uneven-cooling-velocity applying device which cools the molten material which has been drawn through the partition member such that one of opposite sides of the molten material on which the starter surface and the material exit surface are separated from each other by the non-parallel separating device at a velocity higher than that on the other of the opposite sides is cooled at a velocity higher than that of the other of the opposite sides.

The uneven-cooling-velocity applying device is adapted to cool at least one of the formed piece and the drawn molten material such that the one side of the drawn molten material on which the velocity of the separation of the starter surface and the material exit surface from each other is higher than on the other side is cooled at a velocity higher than the other side. Accordingly, the uneven-cooling-velocity applying device may be adapted to cool only the one side on which the velocity of the movement is higher than on the other side, or alternatively may be adapted to cool both of the opposite sides such that the one side on which the velocity of the movement is higher than on the other side is cooled by a cooling medium having a temperature lower than that of a cooling medium used for the other side. Further, the uneven-cooling-velocity applying device may be adapted to cool both of the opposite sides such that a flow rate of the cooling medium is higher on the above-described one side than that of the cooling medium on the other side, while the cooling mediums used for the opposite sides have the same temperature, or alternatively such that a distance between a cooling portion and the formed piece or the drawn molten material is shorter on the above-described one side than that on the other side, while the cooling medium used for the opposite sides have the same temperature. Still further, where the uneven-cooling-velocity applying device is adapted to cool only the above-described one side, the device may heat the other side or keep the temperature of the other side, or alternatively may not cool nor heat the other side. However, it is desirable that the device be adapted to cool both of the opposite sides, for facilitating the drawn molten material to be solidified, leading to an increased forming velocity and accordingly an improved production efficiency.

(47) A forming system according to any one of modes (40)–(46), characterized by including a cross section changing device which changes a cross section of the piece as viewed in a forming direction of the piece.

The cross section changing device of the present mode includes not only the cross-sectional-shape changing device which changes the cross sectional shape, but also a cross-section similarly-changing device which changes the size of the cross section without changing the shape. The cross-section similarly-changing device may be adapted to control the velocity of the relative movement of the partition member and the forming starter member and the temperature condition of the drawn molten material, or alternatively may be adapted to control the relative position of the molten material mass surface and a partition member having an inclined portion, as described below in mode (76).

(48) A forming system according to mode (47), characterized in that the cross section changing device includes:

a shielding member; and a shielding-member moving device which moves the shielding member in a direction intersecting the forming direction, so as to move the shielding member to an advanced position in which the shielding member is interposed between the partition member and at least a portion of the molten material which has been drawn through the partition member, and to move the shielding member to a retracted position distant from the advanced position.

The forming system of the present mode includes one form of the cross-sectional-shape changing device. When the shielding member is advanced by the shielding-member moving device, into the drawn molten material, the drawn molten material is cut in the above-described portion by the shielding member so that the cross section of the formed piece is reduced, and the cross sectional shape is changed.

The shielding member which is adapted to introduced into the drawn molten material, desirably has a plate shape, or rod-like shape. Further, the shielding member desirably has a low degree of reactivity to the drawn molten material and a low possibility of being deformed under the molten temperature.

The shielding-member moving device is adapted to move the shielding member between the advanced position and the retracted position, in a direction crossing the drawing direction. The shielding-member moving device may serve, for example, as a horizontal motion device which moves the shielding member in the horizontal direction, i.e., in a direction parallel to the material exit surface of the partition member. Further, where the shielding member has the plate shape, the shielding-member moving device may includes a rotating device which rotates the shielding member after the shielding member has been moved to the retracted position. Still further, the shielding-member moving device may include an advanced-position holding device which holds the shielding member stationary in the advanced position after the shielding member has been moved to the advanced position, or a cross-direction moving device which moves the shielding member in a direction crossing the forming direction, or a forming-direction separating device which separates the shielding member together with the forming starter member from the partition member in the forming direction.

Further, the shielding-member moving device may be adapted to move one shielding member, or may be adapted to move a plurality of shielding members. In the latter case, the shielding-member moving device may include a simultaneously moving device which simultaneously moves the plurality of shielding members, or an independently moving device which moves the shielding members independently of each other, or alternatively may include both of these two devices. The cross-sectional-shape changing device may be adapted to include a plurality of shielding-member moving devices, for thereby moving the plurality of shielding members. In any case, the plurality of shielding members may be identical with each other both in shape and size, or may be different from each other in shape or size.

(49) A forming system according to mode (47) or (48), characterized in that the cross section changing device includes:

an auxiliary starter member; and an auxiliary separating device which separates the auxiliary starter member and the partition member from each other in the forming direction at a velocity substantially equal to a velocity at which the forming starter member and the partition member are moved relative to each other, after the auxiliary starter member has been moved to an auxiliary start position in which a first surface of the auxiliary starter member is in contact with the molten material drawn through the partition member while a second surface of the auxiliary starter member which is adjacent to the first surface is in contact with or in proximity to the partition member.

The forming system of the present mode includes one mode of the cross-sectional-shape changing device which is different from mode (48). After the auxiliary starter member has been moved to the auxiliary start position by the auxiliary separating device, the auxiliary starter member is separated together with the forming starter member from the partition member. As a result, the molten material which has been drawn from ones of the segmental surfaces corresponding to the second surface of the auxiliary starter member is solidified integrally with the molten material which has been drawn from ones of the segmental surfaces corresponding to the starter surface of the forming starter member (corresponding to the solidification surface of the formed piece), whereby the cross sectional area of the formed piece is increased. Namely, the cross sectional area of the formed piece is increased in step, by an amount corresponding to the area of the second surface of the auxiliary starter member.

The auxiliary starter member may have a rectangular shape or any other shape, as long as the auxiliary starter member has the first surface which is brought into contact with the molten material drawn from the ones of the segmental surfaces corresponding to the starter surface of the forming starter member, and the second surface which is adjacent to the first surface and which can be brought into contact with or proximity to the partition member. In most cases, the first surface is brought into contact not only with the molten material drawn from the ones of the segmental surfaces corresponding to the starter surface of the forming starter member, but also with formed piece.

The auxiliary separating device may be adapted to move one auxiliary starter member or may be adapted to move a plurality of auxiliary starter members, while the shielding-member moving device may be adapted to move one shielding member or may be adapted to move a plurality of shielding members, as described above. The plurality of auxiliary starter members may be identical with each other both in shape and size, or may be different from each other in shape or in size. Further, the cross-sectional-shape changing device may include a plurality of auxiliary separating devices.

(50) A forming system according to any one of modes (40)–(49), characterized by including:

a plurality of accommodation containers which accommodates the molten material therein; and an accommodation-container selecting device which moves the plurality of accommodation containers and one of opposite end portions of the piece which is closer to the partition member, relative to each other in a direction intersecting the forming direction, thereby selecting one of the plurality of accommodation containers to be opposed to the above-described one of the opposite end portions of the piece.

The accommodation-container selecting device may be adapted to move the accommodation containers, or the formed piece, or alternatively may be adapted to move both of the accommodation containers and the formed piece. The accommodation containers and the above-described one of the opposite end portions of the formed piece may be rotated relative to each other, so as to be moved relative to each other. In the present forming system, a newly formed piece is repeatedly added to the previously formed piece. In this view, the present forming system can be referred to as an adding forming system.

Where the respective molten materials accommodated in the plurality of accommodation containers are the same in kind as each other, a piece having a large length can be formed. In this case, the present forming system can be referred to as a long-piece forming system. Where at least two of the accommodation containers accommodate therein the respective molten materials which are different in kind from each other, it is possible to obtain a formed piece similar to a piece made by connecting pieces which have been individually formed of respective different kinds of molten materials. In this case, the present forming system can be referred to as a different-material-formed-piece connecting system.

(51) A forming system according to any one of modes (40)–(50), characterized by including:

a partition-member holding member which holds the partition member such that the partition member is located in the vicinity of an upper surface of the above-described mass; and a relative-height control device which controls a relative height of the partition-member holding member and the upper surface of the mass such that the relative height has a predetermined value.

In the present forming system in which the partition member is held to be located in the vicinity of the upper surface of the molten material mass, the upper surface of the partition member serves as the material exit surface so that the molten material is drawn upward from the upper surface of the molten material mass. Thus, the present forming system can be referred to as a drawing-up system.

The relative-height control device may be adapted to include a partition-member elevating device which moves the partition member held by the partition-member holding member, or may be adapted to include a bottom-wall elevating device which moves the accommodation container accommodating therein the molten material or a bottom wall of the accommodation container to thereby move the upper surface of the molten material mass. Further, the relative-height control device may be adapted to include a molten-material supply device which supplies the accommodation container with the molten material to thereby control the upper surface of the molten material mass, as described below in mode (107).

The partition-member holding member may be adapted to hold the partition member such that the partition member is movable relative to the molten material mass surface, or may be adapted to hold the partition member such that the partition member is held stationary. In the former case in which the partition member is movably held, the partition-member holding member may be adapted to hold the partition member such that the partition member is rotatable, so that the forming starter member and the partition member can be rotated relative to each other in the forming system of mode (44), by rotating the partition member. Further, in the forming system of modes (47)–(49), even where the shielding member and the auxiliary starter member of the cross section changing device are adapted to act on only one of side surfaces of the formed piece, it is possible to position any one of the side surfaces in a position opposed to the cross section changing device, by rotating the partition member together with the forming starter member about an axis perpendicular to the material exit surface of the partition member. That is, the shielding member and the auxiliary starter member can act on any one of side surfaces of the formed piece.

(52) A forming system according to any one of modes (40)–(50), characterized in that the partition member constitutes at least a portion of a bottom wall of an accommodation container which accommodates therein the molten material.

In the forming system of the present mode in which a portion of the bottom wall of the accommodation container is constituted by the partition member, a lower surface of the partition member serves as the material exit surface. Thus, the molten material is drawn downward from the lower surface of the molten material mass, so as to be formed as the formed piece. The present forming system can be referred to as a drawing-down system.

(53) A forming system according to mode (52), characterized by including a pressure-difference establishing device which establishes a difference between a pressure in an upper space which is located above the molten material accommodated in the accommodation container and a pressure in a lower space which is located below the partition member, such that the difference has a predetermined value.

The above-described difference between the pressures in the respective upper and lower spaces is established by the pressure-difference establishing device, such that the difference corresponds to the predetermined value, so that the position of the lower surface of the molten material mass relative to the partition member has a predetermined position. In this view, the pressure-difference establishing device can be considered to as one mode of a relative-position control device.

(54) A forming system according to any one of mode (40)–(53), including a drawn-molten-material-temperature adjusting device which adjusts a temperature of the molten material which has been drawn through the partition member.

The drawn-molten-material-temperature adjusting device includes a drawn-molten-material-outer-side-surface-temperature adjusting device which adjusts the temperature of the outer side surfaces of the drawn molten material to thereby adjust the temperature of the drawn molten material, and a drawn-molten-material-end-face-temperature adjusting device which adjusts the temperature of the end face of the drawn molten material. The drawn-molten-material-end-face-temperature adjusting device is usually provided within the forming starter member, or in the periphery of the forming starter member or the formed piece. That is, the temperature of the outer side surfaces of the drawn molten material or the temperature of the end face of the drawn molten material can be adjusted by adjusting the temperature of the forming starter member or the temperature of the formed piece. The adhesion facilitating device described in mode (113) can be used also as a kind of the drawn-molten-material-temperature adjusting device of the present mode.

(55) A forming system according to mode (54), wherein the drawn-molten-material-temperature adjusting device includes at least one of a drawn-molten-material cooling device which is provided in the vicinity of the partition member so as to cool outer side surfaces of the molten material which has been drawn through the partition member, and a drawn-molten material heating device which is provided in the vicinity of the partition member so as to heat the outer side surfaces of the molten material which has been drawn through the partition member.

(56) A forming system according to mode (54) or (55), wherein the drawn-molten-material-temperature adjusting device includes drawing-distance-subject-temperature adjusting means for adjusting a temperature of the molten material which has been drawn through the partition member, such that a drawing distance between the molten material and the surface of the molten material mass has a predetermined value while the surface of the above-described mass and the forming starter member are separated from each other.

(57) A forming system according to any one of modes (40)–(56), further equipped with a relative movement device including a forming-members holding device which holds the partition member and the forming starter member such that the partition member and the forming starter member are movable relative to each other, and relative-movement-velocity controlling means for controlling a velocity at which the partition member and the forming starter member are moved relative to each other.

(58) A forming system according to mode (57), wherein the relative-movement-velocity controlling means includes drawing-distance-controlling-relative-movement-velocity controlling means for controlling the velocity at which the partition member and the forming starter member are moved relative to each other, such that a drawing distance between the molten material and the surface of the mass has a predetermined value while the surface of the mass and the forming starter member are separated from each other.

(59) A forming system according to any one of modes (40)–(58), including a molten-material-drawing-distance keeping device which keeps the drawing distance constant, while the surface of the mass and the forming starter member are separated from each other.

The temperature of the drawn molten material can be controlled by controlling the cooling temperature of the drawn-molten-material cooling device and the heating temperature of the drawn-molten-material heating device, or by changing positions in which the drawn-molten-material cooling and heating devices are installed (by changing respective distances from the drawn-molten-material cooling and heating devices, to the outer side surface of the formed piece, or by changing respective distances from the drawn-molten-material cooling and heating devices, to the outer side surface of the formed piece).

The drawn-molten-material cooling device may be adapted to cool the drawn molten material by means of water, or alternatively by means of air. Further, the drawn-molten-material cooling device may be adapted to cool the entirety of the outer periphery of the drawn molten material, or alternatively may be adapted to cool a portion of the outer periphery of the drawn molten material. For forming a piece having a cross section whose shape is polygonal, for example, it is preferable that the cooling device cools the flat surfaces of the piece rather than the corner portions of the piece, so that the entirety of each of the outer side surfaces is evenly cooled. It is noted that the drawn-molten-material heating device is considered to include a temperature maintaining device. Maintenance of the temperature can be considered a kind of heating, as distinguished from self-cooling. There is a case in which the outer side surfaces do not have to be heated but may be simply maintained their temperature.

In modes (56) and (58), it is clarified that the temperature of the drawn molten material is adjusted or the velocity of the relative movement is controlled, with the purpose of controlling the length of the drawn molten material (drawing distance). Since the cross sectional area of the formed piece is controlled by controlling the drawing distance, the drawing-distance-controlling-temperature adjusting means and the drawing-distance-controlling-relative-movement-velocity controlling means can be referred to as formed-piece-cross-sectional-dimension-controlling-temperature adjusting means and formed-piece-cross-sectional-dimension-controlling-relative-velocity controlling means, respectively. At least one of the drawn-molten-material-temperature adjusting device including the formed-piece-cross-sectional-dimension-controlling-temperature adjusting means, and the relative movement device including the formed-piece-cross-sectional-dimension-controlling-relative-velocity controlling means is referred to as a formed-piece-cross-section control device. Further, in view of the fact that the length of the drawn molten material is controlled for the purpose of controlling the cross sectional dimensions of the formed piece, the formed-piece-cross-section control device depending on the control of the drawing distance is considered as a drawing-distance-depending-formed-piece-cross-section control device.

The temperature of the drawn molten material may be adjusted or the velocity of the relative movement may be controlled, for other purposes, for example, for the purpose of controlling the solidification velocity, the forming velocity, the shape of the solidification surface, and the composition of the formed piece. In each of these cases, therefore, the above-described drawn-molten-material-temperature adjusting device is considered to include solidification-velocity-controlling-temperature adjusting means, forming-velocity-controlling-temperature adjusting means, solidification-surface-shape-subject-temperature adjusting means, or composition-controlling-temperature adjusting means. Similarly, the above-described relative-movement-velocity control device is considered to include solidification-velocity-controlling-relative-velocity control means, forming-velocity-controlling-relative-velocity control means, solidification-surface-shape-controlling-relative-velocity control means, or composition-controlling-relative-velocity control means. At least one of these drawn-molten-material-temperature adjusting device and relative-movement-velocity control device can be referred to as a solidification-velocity control device, a forming-velocity control device, a solidification-surface-shape control device, or a piece-composition control device.

The length of the drawn molten material can be kept constant by the drawn-molten-material-temperature adjusting device or the relative-movement-velocity control device. The molten-material-drawing-distance keeping device of mode (59) is one example of the molten-material-drawing-distance control device of mode (41). Where the length of the drawn molten material is kept constant by the drawing-distance-controlling-temperature adjusting means, the drawing-distance-subject-temperature adjusting means is considered to include drawing-distance-keeping-temperature adjusting means. Where the length of the drawn molten material is kept constant by the drawing-distance-controlling-relative-movement-velocity controlling means, the drawing-distance-controlling-relative-movement-velocity controlling means is considered to include drawing-distance-keeping-relative-velocity control means.

Where the velocity of the relative movement of the partition member and the forming starter member is made considerably enlarged, it is possible to cut off the formed piece. In this case, the relative-movement-velocity controlling means can be considered to include cutting-off-purpose-relative-velocity control means.

(60) A forming system according to any one of modes (40)–(59), including a stirring device which stirs the molten material accommodated in the accommodation container.

The stirring device may be a molten-material stirring device which directly stirs the molten material, or an accommodation-container rotating device which rotates the accommodation container, or any other device as long as the device serves as a relative-motion applying device which gives the accommodation container and the molten material accommodated in the accommodation container, a movement relative to each other. Further, the stirring device may take the form of a shaking device which shakes the accommodation container, a vibration device which vibrates the accommodation container, or a relative-combined-movement applying device which applies the accommodation container with a motion combining the shaking and the vibration. However, where the formed piece adhering to the forming starter member and the drawn molten material adhering to the formed piece may be possibly removed from the forming starter member and the formed piece, respectively, due to the shaking or vibration of the accommodation container, the molten material has to be stirred without shaking or vibrating the accommodation container. In this case, it is possible to employ, as the molten-material stirring device, a gas supply and stirring device which is adapted to introduce a gas including a nitrogen gas and excluding oxygen, into the accommodation container.

(61) A forming system according to mode (60), wherein the molten material which is accommodated in the accommodation container includes a metallic material, and the stirring device utilizes an interaction of an electric current and a magnetic field for thereby stirring the molten material.

Where the molten material includes a metallic material, a suitable device such as an electromagnetic coil can be employed to generate the magnetic field, so that the molten material is stirred by utilizing the interaction of the electric current and the magnetic field.

(62) A forming system according to any one of modes (40)–(61), including a forming-space covering member which covers at least a space surrounding the forming starter member and the partition member, and a gas supply device which supplies the space with a gas.

The supply of the gas to the space within the forming-space covering member is effective to prevent oxidation of the drawn molten material and the molten material mass surface. Further, the supply of the gas to the space is also effective to cool the drawn molten material. Thus, the gas supply device can serve also as a cooling device. Still further, the gas supply device can constitute a portion of the pressure-difference establishing device in the forming system of mode (53).

(63) A forming system according to any one of modes (40)–(62), including an upper covering member which covers an upper surface of the above-described mass.

Where the forming-space covering member is provided to the forming system so as to be located above the molten material mass, the forming-space covering member corresponds to one mode of the upper covering member. In this case, the forming-space covering member is located in a position spaced apart from the upper surface of the molten material mass so as to cover the upper surface of the molten material. The upper-covering member, on the other hand, may be in contact with the upper surface of the molten material to cover the upper surface of the molten material.

(64) A forming system according to any one of modes (40)–(63), including a relative-position control device which controls a relative position of the partition member and the surface of the above-described mass, such that the relative position corresponds to a predetermined position while the surface of the mass and the forming starter member are separated from each other.

The relative position of the partition member and the molten material mass surface is desirably held constant during the forming process. In this case, the relative-position control device includes a relative-position keeping device.

(65) A forming system according to any one of modes (40)–(64), wherein the partition member has at least six, preferably at least 14, more preferably at least 33 partition walls per each line segment having a length of 100 mm.

(66) A forming system according to any one of modes (40)–(65), wherein a spacing interval between each adjacent two of the partition walls of the partition member as viewed in at least one direction is equal to or less than 10 mm, or preferably is equal to or less than 5 mm, or more preferably is equal to or less than 2 mm.

(67) A forming system according to any one of modes (40)–(66), wherein the spacing interval between each adjacent two of the partition walls of the partition member is substantially constant.

The spacing interval between the adjacent partition walls is reduced with an increase in the number of the partition walls disposed over each line segment having a specific length, whereby the area of each of the segmental surfaces defined by the partition walls is reduced. The possible error in the cross sectional shape or cross sectional dimensions of the formed piece is minimized with a reduction in the area of each of the segmental surfaces.

Where the partition walls are equally spaced apart from each other, it is possible to prevent a local increase or decrease of the error in the cross sectional shape or cross sectional dimensions of the formed piece.

(68) A forming system according to any one of modes (40)–(67), wherein the partition walls of the partition member are arranged generally in a lattice.

Where the partition walls are arranged in a lattice, each of the perforations defined by the partition walls has a square shape in its cross section, so that the partition walls divide the molten material mass surface into segmental surfaces each of which has a square shape. Where the present feature is combined with the feature of mode (67), the cross sectional areas of the perforations can be equalized to each other, and each of the perforations can be designed to have an accurate cross sectional area such as 1 $mm^2$ or 2 $mm^2$.

(69) A forming system according to any one of modes (40)–(67), wherein each of perforations which are defined by the partition walls has a cross section whose shape is circular.

The partition walls can be adapted such that each of the perforations has the circular cross sectional shape. In this case, although the thickness of the partition walls can not be uniform, the cross sectional areas of the perforations can be equalized to each other, and each of the perforations can be designed to have an accurate cross sectional area. Another advantage of the present arrangement is that it is easy to produce the partition walls.

(70) A forming system according to any one of modes (40)–(69), wherein each of perforations which are defined by the partition walls extends in a direction crossing the surface of the above-described mass where the partition member is disposed in the vicinity of the surface of the mass.

Since the molten material is drawn through the partition walls, the perforations have to be adapted to extend in a direction crossing the molten material mass surface, in other words, in a direction crossing the material exit surface of the partition member. It is not essential but preferable that the direction in which the perforations extend be perpendicular to the molten material mass surface or the material exit surface. It is not essential but preferable that the perforations extend parallel to each other, and the perforations may cross each other. It is not essential that the respective lengths of the perforations be equal to each other, either.

Each of the perforations may have a square or circular shape in its cross section as described in modes (68), (69), or other polygonal shape. Further, the respective cross sections of the perforations may be different from each other.

In general, it is easy to produce the partition member having perforations which extend parallel to each other and perpendicular to the material exit surface of the partition member and which have the same cross sectional shape.

(71) A forming system according to any one of modes (40)–(70), wherein at least 20 perforations each of which is defined by the partition walls, or preferably at least 36 perforations, or more preferably at least 200 perforations are located within an area of 10000 $mm^2$ in the partition member.

The perforations may be evenly or unevenly disposed over the entire area of the partition member or in a local area of the partition member. However, in general, it is easy to handle the partition member having the perforations which are evenly disposed over the entire area of the partition member. Such an arrangement in which the perforations are evenly disposed over the entire area of the partition member permits any portion of the partition member to be used for forming the piece, and provides a freedom in determining the shape and size of the starter surface of the forming starter member within the size of the partition member. Further, also where a plurality of forming starter members and a single partition member are separated from each other, it is possible to increase the number of the forming starter members or employ forming starter members each having a larger starter surface. However, the partition member may have a local area in which the perforation are not provided, or may have a reinforcing rib which is provided on the side opposite to the material exit surface, for increasing the strength of the partition member or facilitating the production of the partition member.

Where the partition wall is used in the drawing-down system according to modes (52), (53), an upper limit of the opening area of each of the perforations is determined depending upon the surface tension of the molten material. The upper limit of the opening area has to be determined such that the molten material does not drip from the partition member, and such that the lower surface is kept in protruding downward from the material exit surface owing to the surface tension.

(72) A forming system according to any one of modes (40)–(71), wherein the partition member is made of a material having a low degree of reactivity with respect to the molten material.

(73) A forming system according to any one of modes (40)–(72), wherein at least a portion of the partition member which is brought into contact with the molten material is made of a ceramic composition.

The ceramic composition which generally has a low degree of reactivity is suitable for the partition member. It is preferable that the entirety of the partition member be made of the ceramic composition, but it is enough that at least a surface of the partition member which is brought into contact with the molten material be made of the ceramic composition. If the ceramic composition has a refractory property, in this case, the partition member can be used for a forming operation with a molten metal.

Where the partition member is made of a ceramic composition having a porous body, fine particles of foreign substances in the molten material are absorbed by multiple minute pits formed on the surfaces of the partition member. Thus, the fine particles of foreign substances can be advantageously prevented from being introduced into the formed piece. The partition walls serve to remove comparatively large particles of foreign substances in the molten material even if the partition member is not made of the ceramic composition having the porous structure. However, the use of the partition member made of the ceramic composition having the porous structure makes it possible to remove comparatively small particles of the foreign substances. Thus, the partition member has a function of a foreign-substance removing member.

(74) A forming system according to any one of modes (40)–(73), wherein each of the partition walls has a sufficiently large strength for physically preventing the molten material from moving from one of opposite sides of each of the partition walls to the other side.

The use of the partition member of the present mode permits respective pressures on the opposite sides of the partition wall to have a difference therebetween. For example, where the partition wall is located between two segmental surfaces from one of which the molten material is drawn and from the other of which the molten material is not drawn, the respective pressures on the opposite sides of the partition wall have a difference. In this case, the partition wall having a sufficiently large strength for withstanding a large pressure difference facilitates the required operation.

(75) A forming system according to any one of modes (40)–(74), wherein one of opposite surfaces of the partition member which is closer to the forming starter member constitutes a material exit surface, at least a portion of the material exit surface being provided with a parallel portion, which is parallel to the surface of the above-described mass where the partition member is disposed in the vicinity of the surface of the mass.

Where the material exit surface is provided with the parallel portion which is parallel to the molten material mass surface, it is easy to bring the flat starter surface of the forming starter member into contact with or proximity to the parallel portion.

(76) A forming system according to any one of modes (40)–(75), wherein one of opposite surfaces of the partition member which is closer to the forming starter member constitutes a material exit surface, at least a portion of the material exit surface being provided with an inclined portion, which is inclined to the surface of the above-described mass where the partition member is disposed in the vicinity of the surface of the mass.

The inclined portion may be constituted by two planes which intersect with each other, and may have a conical shape, a pyramid shape such as a triangular conical shape, a circular truncated conical shape, a truncated pyramid shape, a semi-spherical shape, or any other shape which permits the number or positions of the effective partition walls actually dividing the molten material mass surface, to be changed as a result of change of the relative position of the partition member and the molten material mass surface. The material exit surface of the partition member is constituted by a series of respective top end surfaces of the partition walls. Each of the top end surfaces may be inclined with respect to the molten material mass surface, or alternatively may not inclined with respect to the molten material mass surface molten. In the latter case, the stepwise change in the level of the top end surface of the partition wall results in an inclined surface in a macroscopical view.

Where the relative-position control device of mode (64) is adapted to change the relative position of the molten material mass surface and the partition member while the partition member includes the material exit surface which is provided with the inclined portion as described in the present mode, it is possible to change the number and positions of the effective partition walls which divide the molten material mass surface. As a result, the cross section of the formed piece can be varied in the forming direction, so that the formed piece has cross sectional shapes which are similar to each other (which are identical with each other except in size), or cross sectional shapes which are completely different from each other. It is also possible to form a tapered piece whose taper rate can be controlled by controlling the relative position of the molten material mass surface and the partition member, and/or the velocity of the relative movement of the forming starter member and the partition member. Where the relative position of the partition member and the molten material mass surface is controlled such that a portion of the molten material mass surface which has been divided by some of the partition walls is no longer divided by the partition walls, the number of the effective partition walls which actually divide the molten material mass surface is reduced. Thus, the cross sectional area of the formed piece is made larger. Where a portion of the molten material mass surface which has not been divided comes to be divided by some of the partition walls, on the other hand, the number of the effective partition walls is increased so that the cross sectional area of the formed piece is made smaller. Further, if the shape of the area inside the effective partition walls is varied during the forming process, the cross sectional shape of the formed piece is varied on the basis of the variation in the shape of the area inside the effective partition walls.

(77) A forming system according to any one of modes (40)–(76), wherein one of opposite surfaces of the partition member which is closer to the forming starter member constitutes a material exit surface, the forming system being equipped with a material-exit-portion control device which controls a material exit portion of the material exit surface through that the molten material is actually drawn out.

Where the relative-position control device of mode (64) is adapted to change the relative position of the molten material mass surface and the partition member while the forming system has the partition member constructed as described in mode (76) and the feature defined in the present mode, the relative-position control device and the partition member cooperate with each other to constitute one example of the material-exit-portion control device. The material-exit-portion control device can be adapted to has features defined in the following modes.

(78) A forming system according to mode (77), wherein the material-exit-portion control device includes an exit-portion-regulating member, and an exit-portion-regulating-member holding device which holds the exit-portion-regulating member such that the exit-portion-regulating member is movable along at least one of opposite surfaces of the partition member.

The movement of the exit-portion-regulating member during the forming process permits the area and shape of the material exit portion to be varied, thereby making it possible to vary the cross sectional area and shape of the formed piece. As a result, the formed piece has cross sectional shapes which are similar to each other (which are identical with each other except in size), or cross sectional shapes which are completely different from each other, on the basis of the shape of the exit-portion-regulating member and the movement distance of the exit-portion-regulating member.

Where the exit-portion-regulating member is moved in a direction during the forming process such that the material exit portion is narrowed, ones of the segmental surfaces from which the molten material has been drawn are enclosed by the exit-portion-regulating member, thereby reducing the cross sectional area of the formed piece. After the exit-portion-regulating member has determined which ones of the segmental surfaces the molten material is drawn from, the number of the segmental surfaces from which the molten material is drawn is not undesirably increased nor reduced. Thus, the exit-portion-regulating member is not necessary during the formation of a piece having a constant shape in its cross section. The exit-portion-regulating-member holding device may be adapted to include a guide device which facilitates the movement of the exit-portion-regulating member along the partition member. Further, it is preferable that the material-exit-portion control device be adapted to include an exit-portion-regulating-member moving device which moves the exit-portion regulating member, as well as the exit-portion regulating member and the exit-portion-regulating-member holding device.

The exit-portion regulating member may be disposed on one of the opposite surfaces of the partition member which corresponds to the material exit surface, or may be disposed on the other surface, or alternatively may be disposed on each of the opposite surfaces. Where the material exit surface of the partition member is provided with a first exit-portion regulating member which is movable on the material exit surface in a first direction while the other side surface of the partition member is provided with a second exit-portion regulating member which is movable on the other side surface of the partition member in a second direction crossing the first direction, for example, it is easy to form a piece having a cross section which varies in the two directions crossing each other, while preventing the first and second exit-portion regulating members from being interfering with each other. In particular, if each of the first and second exit-portion regulating members is constituted by a pair of members which are movable toward each other and away from each other, it is possible to form, for example, a tapered piece having a cross section which gradually varies in the two directions perpendicular to each other.

The partition member including the inclined portion as described in mode (76) can be considered one constitutional element of the cross section changing device of mode (47). The material-exit-portion control device described in modes (77), (78) can be considered one mode of the cross section changing device. The exit-portion regulating member and the exit-portion-regulating-member holding device can be considered one mode of a cross-sectional-shape varying member and one mode of a cross-sectional-shape-varying-member holding device of mode (97) as described below, respectively. Where the exit-portion regulating member is provided on the material exit surface of the partition member, the exit-portion regulating member can be considered to be similar to the shielding member of mode (48). In this case, the formed piece can be cut off by using the exit-portion regulating member.

(79) A forming system according to any one of modes (40)–(78), wherein one of opposite surfaces of the partition member which is closer to the forming starter member constitutes a material exit surface, and wherein a ratio of cross sectional area of the perforations to an area of the material exit surface is at least 20%, or preferably at least 30%, more preferably at least 40%.

(80) A forming system according to any one of modes (40)–(78), wherein a porosity of the partition member is at least 20%, or preferably at least 30%, or more preferably at least 40%.

The porosity represents a ratio of the pore space with respect to the entire volume of the partition member. Where two partition members each of which has non-porous partition walls and perforations evenly distributed as viewed in a width direction of the partition member have the same porosity, the two partition members have the same opening percentage. Where the cross sectional area of the perforation becomes larger or smaller in a direction away from the material exit surface, or where the partition walls are porous bodies, for example, the porosity and the opening percentage are not proportional to each other. Namely, partition members having the same porosity do not necessarily have the same opening percentage. Similarly, partition members having the same opening percentage do not necessarily have the same porosity.

(81) A forming system according to any one of modes (44), (54)–(80), wherein the parallel separating device includes a vertically parallel separating device which vertically separates the partition member and the forming starter member from each other.

(82) A forming system according to any one of modes (44), (54)–(81), wherein the parallel separating device includes a horizontally parallel separating device which horizontally moves the partition member and the forming starter member relative to each other.

(83) A forming system according to mode (82), wherein the relative-horizontal-movement device includes a contour-diversification-purpose-relative-horizontal-movement-velocity controlling means for controlling a velocity at which the partition member and the forming starter member are horizontally moved relative to each other, thereby displacing cross sections of the piece from each other without tearing the molten material which has been drawn through the partition member, so that a contour of the piece is diversified.

(84) A forming system according to mode (82), wherein the relative-horizontal-movement device includes a cutting-off-purpose-horizontal-movement-velocity controlling means for controlling a velocity at which the partition member and the forming starter member are horizontally moved relative to each other, such that the velocity has a value permitting the molten material which has been drawn through the partition member, to be torn apart, so that the piece is cut off.

Where the velocity at which the partition member and the forming starter member are horizontally moved relative to each other is comparatively low, the cross sections of the formed piece are displaced from each other so that the contour of the formed piece is varied while the drawn molten material is not torn apart. Where the above-described velocity is high, the drawn molten material is torn apart. The drawn molten material which has been drawn upward is torn apart, generally, in a portion thereof adjacent to the formed piece. The drawn molten material which has been drawn downward is torn apart, generally, in a portion thereof adjacent to the partition member. Each of the contour-diversification-purpose-relative-horizontal-movement-velocity controlling means and the cutting-purpose-horizontal-movement-velocity controlling means can be considered one mode of the relative-movement-velocity controlling means of mode (57).

(85) A forming system according to any one of modes (44), (54)–(84), wherein the parallel separating device includes a relative rotation device which rotates the partition member and the forming starter member relative to each other about an axis perpendicular to a plane which is opposed to the partition member and the forming starter member.

The relative rotation of the partition member and the forming starter member also permits the cross sections of the formed piece to be displaced from each other, thereby diversifying the contour of the formed piece. Where the axis of the relative rotation is located at the center of the forming starter member, a formed piece having a twisted shape is obtained. Where the axis of the relative rotation is located at a position offset from the center of the forming starter member, a formed piece having a spiral shape is obtained. Where the axis of the relative rotation is located completely outside the forming starter member while the velocity of the relative rotation is enlarged, the drawn molten material is completely torn apart. In this case, the velocity of the relative rotation is controlled by contour-diversification-purpose-relative-rotation-velocity controlling means and cutting-off-purposes relative-rotation-velocity controlling means.

(86) A forming system according to any one of modes (40)–(85), including a combined-motion-applying device which applies the partition member and the forming starter member with a combined motion combining a vertically-parallel separating motion through which the partition member and the forming starter member are vertically separated from each other while being held parallel to each other, and at least one motion which is other than the vertically-parallel separating motion.

The non-parallel separating device of mode (45) is one mode of the combined-motion applying device. The non-parallel separating device is adapted to apply the partition member and the forming starter member with a combined motion combining the vertically-parallel separating motion and the relative rotary motion. Where the forming starter member and the partition member are vertically separated from each other with the two member being held parallel to each other while the two member are horizontally separated from each other, or while the two members are rotated relative to each other, the parallel separating device of mode (44) also corresponds to the combined-motion applying device of the present mode. Each of the horizontal movement and the relative rotation which are respectively defined in modes (82), (85) corresponds to one mode of the motion which is other than the vertically-parallel separating motion. The combined-motion applying device may be adapted to three-dimensionally move the forming starter member and the partition member relative to each other, wherein the combined-motion applying device can be referred to as a three-dimensional-motion applying device.

(87) A forming system according to any one of modes (40)–(44), (47)–(86), including an angle holding and separating device which separates the forming starter member and the partition member from each other, such that an angle defined by a starter surface of the forming starter member and a material exit surface of the partition member is held constant, the starter surface and the material exit surface being opposed to each other.

The present mode includes an arrangement wherein the starter surface and the material exit surface are parallel to each other so that the angle defined by the starter surface and the material exit surface is zero. Where the angle defined by the starter surface and the material exit surface is not zero, the starter surface and the material exit surface are rotated relative to each other in the initial period of the forming process such that the angle defined by the two surfaces has a specific value which is other than zero, and the two surfaces are then separated from each other while the specific value of the angle is held constant. In this case, it is possible to obtain a formed piece extending substantially straight and having end faces which are not parallel to each other.

(88) A forming system according to any one of modes (40)–(43), (45)–(80), (86), including an angle-varying and separating device which separates the forming starter member and the partition member from each other, such that an angle defined by a starter surface of the forming starter member and a material exit surface of the partition member is varied, the starter surface and the material exit surface being opposed to each other.

(89) A forming system according to any one of mode (46), (54)–(80), (85), (86), (88), wherein the uneven-cooling-velocity applying device includes an outer-circumferential-side principally-cooling device which cools more an outer circumferential side of a relative rotating path described by at least one of the forming starter member and the partition member which are rotated relative to each other, than an inner circumferential side of the relative rotating path.

The outer-circumferential-side principally-cooling device may be any device which is adapted to cool more the outer circumferential side than the inner circumferential side. The outer-circumferential-side principally-cooling device may be adapted to cool only the outer circumferential side, or alternatively may be adapted to cool the outer and inner circumferential sides such that the cooling medium on the outer circumferential side has a temperature lower than that of the cooling medium on the inner circumferential side. Further, the outer-circumferential-side principally-cooling device may be adapted to cool the outer and inner circumferential sides by the respective cooling mediums having the same temperature, and have a cooling portion whose length as viewed in the forming direction is larger on the outer circumferential side than on the inner circumferential side. The outer-circumferential-side principally-cooling device is one example of each of the temperature adjusting device of mode (54) and the cooling device of mode (55).

Where the drawn molten material is positively cooled as in the present mode, the forming velocity can be increased, thereby improving the productivity.

(90) A forming system according to any one of modes (48), (54)–(89), wherein the shielding-member moving device includes a shielding-member separating device which separates the shielding member together with the forming starter member from the partition member after the shielding member has been moved to the advanced position.

(91) A forming system according to any one of modes (48), (54)–(89), wherein the shielding-member moving device includes a shielding-member-in-advanced-position holding device which holds the shielding-member moving device stationary in the advanced position while the forming starter member and the partition member are separated from each other.

(92) A forming system according to any one of modes (48), (54)–(91), wherein the shielding member has a flat-plate shape.

The shielding member having the flat-plate shape is capable of cutting the drawn molten material in a portion thereof in which the shielding member is positioned. The shielding member which is advanced into the drawn molten material is preferably made of a ceramic component, because the ceramic component has a low degree of reactivity and a high degree of fire resistance (heat resistance).

In the forming system of mode (90), particularly, the shielding member desirably has a flat-plate shape. By separating the shielding member having the flat-plate shape together with the formed piece from the partition member, it is possible to satisfactorily solidify the drawn molten material located on one of the opposite sides of the shielding member which is closer to the formed piece, thereby preventing the reduction surface and the end surface of the formed piece from being recessed due to an insufficiency of the molten material.

(93) A forming system according to mode (92), wherein the shielding-member moving device includes a cutting-position positioning device which positions the at least one shielding member in a cutting position in which the shielding member covers an entirety of a material exit portion of the partition member, so that the molten material which has been drawn through the material exit portion is torn apart.

By positioning the shielding member in the cutting position, the entirety of the drawn molten material is torn apart, whereby the formed piece is cut off. The present mode includes a case where the entirety of the material exit portion is covered by a plurality of shielding members which have been moved to the respective advanced positions. In this case, each of the respective advanced positions corresponds to the cutting position. The plurality of shielding members are required where the shielding member has a size smaller than that of the material exit portion. The shielding member can be also referred to as a cutting-off member, where the shielding member serves to cut off the formed piece.

(94) A forming system according to any one of modes (48), (54)–(89), (93), wherein the shielding member has a rod-like shape, and wherein the shielding-member moving device includes at least a width-direction motion device which moves the shielding member at least in a width direction of the shielding member.

The shielding member may have the rod-like shape. By moving the shielding member having the rod-like shape in the width direction of the shielding member, it is possible to tear apart a portion of the drawn molten material which is wider than the shielding member. In particular, where the shielding-member moving device includes two-direction motion device which moves the shielding member in two directions which are perpendicular to the drawing direction, the reduction surface having a desired shape can be formed. Further, when the entirety of the drawn molten material is traversed by the rod-like shaped shielding member, the formed piece is cut off.

The present forming system may be also provided with a plurality of shielding members. Simultaneous movements of the plurality of shielding members reduce the time required for cutting the drawn molten material over a large area or at a plurality of portions thereof, thereby leading to an improved productivity.

(95) A forming system according to any one of modes (47), (49), (54)–(94), wherein the cross section changing device includes an auxiliary starter member; and a connection-purpose auxiliary separating device which separates the auxiliary starter member and the partition member from each other in the forming direction at a velocity substantially equal to a velocity at which at least two formed pieces and the partition member are moved relative to each other, after the auxiliary starter member has been moved to a connection auxiliary start position in which the auxiliary starter member is in contact with at least one of the formed pieces and the drawn molten material while being in contact with or in proximity to the partition member.

In this case, the auxiliary starter member has two or more than two first surfaces. In the forming system of the present mode, it is possible to connect the formed pieces and form a U-shaped piece. In this view, the present connection-purpose auxiliary separating device can be referred to as a formed-piece connecting device, while the forming system including the connection-purpose auxiliary separating device can be referred to as a U-shaped-piece forming system.

(96) A forming system according to any one of odes (47), (54)–(95), wherein the cross section changing device has generally a hollow shape, and includes a shape-adding-member-internal-pressure lowering device which lowers a pressure in an internal space within a shape adding member having a first surface and a second surface which is adjacent to the first surface, after the shape adding member has been moved to a shape adding position in which the first surface is in contact with at least one of the drawn molten material and the piece while the second surface is in contact with or proximity to the partition member, the internal space being open in the first surface and the second surface.

(97) A forming system according to any one of modes (47), (54)–(96), wherein the cross section changing device includes a cross-sectional-shape varying member which varies a cross sectional shape of the piece, and a cross-sectional-shape-varying-member holding device which holds the cross-sectional-shape varying member such that the cross-sectional-shape varying member is movable between an operating position in which the cross-sectional-shape varying member is in contact with at least one of the piece and the drawn molten material, and a non-operating position in which the cross-sectional-shape varying member is spaced apart from the at least one of the piece and the drawn molten material.

The cross-sectional-shape varying member includes the shielding member, the auxiliary starter member, and the shape adding member. The above-described positions such as the advanced position, the auxiliary start position, the connection-purpose auxiliary start position and the shape adding position correspond to the operating position.

(98) A forming system according to any one of modes (50), (54)–(97), wherein the plurality of accommodation containers are arranged on a circle having a center thereof at an axis vertically extending, and the accommodation-container selecting device includes a relative-rotation-type accommodation-container selecting device which rotates the plurality of accommodation containers and the piece relative to each other about the axis, thereby selecting one out of the plurality of accommodation containers to be opposed to the above-described one of the opposite end portions of the piece.

The present mode is a mode in which the relative movement of mode (50) is limited to the relative rotation. The present arrangement in which the plurality of accommodation containers and the formed piece are rotated relative to each other reduces a space required for the installment of the forming system. In this case, either of the accommodation containers and the formed piece may be rotated, or alternatively both of the accommodation containers and the formed piece may be rotated.

(99) A forming system according to any one of modes (51), (54)–(98), including a molten-material drawing-up device which draws the molten material upward from the upper surface of the above-described mass.

(100) A forming system according to any one of modes (51), (54)–(99), wherein the relative-height control device includes a relative-distance control device which controls a distance between a bottom wall of the accommodation container and the partition member.

Any one of the partition member and the bottom wall of the accommodation container may be vertically moved by the partition-member elevating device or the bottom-wall elevating device. Or alternatively, both of the partition member and the bottom wall may be vertically moved. In any case, where the accommodation container is not supplied with the molten material, the amount of the molten material is reduced as the forming process progresses, so that the partition member and the bottom wall become gradually closer to each other. Where the accommodation container is supplied with the molten material such that the amount of the molten material is held constant, the distance between the bottom wall of the accommodation container and the partition member is controlled so as to avoid an error in the relative position of the partition member and the molten material mass surface.

(101) A forming system according to any one of modes (51), (54)–(99), wherein the relative-height control device includes a surface-height adjusting member at least a portion of which is immersed in the above-described mass, and a volume varying device which varies a volume of the portion of the surface-height adjusting member in the mass, on the basis of an amount of the molten material which has been drawn through the partition member.

The volume varying device may take the form of an immersed-volume adjusting device which adjusts the volume of the immersed portion of the surface-height adjusting member which portion is immersed in the molten material mass, on the basis of the amount of the molten material which has been drawn out of the accommodation container, or alternatively may take the form of a volume varying device which varies the volume of the surface-height adjusting member where the volume of the surface-height adjusting member is variable.

(102) A forming system according to any one of modes (51), (54)–(101), wherein the relative-height control device includes relative-height holding means which holds the relative height of the partition-member holding member and the upper surface of the above-described mass constant.

(103) A forming system according to any one of modes (51), (54)–(102), wherein the relative-height control device includes a surface sensor which is held by one of the partition-member holding member and the partition member.

The above-described relative height is controlled on the basis of the output value of the surface sensor. The relative height can be held constant by controlling the relative-height control device such that the output value of the surface sensor is held constant.

(104) A forming system according to any one of modes (52)–(98), including a molten-material drawing-down device which draws the molten material accommodated in the accommodation container, downward from a lower surface of the above-described mass.

(105) A forming system according to any one of modes (52)–(98), (104), including at least one of a lower part covering member which covers at least the forming starter member and a material exit surface of the partition member, and an upper part covering member which covers an upper opening of the accommodating container.

The space which is covered by the lower part covering member is a lower space, while the space which is covered by the upper part covering member is an upper space. The lower part covering member corresponds to the forming-space covering member of mode (62), while the upper part covering member corresponds to the upper covering member of mode (63).

The difference between the pressures in the respective upper and lower spaces is controlled so as to have a predetermined value, by controlling at least one of the pressures in the respective upper and lower spaces. In this case, if the lower space is supplied with gas by the gas supply device of mode (62) or the drawn-molten-material cooling device of mode (55), the pressure in the lower space is made higher than the atmospheric pressure. Thus, the pressure difference can be controlled so as to have a predetermined value, by making the pressure in the upper space lower, by the predetermined value, than the pressure in the lower space which is higher than the atmospheric pressure. The supply of the gas to the lower space permits the pressure in the upper space to be not so reduced as in a case where the lower space is not supplied with the gas.

Where the lower space is supplied with the gas in the form of the cooling medium which is used for cooling the drawn molten material, the formed piece and the starter member, the amount of the gas to be supplied can be controlled so as to correspond to an amount suitable for the cooling. In this case, the pressure difference can be controlled by controlling the pressure in the upper space relative to the pressure in the lower space which is determined depending upon the amount of the supplied gas, such that the pressure difference has a value satisfying a predetermined condition, whereby both of the cooling state and the pressure difference can be accurately controlled. However, for preventing oxidation of the drawn molten material, or for cooling the drawn molten material, in general, the amount of the gas to be supplied need not be accurately controlled. Therefore, it is possible to provide the lower space with a gas excluding oxygen such that the pressure in the lower space is higher than the pressure in the upper space by a value satisfying a predetermined condition, while holding the pressure in the upper space equal to the atmospheric pressure or lower than the atmospheric pressure by a specific value. In this case, only the pressure in the lower space has to be controlled, thereby simplifying the pressure control.

(106) A forming system according to any one of modes (53)–(98), (104), (105), wherein the pressure-difference establishing device includes a head-pressure-difference establishing device which establishes a difference between pressures in the respective upper space and in the lower space, such that the difference has a value corresponding to a head pressure of the molten material which is accommodated in the accommodation container, so that a pressure of the molten material which is positioned in the partition member is substantially equal to the pressure in the lower space.

While the difference between the pressures in the respective upper and lower spaces is held substantially equal to the head pressure of the molten material, the molten material does not undesirably flow out through the partition member. In this state, the relative height of the lower surface of the molten material mass and the material exit surface of the partition member can be controlled by finely increasing or decreasing the difference between the pressures in the respective upper and lower spaces.

(107) A forming system according to any one of modes (40)–(106), including a molten-material supply device which supplies the accommodation container with the molten material.

Where the molten-material supply device is equipped with a continuously supplying device, the molten material is continuously supplied to the accommodation container during the forming process. Where the molten-material supply device is equipped with an intermittently supplying device, the molten material is supplied to the accommodation container according to a predetermined condition, for example, when the amount of the molten metal accommodated in the accommodation container is decreased to a predetermined value. According to the present forming system, the supply of the molten material from the molten-material supply device to the accommodation container permits the upper surface of the molten material mass to be held substantially constant during the forming process, and also making it possible to form a large-sized piece whose volume exceeds the volume of the accommodation container. The forming operation can be continued as long as the molten material is supplied to the accommodation container, whereby a piece having a large length can be formed. In this sense, the present forming system can be referred to as a large-sized-piece forming system, or a long-piece forming system.

(108) A forming system according to mode (107), wherein the molten-material supply device includes a supply container which accommodates therein the molten material, a connecting tube which connects the supply container with the accommodation container, and supply-amount controlling means for controlling an amount of the molten material to be supplied to the accommodation container.

(109) A forming system according to mode (108), wherein the supply-amount controlling means includes molten-material-amount-basis-supply-amount controlling means for controlling an amount of the molten material to be supplied to the accommodation container on the basis of an amount of the molten material which is accommodated in the accommodation container.

In the forming system of the present mode, the accommodation container is supplied with the molten material such that the amount of the molten material which is accommodated in the accommodation container is held constant. In this case, the molten-material-amount-basis-supply-amount controlling means includes molten-material-amount keeping means.

Where the supply amount of the molten material is controlled by the molten-material-amount-basis-supply-amount controlling means, on the basis of the amount of the molten material accommodated in the accommodation container so that the relative position of the partition member and the molten material mass surface can be controlled, this molten-material-amount-basis-supply-amount controlling means can be considered as an one mode of relative-position controlling means. Where the molten material is supplied to accommodation container such that the relative position is held constant, the molten-material supplying device can be considered as a relative-position keeping device.

(110) A forming system according to any one of modes (107)–(109), wherein the molten material includes a metallic material, and the molten-material supply device includes an electromagnetic pump which supplies the molten material from the supplying container to the accommodation container.

Where the molten material includes a metallic material, the molten material can be supplied from the supply container to the accommodation container, by using the electromagnetic pump. The supply amount of the molten material can be controlled by controlling the electric current to be supplied to the electromagnetic pump. The supply amount of the molten material is thus controlled by electric current controlling means.

(111) A forming system according to any one of modes (107)–(109), wherein the molten-material supply device includes a supply-container-internal-pressure control device which controls a pressure in a space located above an upper surface of the molten material within the supply container.

When the pressure in the space located above the upper surface of the molten material within the supply container is increased, the molten material begins to be supplied, or the supply amount of the molten material is increased. When the pressure is decreased, the supply amount of the molten material is decreased, or the supply of the molten material is suspended.

(112) A forming system according to any one of modes (40)–(111), including a plural-member separating device which simultaneously separates a plurality of forming starter members and at least one partition member from each other.

The forming system of the present mode can be referred to as a plural-piece simultaneously forming device. The plural-member separating device may include a plural-member simultaneously separating device in which all of the forming starter members simultaneously begin to be separated from the partition member or members, or alternatively may include an individually-simultaneously separating device in which the forming starter members start to be separated from the partition member or members at different times. In any case, the plural-member separating device provides a higher productivity than where the pieces are formed one by one. The plural-member simultaneously separating device may be adapted such that the plurality of forming starter members are held by a common starter-member holding member, thereby making it possible to reduce the cost of the system.

(113) A forming system according to any one of modes (40)–(112), wherein the forming starter member includes an adhesion facilitating device which facilitates the molten material to adhere to the forming starter member.

The adhesion facilitating device, for example, serves to rush the adhesion. Where the molten material in the vicinity of the starter surface is rapidly solidified, the molten material can rapidly adhere to the forming starter member. The adhesion facilitating device can be also referred to as a solidification facilitating device.

(114) A forming system according to mode (113), wherein the adhesion facilitating device includes a starter-surface cooling device which cools a starter surface of the forming starter surface.

(115) A forming system according to any one of modes (40)–(114), wherein the forming starter member includes a removal preventing device which prevents the molten material which has adhered to the forming starter member, from being removed from the forming starter member.

(116) A forming system according to mode (115), wherein the removal preventing device includes a surface of the forming starter member which is closer to the partition member and which has concave and convex parts.

The presence of the concave and convex parts is effective to prevent the molten material adhering to the forming starter member, from being removed from the forming starter member. Where projecting portion is formed on the surface of the forming starter member which is closer to the partition member, the solidified molten material holds the projecting parts, owing to its shrinkage. Thus, the presence of the projecting portion is particularly effective to prevent the removal of the molten material from the forming starter member.

(117) A forming system according to any one of modes (40)–(116), wherein the forming starter member is made of a material including at least one of a plurality of substances which are included in the molten material.

Where the forming starter member is made of a material including at least one of the plurality of substances which are included in the molten material, the molten material can easily adhere to the forming starter member, and can be prevented from being removed from the forming starter member. If the forming starter member is made of a material which is completely identical to that of the molten material, the forming starter member can be considered a portion of the formed piece, so that the forming starter member does not have to be removed from the formed piece after the forming process. If the formed piece is used as the forming starter member, it is possible to connect the formed pieces with each other, thereby making it possible to form a long piece. Even where the forming starter member is not made of a material completely identical to that of the molten material, but made of a material including a substance or substances which is included in the molten material, namely, even where the forming starter member and the molten material have respective portions which are constituted by an identical substance, the forming starter member and the formed piece can be connected with each other. In general, where two members to be connected with each other include respective substances identical with each other, the connectivity enjoys a higher degree than where the two members do not include any identical substance. Further, where the forming starter member and the molten material are both made of metallic materials or ceramic materials, the degree of the connectivity is higher than where one of the forming starter member and the molten material is made of a ceramic material while the other is made of a metallic material.

Where a ceramic material is used for the molten material, it is preferable to use a glass or other material whose melting point is comparatively low. For practical purposes, it is preferable that both of the forming starter member and the molten material be made of metallic materials.

(118) A forming system according to any one of modes (40)–(117), wherein the forming starter member is a hollow cylindrical member having a cylindrical wall portion and a bottom wall portion which closes one of axial ends of the member, the forming system including a starter-member-internal-pressure control device which controls a pressure in a space surrounded by the bottom wall portion and the cylindrical wall portion.

According to the forming starter member and the starter-member-internal-pressure control device of the present mode, it is possible to form a cylindrical shaped piece, a solid piece, and a hollow-cylindrical-shaped piece having a bottom.

Where the temperature adjusting device of mode (54) is provided in a position such that the temperature of the forming starter member or the temperature of the forming-starter-member-internal-pressure control device can be adjusted, it is possible to facilitate the solidification of the molten material which has been introduced into the space within the forming-starter-member-internal-pressure control device.

(119) A forming system according to mode (118), wherein the forming starter member includes at least one projecting portion which is provided to at least one of the bottom wall portion and the cylindrical wall portion.

Where the at least one projecting portion is formed on the bottom wall portion or the cylindrical wall portion, the adhering molten material is prevented from being removed. In this case, the projecting portion and the starter-member-internal-pressure control device correspond to a removal preventing device. The projecting portion can be also referred to as an adhesion boss.

The end face of the formed piece can has a shape corresponding to the shape of the projecting portion. In this case, the forming starter member and the starter-member-internal-pressure control device can be considered as one mode of a shape changing device.

The respective features related to the forming starter member which are defined in modes (113)–(119) can be applied to the auxiliary starter member, which is required to have the same function as the forming starter member.

(120) A forming and forging system including the forming system according to any one of modes (40)–(119), and a forging system which forges the piece which has been formed by the forming system.

(121) A forming system including:

a partition member having partition walls which divide the surface of the molten material mass, into a plurality of segmental surfaces;

a forming-members holding device which holds the partition member and a forming starter member serving to define a cross sectional shape of a piece to be formed by the forming system, such that the partition member and the forming starter member are movable relative to each other; and a relative movement device which brings the forming starter member and the partition member into contact with or proximity to each other, and then separating the forming starter member and the partition member from each other.

(122) A connecting method of connecting members formed of different metallic materials, wherein the forming starter member according to mode (1) is a metallic member which is made of a first material, while the molten material according to mode (1) is a molten metal which is a melt of a second material that is different from the first material.

In this connecting method, as a result, the different kinds of metallic members are connected with each other without a welding. The metallic member made of the first material may be produced by the method of mode (1), or may be produced by a method which is different from the method of mode (1).

(123) A long piece formed by a method including: a step of forming a piece in one of a plurality of accommodation containers which accommodate a molten material therein; a step of bringing the piece into contact with or proximity to a partition member of the other of the plurality of accommodation containers; and a step of separating the partition member and the formed piece from each other.

BEST MODE FOR CARRYING OUT THE INVENTION

A first embodiment of the present invention in the form of a forming system will be explained in detail on the basis of the drawings. This forming system is capable of carrying out a forming method of the present invention. It is noted that each of the drawings schematically shows the forming system or formed piece.

Figure 1:
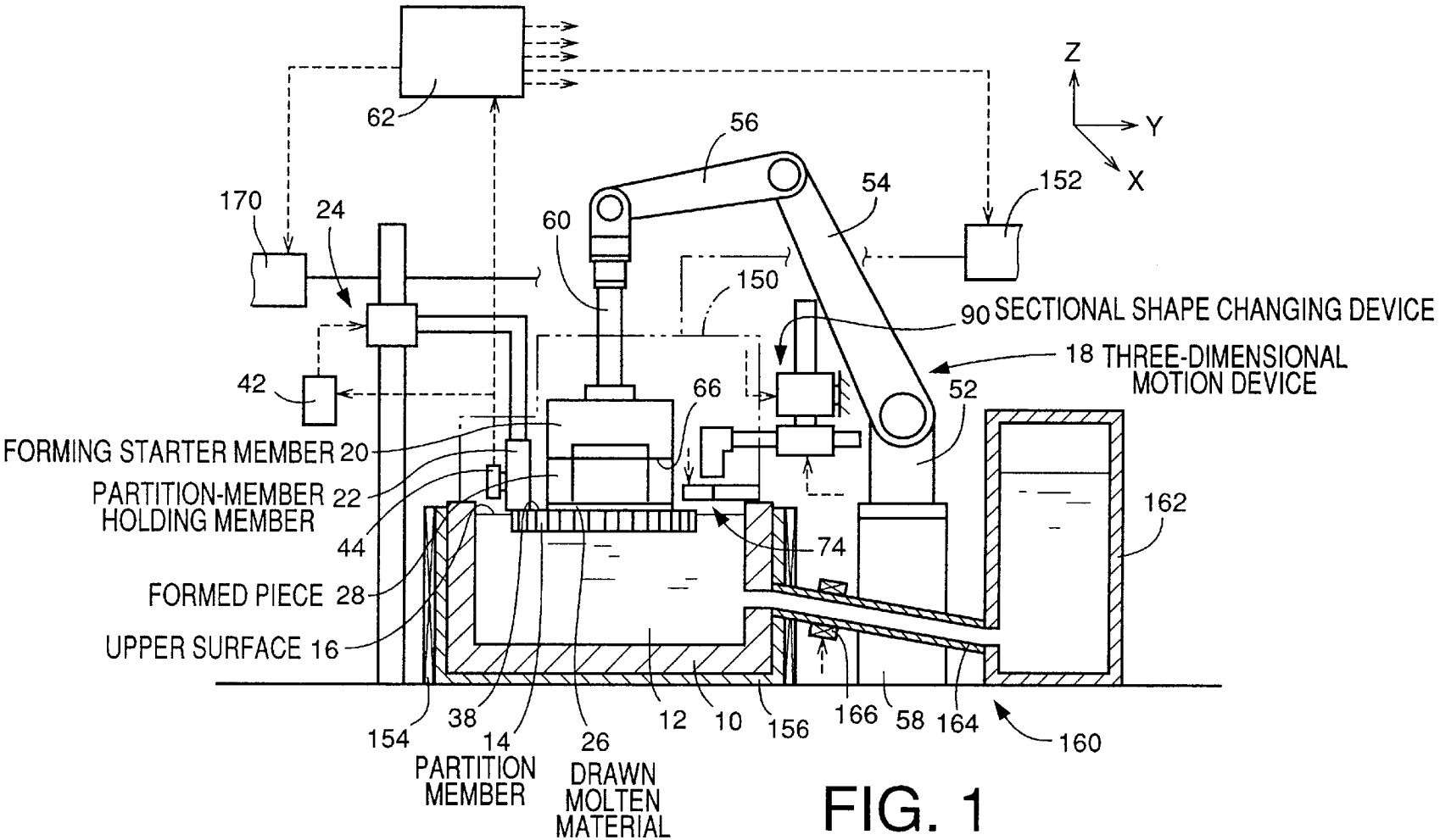
FIG. 1 is a view schematically showing a first embodiment of the present invention in the form of a forming system. This forming system is capable of carrying out a forming method of the present invention.

FIG. 1 shows the forming system in which a molten material 12 is accommodated in an accommodation container 10, whereby a molten material mass is formed within the accommodation container 10. Reference numeral 14 denotes a partition member which divides an upper surface 16 of the molten material mass into segments. Reference numeral 18 denotes a three-dimensional motion device adapted to three-dimensionally move a forming starter member 20.

The partition member 14 is supported by a partition-member holding member 22 such that the partition member 14 is located close to the upper surface 16 of the molten material mass. The partition-member holding member 22 is attached to a partition-member elevating device 24 such that the partition-member holding member 22 is vertically movable by the partition-member elevating device 24. Thus, the partition member 14 is vertically movably supported by the partition-member holding member 22.

Figure 3:
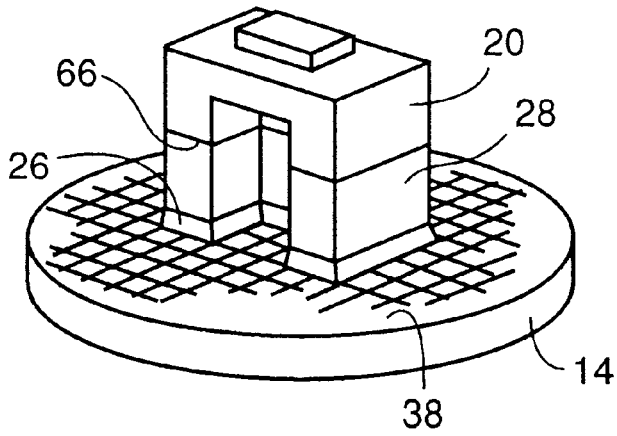
FIG. 3 is a view schematically showing a state in which a piece is formed by solidification of a molten metal drawn up through the partition member.

The partition member 14 and the forming starter member 20 are movable relative to each other by the three-dimensional motion device 18 and the partition-member elevating device 24. When the partition member 14 and the forming starter member 20 are separated from each other, the molten material 12 is drawn up through the partition member 14, as shown in FIG. 3. The drawn molten material 26 which has been drawn up, is solidified into a formed piece 28 between the forming starter member 20 and the partition member 14. In the present embodiment, since an aluminum alloy (JIS-AC4C) is used as the molten material, the molten material is hereinafter referred to as a molten metal.

Figure 2:
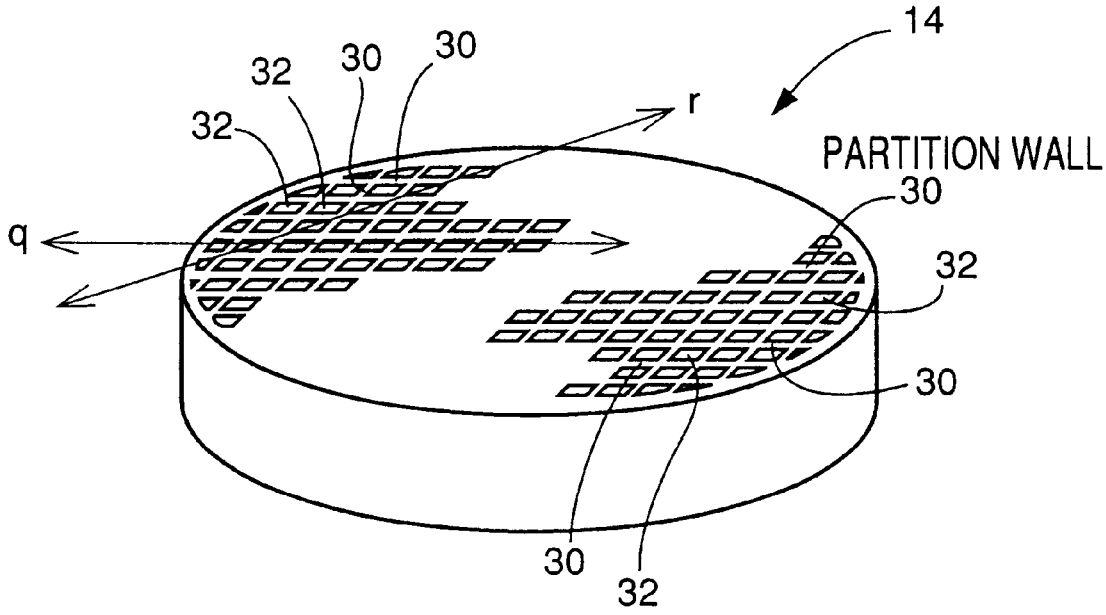
FIG. 2 is a perspective view showing a partition member of the forming system.

As shown in FIG. 2, the partition member 14 takes a generally plate-like shape having a diameter of 150 mm and a thickness of 15 mm. The partition member 14 has a multiplicity of partition walls 30 arranged in a lattice. The partition walls 30 are substantially parallel to each other, and substantially equally spaced apart from each other as viewed in any single direction. Thus, the partition member 14 has a multiplicity of perforations 32 which are defined by the partition walls 30 and which are independent of each other. The perforations 32 extend parallel to each other and perpendicularly to a surface of the partition member 14.

In the present embodiment, each of the partition walls 30 has a thickness of about 0.5 mm, and the spacing between the adjacent partition walls 30 is about 1 mm. Thus, 66 (=1/1.5×100) partition walls 30 are disposed over a length of 100 mm in a direction q which is parallel to the partition walls 30, while 47 (=1/1.5$\sqrt{2}$×100) partition walls 30 are disposed over a length of 100 mm in a direction r which intersects the direction q. The internal dimensions of each of the perforation 32 are 1 mm×1 mm. Thus, 4356 (=66×66) perforations 32 are located within an area of 100 mm×100 mm (=10000 $mm^2$). The partition member 14 has an opening percentage (a ratio of cross sectional area of the perforations) of 44% (=1/1.5×1.5). The partition member 14 is a porous body, whereby its porosity is larger than the opening percentage. Since the partition member 14 has multiple minute pits formed on its surfaces, the partition member 14 has a large specific surface area (surface area per unit weight).

In the present embodiment, the partition member 14 is formed of a sintered ceramic composition including cordierite and mullite. Since such a ceramic composition generally has a low degree of reactivity to a metallic material, the partition member 14 will not react with the molten metal 12 even when the partition member 14 contacts the molten mass 12 under a high temperature. Further, the ceramic composition has a refractory property, so that the partition member 14 will not be deformed even when the partition member 14 is subjected to a high temperature. Still further, the porous structure of the partition member 14 permits removal of fine particles of foreign substances from the molten metal 12, at the surfaces of the partition walls 30. Although the partition walls 30 may remove large particles of foreign substances in the molten metal 12 even if the partition member 14 does not have a porous structure, it is desirable that the partition member 14 has a porous structure, for removing the fine particles of the foreign substances. Thus, the present partition member also functions as a foreign-substance removing member.

Figure 4:
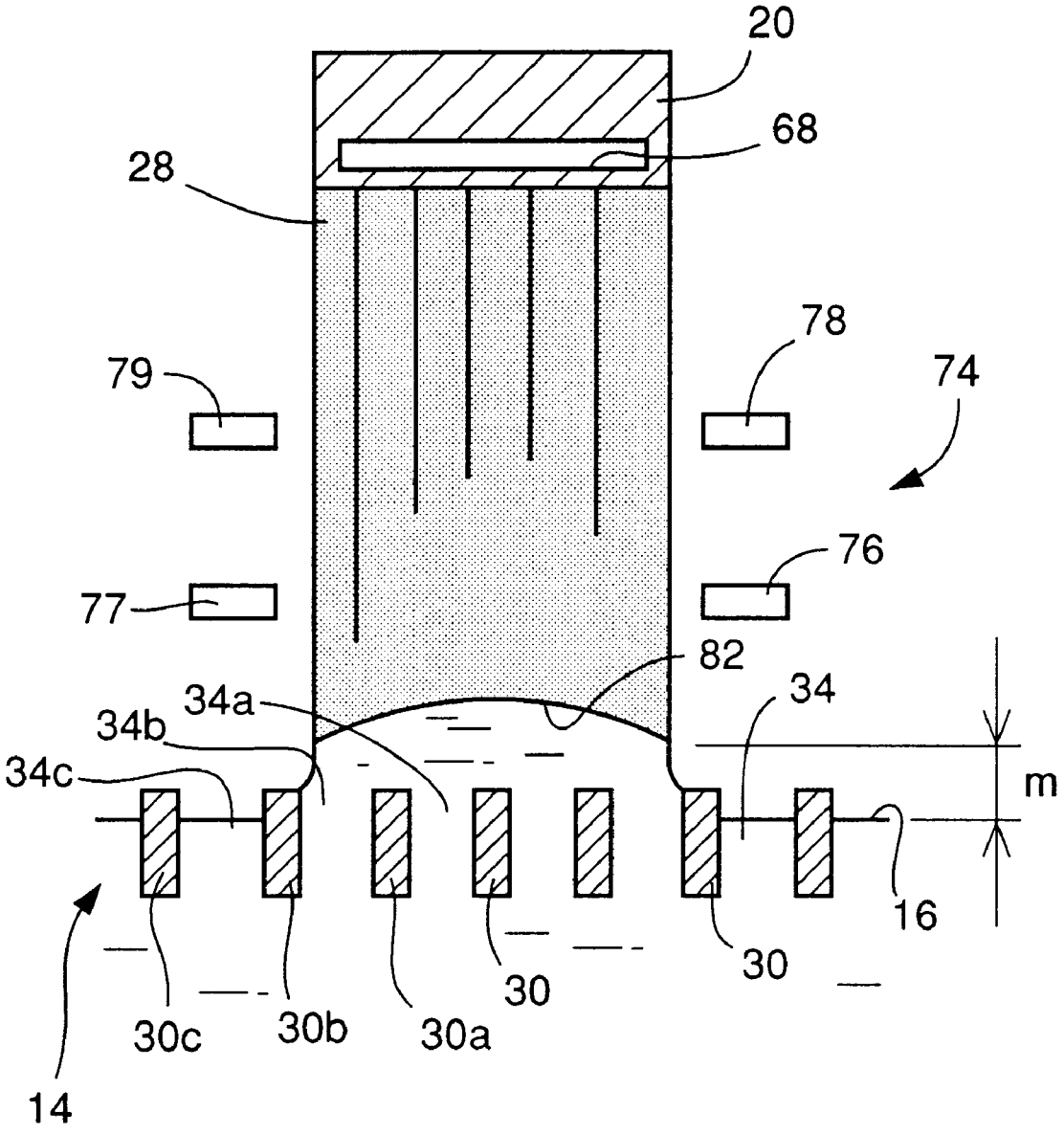
FIG. 4 is a view schematically showing a state of a solidification surface and its periphery in which the drawn molten metal is solidified.

As described above, the partition member 14 is disposed close to the upper surface 16 of the molten material mass, so that the upper surface 16 is divided by the partition walls 30 into a multiplicity of segmental surfaces 34 which correspond to the respective perforations 32, as shown in FIG. 4. Since the molten metal 12 does not move across the partition walls 30, the molten metal 12 is drawn from each of these segmental surfaces 34 (each of the perforations 32).

The partition member 14, which is formed of a ceramic composition as described above, does not suffer from breakage of the partition walls 30 when the molten metal 12 is drawn up. For instance, the partition wall 30*a* indicated in FIG. 4 does not receive a considerably large force, since the molten metal 12 is drawn up from the segmental surfaces 34*a*, 34*b* which are located on the opposite sides of the partition wall 30*a*. On the other hand, the partition wall 30*b* receives a comparatively large force acting thereon in a direction away from the segmental surface 34*c* toward the segmental surface 34*b*, because the molten metal 12 is drawn up from the segmental surface 34*b* located on one side of the partition wall 30*b*, but is not drawn up from the segmental surface 34*c* located on the other side of the partition wall 30*b*. In other words, the partition wall 30*b* receives a comparatively large force because the segmental surface 34*c* is subjected to the atmospheric pressure while the segmental surface 34*b* is subjected to a reduced pressure generated by the drawing of the molten metal 12 therefrom. However, the partition wall 30*b* which has a sufficiently large strength is not broken or deformed by the drawing of the molten metal 12. It is noted that the molten metal 12 is not drawn up from the segmental surfaces 34 respectively located on the opposite sides of the partition wall 30*c*.

As described above, each of the partition walls 30 of the partition member 14 belongs to one of the following groups: a group of partition walls each of which is subjected to the drawing of the molten metal 12 on its opposite sides; a group of partition walls each of which is subjected to the drawing of the molten metal 12 on only one of its opposite sides; and a group of partition walls each of which is not subjected to the drawing on either of its opposite sides. The grouping of the partition walls 30 is not predetermined, but is determined depending upon the shape and contact positions of the forming starter member 20. In other words, any partition wall 30 may belong to any one of the above-described groups of partition walls.

Where the molten metal 12 is drawn up from the upper surface of the partition member 14 which is disposed close to the upper surface 16 of the molten metal 12, the upper surface of the partition member 14 may be considered to be a material exit surface 38.

The partition-member elevating device 24 is operated by a driver circuit not shown in the figure, under the control of a surface tracing control device 42.

The partition member 14 is moved down when the partition-member holding member 22 is moved down by the partition-member elevating device 24. As a result, the upper surface 16 of the molten metal 12 is raised relative to the partition member 14, whereby the upper surface 16 is moved toward the material exit surface 38 of the partition member 14 as viewed in the vertical direction. When the partition-member holding member 22 is moved up, the partition member 14 is moved up, so that the upper surface 16 is lowered relative to the partition member 14, and accordingly is backed away from the material exist surface 38. The partition-member holding member 22 carries a surface sensor 44 which is adapted to detect a distance between the partition-member holding member 22 (the partition member 14) and the upper surface 16, so that the relative height of the partition member 14 and the upper surface 16 can be obtained on the basis of the detected distance. The output signal of the surface sensor 44 is supplied to the above-indicated surface tracing control device 42.

The three-dimensional motion device 18 is equipped with a first arm 52, a second arm 54 and a third arm 56. The first arm 52 is supported by a body 58 such that the first arm 52 is rotatable about the vertical axis (Z axis). The second arm 54 is supported by the first arm 52 such that the second arm 54 is rotatable about a horizontal axis, while the third arm 56 is supported by the second arm 54 such that the third arm 56 is rotatable about the horizontal axis. A starter-member holding member 60 is mounted on the third arm 56 such that the starter-member holding member 60 is rotatable about the mutually perpendicular three axes (X axis, Y axis and Z axis). The starter-member holding member 60 is adapted to removably hold the forming starter member 20 at its end. The three-dimensional motion device 18 is controlled by driver circuits not shown in the figure, according to control commands generated from a control panel not shown in the figure. The control panel is controlled by a forming control device 62 which will be described below.

As shown in FIG. 3, the forming starter member 20 has a starter surface 66 which is generally U-shaped. The forming starter member 20 is formed of an aluminum alloy used for casting. Namely, the forming starter member 20 is made of the same material as the molten metal 12, and therefore makes it easy for the molten metal 12 to adhere to the starter surface 66, and difficult for the molten metal 12 to be removed from the starter surface 66 after the molten metal 12 has once adhered thereto. The starter member 20 has a passage 68 formed therein, as shown in FIG. 4. The passage 68 is supplied with water from a suitable water supply device not shown in the figure. The starter surface 66 is cooled by the water supplied to the passage 68, facilitating the solidification of the molten metal which has adhered to the starter surface 66 during an initial period of the forming process. The passage 68 and the water supply device cooperate to function not only as a starter-surface cooling device which cools the starter surface 66, but also as an adhesion facilitating device which facilitates the adhesion of the molten metal to the starter surface 66, and the solidification of the molten metal. During the forming process, the formed piece 28 is cooled whereby the end face of the drawn molten metal 26 is accordingly cooled. Thus, the passage 68 and the water supply device cooperate to function also as a drawn-molten-material cooling device and a drawn-molten-material-end-face cooling device.

The molten metal 12 is drawn up while adhering to the starter surface 66 of the starter member 20, so that the contour and size of the formed piece 28 are substantially identical with those of the starter surface 66.

The present forming system is provided with a temperature adjusting device 74, which includes two pairs of heating and cooling devices 76–79, as shown in FIG. 4. The temperature adjusting device 74 further includes an electric power source and a nitrogen supply device which are not shown in the figure. Each heating and cooling device 76–79 includes a heater portion and a nitrogen gas nozzle portion which are not shown in the figure. The heater portion and the nitrogen gas nozzle portion are selectively activated to selectively serve as a heating device and as a cooling device. The heating temperature is adjustable by adjustment of the temperature at the heater portion, while the cooling velocity is adjustable by adjustment of the flow rate and/or temperature of the nitrogen gas (cooling medium) delivered from the nozzle portion.

One of the two pairs of heating and cooling devices 76, 77 are located in opposed relation with each other, and the other of the two pairs of heating and cooling devices 78, 79 are also located in opposed relation with each other. The two pairs of heating and cooling devices 76–79 are spaced apart from each other in the forming direction.

When the heating and cooling devices 76, 77 are used as the cooling device, the temperature in an outer portion of the drawn molten metal 26 is made lower than that in an inner portion of the drawn molten metal 26, whereby the solidification of the drawn molten metal 26 is initiated first in its outer portion, and then in its inner portion. Consequently, an solidification surface 82 of the drawn molten metal 26 in the vicinity of the partition member 14 is made concave, whereby the solidification of the drawn molten metal 26 within the partition member 14 can be avoided. The temperature in the outer side surfaces of the drawn molten metal 26 is made lower than that in the inner portion, and the solidification surface 82 tends to be concave even if the heating and cooling devices 76, 77 are not operated as the cooling device. However, positive cooling of the drawn molten metal 26 by the cooling device surely prevents convexity of the solidification surface 82, and facilitates the solidification of the drawn molten metal 26.

When the heating and cooling devices 76, 77 are operated as the heating device, the temperature difference between the inner and outer portions of the drawn molten metal 26 is reduced, and the solidification surface 82 tends to be flat. However, overheating of the drawn molten metal 26 may possibly result in convexity of the solidification surface 82. The operation of the upper heating and cooling devices 78, 79 as the heating device also reduces the temperature difference between the inner and outer portions of the drawn molten metal 26, resulting in flatness of the solidification surface 82.

As described above, it is possible to control the shape of the solidification surface 82, by controlling the heating and cooling devices 76–79.

As is apparent from the figure, in the present embodiment wherein the heating and cooling devices 76–79 are provided to heat and cool the outer side surfaces of the formed piece 28, to thereby control the temperature of the drawn molten metal 26, the temperature adjusting device 74 including those heating and cooling devices 76–79 functions as a drawn-molten-material-outer-side-surface-temperature adjusting device, a drawn-molten-material cooling device, and a drawn-molten-material heating device.

Figure 5:
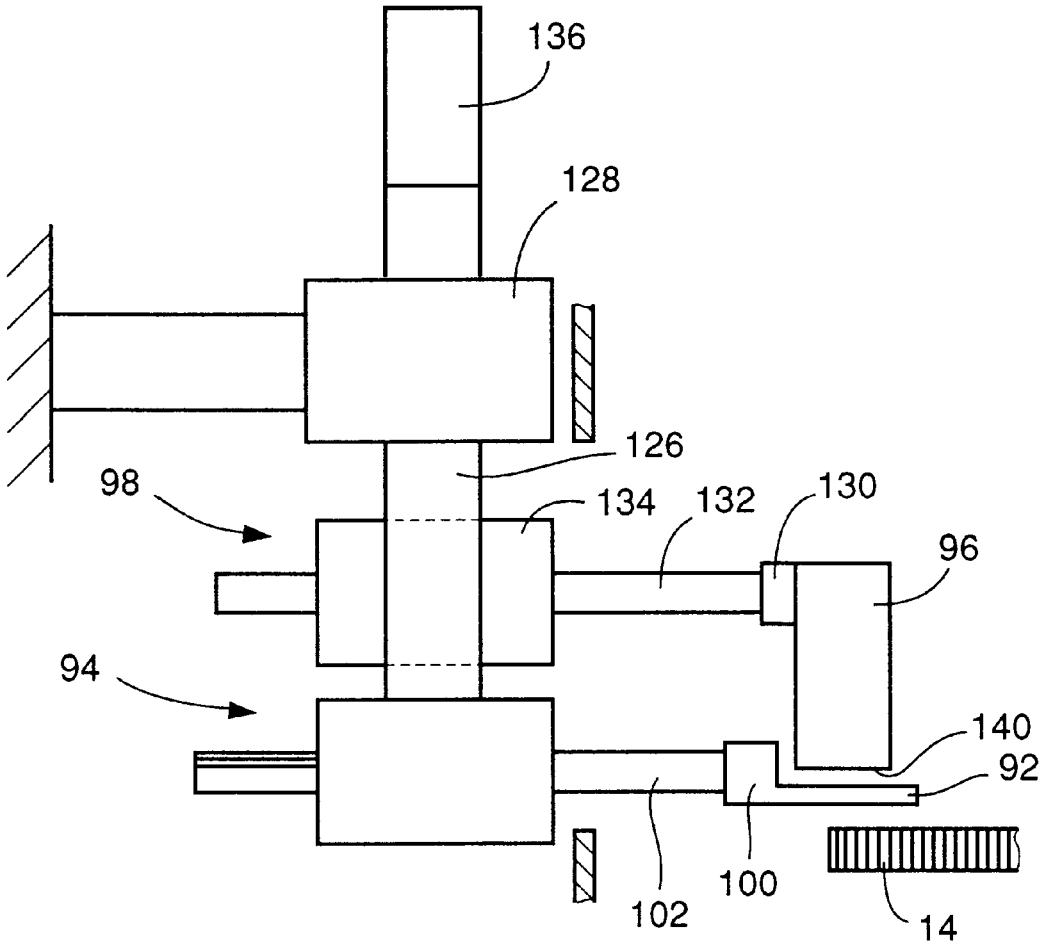
FIG. 5 is a side view of a sectional shape changing device of the forming system.
Figure 6:
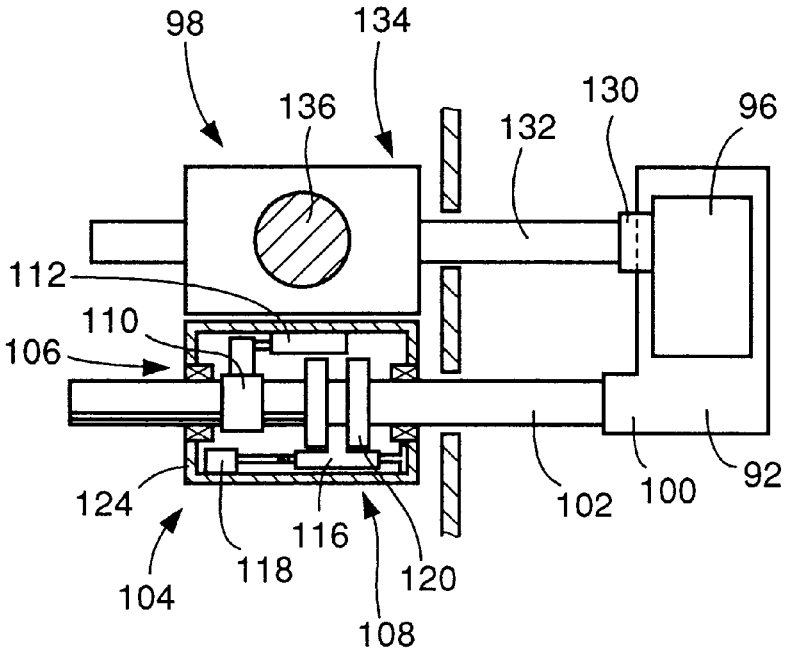
FIG. 6 is a plan view (partly in cross section) of the sectional shape changing device.

The present forming system is equipped with a cross section changing device in the form of a sectional shape changing device 90. The sectional shape changing device 90 includes a shielding member 92, a shielding-member moving device 94, an auxiliary starter member 96, and an auxiliary separating device 98, as shown in FIGS. 5 and 6.

The shielding member 92 is a flat plate member having a thickness of 1.5 mm and made of silicon nitride. The shielding member 92, which is advanced into the drawn molten metal 26, as described below, has a fire-resistance and a low degree of reactivity with respect to the molten metal.

The shielding member 92 has a mounting portion 100 at a proximal end thereof, at which the shielding member 92 is removably attached to a shielding-member drive shaft 102. The shielding-member drive shaft 102 is supported by an advancing and retracting device 104 of the shielding-member moving device 94. The advancing and retracting device 104 includes a rotating device 106 for rotating the shielding member 92 about the axis of the shielding-member drive shaft 102, and a horizontal linear motion device 108 for linearly moving the shielding member 92 in the horizontal direction.

The rotating device 106 includes a rotating member 110, and a rotary drive device in the form of a motor 112 for rotating the rotating member 110. The shielding-member drive shaft 102 is fitted in the rotating member 110 such that the shielding-member drive shaft 102 and the rotating member 110 are linearly movable relative to each other and are not rotatable relative to each other. As the rotating member 110 is rotated, the shielding-member drive shaft 102 is rotated, whereby the shielding member 92 is rotated integrally with the shielding-member drive shaft 102, between a horizontal position in which the shielding member 92 has a horizontal attitude, and a vertical position in which the shielding member 92 has a vertical attitude.

The horizontal linear motion device 108 includes a linear motion member 116, and a drive device in the form of a motor 118 for linearly moving the linear motion member 116. The linear motion member 116 is engaged with an engaging portion 120 of the shielding-member drive shaft 102 such that the linear motion member 116 and the engaging portion 120 are rotatable relative to each other and are not linearly movable relative to each other. As the linear motion member 116 is moved by an operation of the motor 118, the shielding-member drive shaft 102 and the shielding member 92 are linearly moved by means of the engaging portion 120.

The shielding member 92 has an advanced position to which the shielding member 92 is advanced by means of the rotating device 106 and the horizontal linear motion device 108, for contact with the drawn molten metal 26, and a retracted position to which the shielding member 92 is retracted away from the drawn molten metal 26. The shielding member 92 has the horizontal attitude when it is positioned at its advanced position, and has the vertical attitude when it is positioned at the retracted position. In the present embodiment, the shielding member 92 is retracted (moved in the left direction away from the position as shown in the figures) and is rotated to have the vertical attitude, whereby the shielding member 92 is positioned in the retracted position.

The advancing and retracting device 104 has a body 124 fixed to a support shaft 126. This support shaft 126 is supported by a vertical motion device 128 of the shielding-member moving device 94, such that the support shaft 126 is vertically movable. When the support shaft 126 is vertically moved by the vertical motion device 128, the advancing and retracting device 104 is vertically moved with the support shaft 126, whereby the shielding member 92 is vertically moved. The vertical motion device 128 functions as a shielding-member separating device which separates the shielding member 92 together with the forming starter member 20 from the partition member 14.

The auxiliary starter member 96 has a mounting portion 130 removably attached to an auxiliary-member drive shaft 132, which is supported by a horizontal linear motion device 134 of the auxiliary separating device 98, so that the auxiliary-member drive shaft 132 is horizontally movable. The body of the horizontal linear motion device 134 is fixed to a support shaft 136, which is vertically movably supported by a vertical motion device not shown in the figures.

In the present embodiment, the auxiliary starter member 96 is a rectangular body which has a first surface in the form of a side face for contact with the drawn molten metal 26 and the formed piece 28, and a second surface in the form of a lower end face for contact with the material exit surface 38 of the partition member 14. The auxiliary starter member 96 is moved to an auxiliary start position in which the first surface contacts the drawn molten metal 26 and the formed piece 28 while the second surface contacts the material exit surface 38. After the auxiliary starter member 96 has been moved to the auxiliary start position, the auxiliary starter member 96 is separated from the partition member 14. As a result, the molten metal is drawn by the second surface, that is, between the second surface and the material exit surface 38. The second surface of the auxiliary starter member 96 has the same function as the starter surface 66 of the forming starter member 20. Therefore, the second surface of the auxiliary starter member 96 will be referred to as auxiliary starter surface 140. Like the forming starter member 20, the auxiliary starter member 96 is formed of an aluminum alloy for casting, which is the same material as the molten metal 12.

In the sectional shape changing device 90 of the present embodiment, the shielding member 92 and the auxiliary starter member 96 can act on the same side surface of the formed piece 28, as shown in FIG. 6. In this arrangement, the cross sectional area of the formed piece 28 can be increased or decreased by the shielding member 92 and the auxiliary starter member 96 which are operable on the same side of the formed piece 28. The sectional shape changing device 90 has a set of the shielding member 92, shielding-member moving device 94, auxiliary starter member 96 and auxiliary separating device 98, on each of the four sides of the formed piece 28. These four sets are equi-angularly spaced apart from each other at 90° angular interval around the formed piece 28, so that the cross sectional shape of the formed piece 28 can be changed on the four sides of the formed piece 28.

Figure 7:
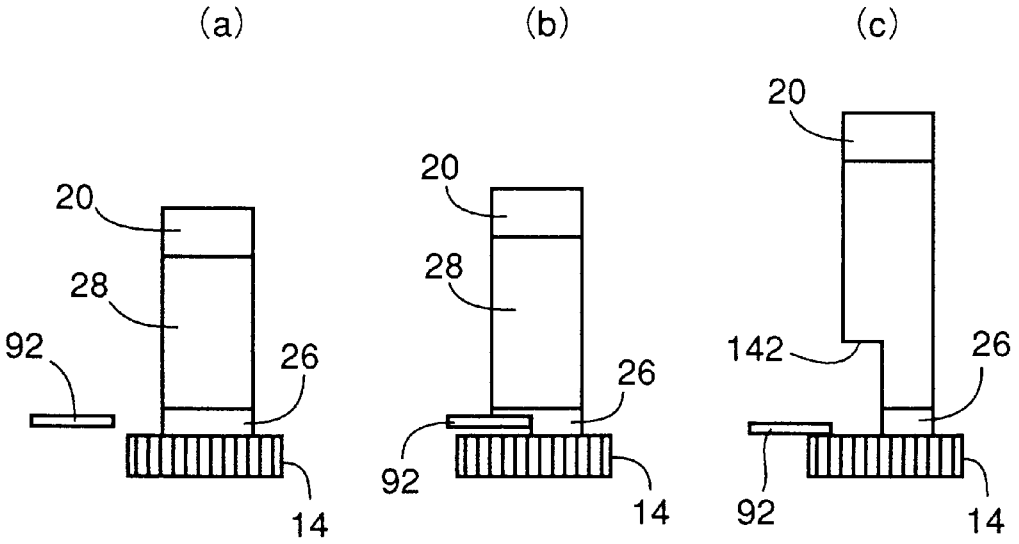
FIG. 7 is a view schematically showing steps in which the cross sectional area of the formed piece is reduced by the sectional shape changing device.

When the forming of the formed piece 28 is initiated, the shielding member 92 and the auxiliary starter member 96 are located in their retracted end positions. To reduce the cross sectional area of the formed piece 28 by using the shielding member 92, the auxiliary starter member 96 is vertically moved up to a position, in which the auxiliary starter member 96 does not interfere with the shielding member 92 when the shielding member 92 is moved up. As shown in FIG. 7, the shielding member 92 is advanced (moved in the right direction) from the retracted position to a predetermined advanced position. Then, the shielding member 92 is vertically moved with the forming starter member 20 from the predetermined advanced position, so as to be separated from the partition member 14.

In the advanced position, the shielding member 92 separates the corresponding portion of the drawn molten metal 26 and the partition member 14 from each other, whereby the shielding member 92 prevents the molten metal 12 from being drawn from the segmental surfaces 34 (perforations 32) which are covered by the shielding member 92. As a result, the cross sectional area of the formed piece 28 is reduced by an amount corresponding to the area of the separated portion.

Figure 8:
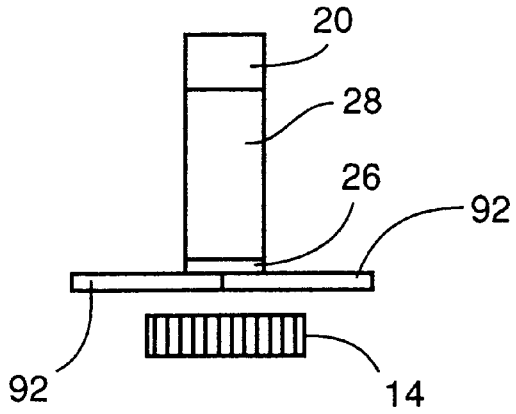
FIG. 8 is a view schematically showing a state in which the formed piece is cut off by the sectional shape changing device.
Figure 9:
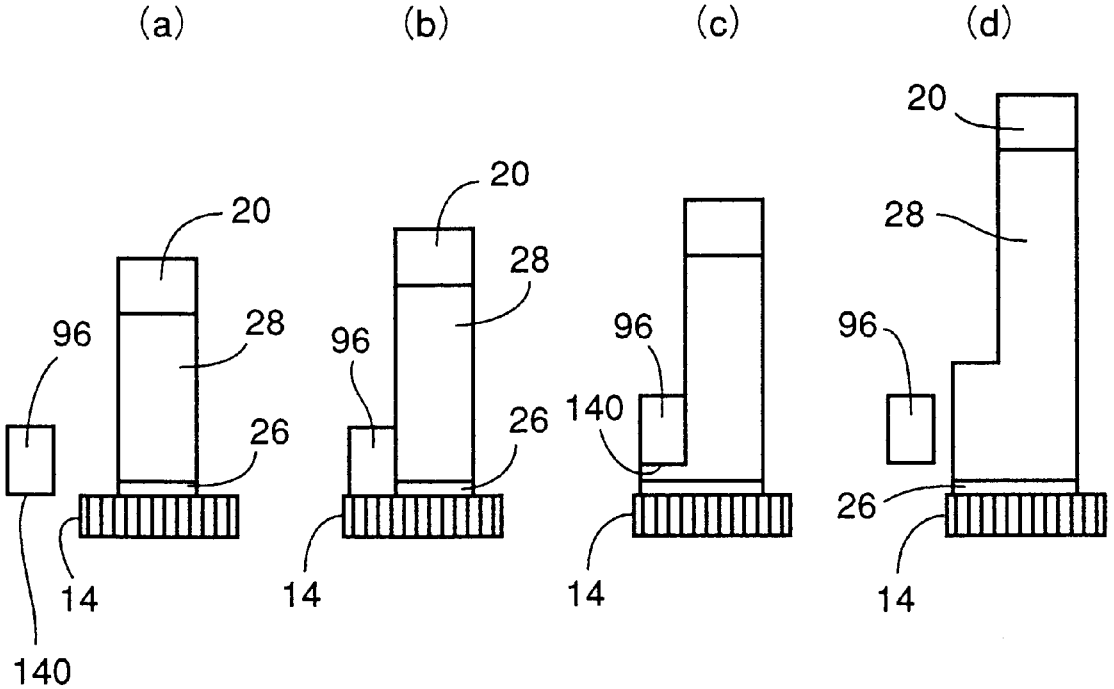
FIG. 9 is a view schematically showing steps in which the cross sectional area of the formed piece is increased by the sectional shape changing device.

As the shielding member 92 and the formed piece 28 (forming starter member 20) are moved together with each other, the drawn molten metal 26 contacting the shielding member 92 is solidified, whereby a reduction surface 142 is formed on the formed piece 28. The movement of the shielding member 92 together with the formed piece 28 is effective to avoid dripping of the drawn molten metal 26 and consequent recessing of the reduction surface 142 due to insufficiency of the molten material at the reduction surface 142. As described below, in a case where the solidification surface 82 is flat, the reduction surface 142 to be formed avoids being concave due to insufficiency of the molten material even if the shielding member 92 is not moved together with the formed piece 28. However, it is difficult to keep the solidification surface 82 flat, and therefore the solidification surface 82 is generally controlled to be more or less concave to avoid the undesirable convexity.

Where the drawn molten metal 26 and the partition member 14 are separated by the shielding members 92 over the entire cross sectional area of the drawn molten metal 26, the formed piece 28 can be cut off, as shown in FIG. 8. If the surface area of the shielding member 92 is smaller than the entire cross sectional area of the drawn molten metal 26, the two or more shielding members 92 are advanced to their advanced positions, so as to cooperate with each other to cover the entire cross sectional area of the drawn molten metal 26. Thus, the shielding member 92 is considered to be a cutting member, and the advanced position is considered to be a cutting position. Further, the advancing and retracting device 104 is considered to be a cutting-position positioning device.

Where the auxiliary starter member 96 is used to increase the cross sectional area of the formed piece 28, the shielding member 92 is previously moved to its retracted position in which the shielding member 92 has the vertical attitude. Then, as indicated in FIG. 9, the auxiliary starter member 92 is moved to the auxiliary start position, and is subsequently separated together with the forming starter member 20 from the partition member 14 after the molten metal has adhered to the auxiliary starter surface 140 of the auxiliary starter member 96. Before the movement of the auxiliary starter member 96 to the auxiliary start position, the upper surface 16 of the molten metal mass is raised relative to the partition member 14, so that the molten metal 12 easily adheres to the auxiliary starter surface 140. The drawn molten metal 26 between the auxiliary starter surface 140 and the partition member 14, and the drawn molten metal 26 between the starter surface 66 and the partition member 14 are integrally solidified, whereby the cross sectional area of the formed piece 28 is increased by an amount corresponding to the area of the auxiliary starter surface 140.

An upper covering member 150 is disposed above the accommodation container 10, for enclosing the partition member 14, the forming starter member 20 and the upper surface 16 of the molten metal mass. The interior space within the upper covering member 150 is supplied with a nitrogen gas from a gas supply device 152, so that the upper surface 16 and the drawn molten metal 26 are protected from exposure to oxygen. The upper covering member 150 covers not only the upper surface 16 of the molten metal 12 but also the drawn molten metal 26. Thus, the upper covering member 150 serves as a forming-space covering member. At a lower portion of the upper covering member 150, there is provided a vent hole equipped with a check valve, for discharging the nitrogen gas into the atmosphere. The check valve is not essential.

Air tightness is secured between the upper covering member 150 and the various devices such as the sectional shape changing device 90, partition-member holding member 22 and three-dimensional motion device 18. The upper covering member 150 is provided at an upper portion thereof with an opening and closing member which is not shown in the figure, and which is opened to remove the formed piece 28 from the upper covering member.

Outside the accommodation container 10, there is disposed a stirring device in the form of an electromagnetic coil 154. In the present embodiment in which the molten material accommodated in the accommodation container 10 is a metallic material, the molten material, i.e., the molten metal 12 can be stirred by interaction of an electric current and a magnetic field. With the molten metal 12 being stirred by the interaction, the temperature of the molten metal 12 in the accommodation container 10 is made uniform, and the molten metal 12 is made homogeneous. Reference numeral 156 denotes a molten-metal heating device.

The present forming system is further equipped with a molten metal supply device 160, which includes a supply container 162 storing the molten metal therein, a connecting tube 164 connecting the containers 10, 162, and an electromagnetic pump 166 provided at a portion of the connecting tube 164. The electromagnetic pump 166 is activated by a controlled amount of electric current, so that the amount of the molten metal to be fed into the accommodation container 10 is controlled. The amount of electric current applied to the electromagnetic pump 166 is controlled by a driver circuit not shown in the figure, under the control of the forming control device 62 indicated above. In the present embodiment, the electromagnetic pump 166 is controlled such that the amount of the molten material mass is held substantially constant. That is, since the molten metal is continuously fed into the accommodation container 10, the molten-metal supply device 160 is considered to be a continuous supplying device. Outside the supply container 162, there is disposed a heating device, not shown in the figure, for heating the molten metal within the supply device 162, so that the molten metal within the supply device 162 is kept in a molten state.

The present forming system is equipped with a starter-member-internal-pressure control device 170. The starter-member-internal-pressure control device 170 is used where the forming starter member is replaced with a hollow-cylindrical-shaped forming starter member which has a bottom closing one of axial ends of the member, as described below. That is, the starter-member-internal-pressure control device 170 is used so as to increase or decrease the pressure within an internal space formed in such a forming starter member.

The forming control device 62 is principally constituted by a computer incorporating CPU, ROM, RAM, an input portion and an output portion. The input portion is connected to the surface sensor 44 described above, while the output portion is connected through respective driver circuits not shown in the figure, to the various devices such as the control panel for driving the three-dimensional motion device 18, the temperature adjusting device 74, the sectional shape changing device 90, the electromagnetic pump 166, the gas supply device 152, and the starter-member-internal-pressure control device 170. The ROM stores various data relating to the shapes and other features of pieces to be formed, and various control programs for forming the pieces.

The three-dimensional motion device 18, the temperature adjusting device 74, the sectional shape changing device 90 and the starter-member-internal-pressure control device 170 are controlled depending upon the shape and other features of the piece to be formed, and the electromagnetic pump 166 is controlled so that the amount of the molten metal 12 is kept substantially constant.

There will next be described an operation of the forming system constructed as described above.

The forming starter member 20 is brought into contact with the material exit surface 38 of the partition member 14, such that the starter surface 66 is in contact with the upper surface 16. Then, the forming starter member 20 is separated from the partition member 14, so that the molten metal 12 is drawn from the material exit surface 38 of the partition member 14. The drawn molten metal 26 is solidified, between the starter surface 66 and the material exit surface 38, into the formed piece 28. This formed piece 28 has substantially the same cross sectional area and shape as those of the starter surface 66.

When the forming starter member 20 is brought into contact with the partition member 14, the partition member 14 is moved down by a downward movement of the partition-member holding member 22, so that the upper surface 16 is raised relative to the partition member 14, so as to be close to the material exit surface 38. In this state, the upper surface 16 of the molten metal 12 within the perforations 32 of the partition member 14 protrudes from the material exit surface 38, owing to surface tension of the molten metal 12. Accordingly, the contact of the starter surface 66 with the material exit surface 38 permits stable adhesion of the molten metal 12 to the starter surface 60. In the present embodiment wherein the starter surface 66 of the forming starter member 20 is brought into contact with the material exit surface 38 of the partition member 14, the partition member 14 also functions as a positioning member which positions the forming starter member 20.

After the molten metal 12 has adhered to the starter surface 66 of the forming starter member 20, the forming starter member 20 is moved upward by a small distance, while at the same time the partition-member holding member 22 holding the partition member 14 is moved upward. The upward movement of the partition member 14 lowers the upper surface 16 relative to the partition member 14, and accordingly moves the upper surface 16 back away from the material exit surface 38. The molten metal adhering to the forming starter member 20 is solidified, and its shape is stabilized owing to necking.

Then, as the forming starter member 20 is separated from the partition member 14, the molten metal 12 accommodated in the accommodation container 10 is continuously drawn up from the segmental surfaces 34 (perforations 32), whereby the piece 28 is formed. During the formation of the piece 28, the molten metal is fed from the molten metal supply device 160, so that the amount of the molten material mass is kept substantially constant, whereby the height of the upper surface 16 relative to the accommodation container 10 is kept substantially constant. Accordingly, the upward movement of the forming starter member 20 causes a relative displacement of the partition member 14 and the forming starter member 20 away from each other.

Further, during the forming process, the upper surface 16 is kept at substantially the same height as the material exit surface 38 of the partition member 14. While the amount of the molten metal 12 is kept substantially constant as described above, the height of the partition member 14 relative to the upper surface 16 is finely adjusted by the partition-member elevating device 24, so as to be kept constant. As a result, the molten material 12 is stably drawn upward, thereby stabilizing the shape of the formed piece 28.

The molten metal 12 is drawn up from only ones of segmental surfaces 34 from which the molten metal adhering to the starter surface 66 is drawn up, and is not drawn up from the other segmental surfaces 34. The molten metal 12 does not move across the partition walls 30, so as to be drawn up. Therefore, the ones of the segmental surfaces 34 from which the molten metal 12 is drawn up are not changed throughout the forming process, without application of an external factor to the segmental surfaces 34. The formed piece 28 can be given substantially the same cross sectional area and shape as those of the starter surface 66. The maximum possible difference of the external dimension of the formed piece 28 with respect to the cross sectional dimension of the starter surface 66 does not exceed the dimension of each segmental surface 34 multiplied by two (equal to the dimension of each segmental surface 34 for each one of the opposite sides).

Further, during the forming process, the height of the outer periphery of solidification surface 82 relative to the upper surface 16 (drawing distance m) is kept substantially constant. As shown in FIG. 4, the cross sectional area of the formed piece 28 decreases with an increase in the drawing distance m, and increases with a decrease in the drawing distance m. Therefore, the cross sectional area of the formed piece 28 can be kept constant by keeping the drawing distance m constant throughout the forming process. The drawing distance m may be controlled by adjusting the velocity of the relative movement of the forming starter member 20 and the partition member 14, temperature settings of the heating and cooling devices 76–79 and other operating parameters of the forming system.

The velocity of the relative movement of the forming starter member 20 and the partition member 14 and the cooling velocity of the heating and cooling devices 76–79 are controlled so that the solidification surface 82 is held concave or flat. In an initial period of the forming process, the heating and cooling devices 76, 77 are used as the cooling device. The drawn molten metal 26 is cooled at its outer side surfaces by the heating and cooling devices 76, 77, and at its upper surface by the forming starter member 20 through the formed piece 28. Since the temperature in the outer portion of the drawn molten metal 26 is made lower than that in the inner portion, the solidification surface 82 is concaved, whereby the solidification of the molten metal 12 within the partition member 14 is avoided.

Subsequently, the lower heating and cooling devices 76, 77 are used as the heating device, to heat the formed piece 28 at its outer side surfaces, whereby the drawn molten metal 26 is heated at its outer side surfaces. Since the drawn molten metal 26 is heated at the outer side surfaces and cooled at its upper surface, the temperature difference between the outer and inner portions of the drawn molten metal 26 is reduced, whereby the solidification surface 82 is made flat. Where the formed piece 28 is cut off, or where the reduction surface 142 is formed, it is possible to prevent a considerable recess in the cut surface or the reduction surface 142, by thus making the solidification surface 82 flat.

After the formed piece 28 has extended through the heating and cooling devices 78, 79, these heating and cooling devices 78, 79 are used as the heating device for heating the formed piece 28 at its outer side surfaces. As a result, the temperature difference between the outer and inner portions of the drawn molten metal 26 is reduced, and the solidification surface 82 is made flat.

In the present embodiment, the heating and cooling devices 76–79 are positioned in alignment with the side surfaces of the formed piece 28, and are not adapted to act on the corner sections of the formed piece 28. This arrangement allows uniform heating and cooling of the drawn mass 26 at its outer side surfaces. Since the starter surface 66 of the forming starter member 20 is generally U-shaped as described above, the heating and cooling devices 76–79 are not adapted to act on the corner sections but are positioned in alignment with the side surfaces.

Thus, the relative height of the partition member 14 and the upper surface 16, the relative movement velocity of the starter member 20 and the partition member 14, the drawing distance m, and the temperature of the drawn molten metal 26 are controlled according to control commands of the forming control device 62, so as to control the velocity of forming the piece 28, and the cross sectional shape, dimensions and composition of the formed piece 28.

When the formed piece 28 has grown to a desired length, the shielding member or members 92 is advanced to the cutting position in which the drawn molten metal 26 is separated over its entire cross sectional area from the formed piece 28 by the shielding member or members 92, whereby the formed piece 28 is cut off. The two or more shielding members 92 are used to cut off the formed piece 28, if the surface area of the shielding member 92 is smaller than the cross sectional area of the drawn molten metal 26, or if the maximum movement stroke of the shielding member 92 is not sufficient to cut off the formed piece 28.

Each shielding member 92 located in the cutting position is moved together with the forming starter member 20, in the direction away from the partition member 14. The portion of the drawn molten metal 26 left on the shielding member 92 is solidified, forming the cut surface of the formed piece 28. The formed piece 28 having the cut surface is removed through an opening portion of the opening and closing member provided at the upper portion of the upper covering member 150, after the opening portion has been opened.

Since the shielding member or members 92 is/are moved together with the forming starter member 20 upon cutting the formed piece 28, the cut surface avoids being recessed due to an insufficiency of the molten metal, even where the solidification surface 82 is concave.

In the forming process, the molten metal 12 accommodated in the accommodation container 10 is stirred so as to avoid uneven distribution of the components of the molten metal 12 within the accommodation container 10. This is effective to avoid a variation in the composition of the formed piece 28 in the longitudinal direction. The stirring of the molten metal 12 in the accommodation container 10 is also effective to a reduced local variation in the temperature of the molten metal 12 in the accommodation container 10.

The interior of the upper covering member 150 is supplied with a nitrogen gas by both the gas supply device 150 and the heating and cooling devices 76–79, so that both the upper surface 16 and the drawn molten metal 12 are protected from oxidation, leading to improved quality of the formed piece 28. The heating and cooling devices 76–79 have not only the function of cooling the drawn molten metal 26, but also the function of supplying the above-indicated interior with the nitrogen gas.

Further, the interior of the upper covering member 150 is slightly pressurized, it is possible to use the molten material having a high vapor pressure or containing a large volume of gases.

In the present forming system, a relative movement device is principally constituted by the partition-member elevating device 24 and the three-dimensional motion device 18. As described above, during the forming process, the height of the partition member 14 relative to the accommodation container 10 is kept substantially constant, and the forming starter member 20 is moved by the three-dimensional motion device 18 relative to the partition member 14. The velocity of the relative movement of the forming starter member 20 and the partition member 14 is controlled by the forming control device 62, usually in relation to the operation of the temperature adjusting device 74 including the heating and cooling devices 76–79, although it may be controlled independently of the operation of the temperature adjusting device 74. The forming control device 62 is considered to include relative-movement-velocity controlling means for controlling the velocity of the relative movement of the forming starter member 20 and the partition member 14, and temperature adjusting means for adjusting the temperature.

Thus, at least one of the three-dimensional motion device 18 and the temperature adjusting device 74, and a portion of the forming control device 62 which is assigned to control the at least one of these devices cooperate to provide various devices such as a molten-material-drawing-distance keeping device, a solidification-velocity control device, a forming-velocity control device, a solidification-surface-shape control device, and a piece-composition control device.

Figure 10:
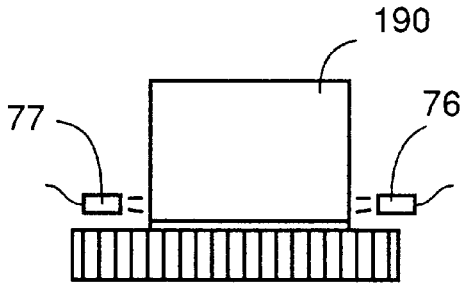
FIG. 10 is a view schematically showing a state in which the forming system forms a piece having an attitude extending in the vertical direction.

The relative position of the partition member 14 and the upper surface 16 is controlled by a relative-position control device which is principally constituted by the partition-member holding member 22, the partition-member elevating device 24, the surface tracing control device 42 and the surface sensor 44. In the forming process, the position of the upper surface 16 relative to the partition member 14 is kept substantially constant by relative-height keeping means. In the present embodiment, the molten metal supply device 160 is adapted to supply the container with the molten metal, so that the amount of the molten metal mass is kept constant. Thus, the molten metal supply device 160 is considered to provide one form of the relative-position control device. The supply amount of the molten metal is controlled by molten-material-amount-basis-supply-amount controlling means, which is supply-amount controlling means of the forming control device 62. More specifically, an electric current to be supplied to the electromagnetic pump 166 is controlled by electric current controlling means.

Where the starter surface 66 and the material exit surface 38 are held parallel to each other during the forming process, a piece 190 extending in the vertical direction is formed, as shown in FIG. 10. The formed piece 190 is cut off when the length of the formed piece 190 has increased to a predetermine value, and is removed through the opening portion.

Figure 11:
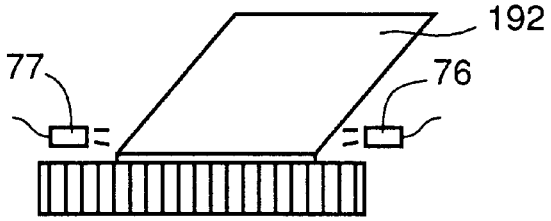
FIG. 11 is a view schematically showing a state in which the forming system forms a piece having an inclined shape.

In the above case, the three-dimensional motion device 18 is considered to include a parallel separating device, a vertically parallel separating device, an angle-holding and separating device and a molten-metal drawing device.

Where the forming starter member 20 and the partition member 14 are vertically separated from each other and horizontally moved relative to each other while the starter surface 66 and the material exit surface 38 are held parallel to each other, a piece 192 having inclined side surfaces is formed, as shown in FIG. 11. In this case, the two members 14, 20 are vertically separated from each other, and horizontally moved relative to each other by the three-dimensional motion device 18. Thus, the three-dimensional motion device 18 is considered to include a relative-horizontal-movement device and a combined-motion-applying device.

The velocities of the vertical and horizontal movements are controlled by respective driver circuit not shown in the figure, under the control of the forming control device 62. If the horizontal movement velocity is excessively high, the drawn molten material 26 may possibly be cut off. Accordingly, the horizontal movement velocity is controlled by a contour-diversification-purpose-relative-horizontal-movement-velocity controlling means, so as to prevent cutting of the drawn molten metal 26 and permit change of the contour of the formed piece 28.

Figure 12:
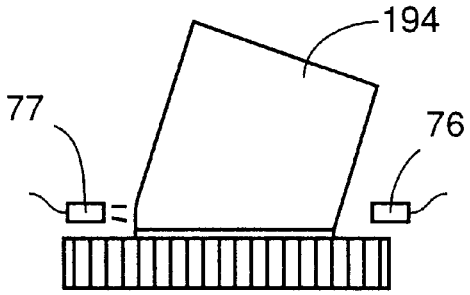
FIG. 12 is a view schematically showing a state in which the forming system forms a piece having a curved shape.

On the other hand, the formed piece 28 can be cut off by horizontally moving the forming starter member 20 relative to the partition member 14 at a considerably high velocity and over a relatively large distance. In this case, the height of the upper surface 16 is desirably backed away from the material exit surface 38 by elevating the partition member 14, before the forming starter member 20 and the partition member 14 are horizontally moved relative to each other. In this case, various operating parameters such as the velocity of the horizontal movement is controlled by cutting-purpose-horizontal-movement-velocity controlling means. This technique to cut off the formed piece by the horizontal movement of the forming starter member 20 is applicable to a formed piece having a shape extending in the vertical direction, and also a formed piece having inclined side surfaces such as the formed piece 192.

Where the starter surface 66 and the material exit surface 38 are rotated relative to each other in the forming process, a piece 194 having curved side surfaces is formed, as shown in FIG. 12. That is, the starter surface 66 and the material exit surface 38 are initially kept parallel to each other, and then become non-parallel to each other.

In the above case, the heating and cooling device 77 located outwardly of the relative rotating path of the starter surface 66 and the material exit surface 38 is used as the cooling device, while the heating and cooling device 76 located inwardly of the relative rotating path is held in the non-operated state. The heating and cooling device 76 is used as neither the heating device nor the cooling device. That is, the drawn molten metal 26 is cooled only on one of its opposite sides on which the velocity of the separation of the starter surface 66 and the material exit surface 38 from each other is higher than on the other side, so that the opposite sides of the drawn molten metal 26 are not evenly cooled. Thus, the cooling velocity is different on the opposite sides.

Where the cooling velocity on the one side of the drawn molten metal 26 on which the velocity of the separation of the starter surface 66 and the material exit surface 38 from each other is comparatively high is equal to the cooling velocity on the other side on which the velocity of the separation is comparatively low, the drawing distance m is made larger on the above-indicated one side and is made smaller on the other side. This results in a decrease in the across sectional area of the formed piece 28 on the above-indicated one side, and an increase in the cross sectional area of the formed piece 28 on the other side, whereby the curved side surfaces of the formed piece 28 does not accurately follow the path described by the starter surface 66. If the cooling velocity is adjusted to be suitable for the other side (inner side of the relative rotating path), the cooling velocity will be too low for the drawn molten metal 26 on the above-indicated one side (outer side of the relative rotating path) to maintain its shape owing to the surface tension. Thus, the drawn molten metal 26 may be torn apart on the outer side, or the formed piece 28 may have an insufficient density value on the outer side. If the cooling velocity is adjusted to be suitable for the molten metal 26 on the outer side, the velocity of the separation of the starter surface 66 and the material exit surface 38 from each other should be considerably reduced, resulting in a decrease in the forming speed or efficiency, and difficulty in obtaining a flatness on the solidification surface 82.

Where the cooling velocity of the drawn molten metal 26 is made higher on the outer side of the relative rotation path than on the inner side of the relative rotation path, the drawing distance m can be made substantially equal on the outer and inner sides. This permits the formed piece to have the curved side surfaces whose curvature accurately follows the path taken by the starter surface 66. Further, the present arrangement permits the forming starter member 20 and the partition member 14 to be separated from each other at optimum velocities on the outer and inner sides, and is therefore effective to prevent tearing of the drawn molten metal 26, and uneveness of the density and other component properties of the formed piece 28. This arrangement is also effective to permit sufficient flatness of the solidification surface 82.

Figure 13:
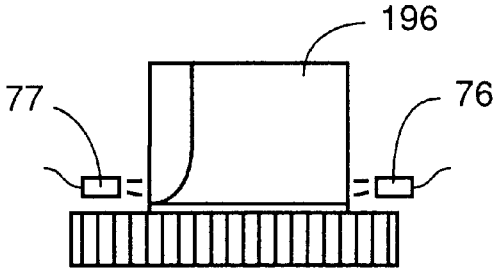
FIG. 13 is a view schematically showing a state in which the forming system forms a piece having a twisted shape.

The heating and cooling devices 76, 77 and a portion of the forming control device 62 assigned to control the heating and cooling devices 76, 77 cooperate to constitute an uneven-cooling-velocity applying device and an outer-side-surface principally-cooling device. The three-dimensional motion device 18 includes a non-parallel separating device, and an angle-varying and separating device.

Where the forming starter member 20 and the partition member 14 are separated from each other while these members 20, 14 are rotated relative to each other, a piece 196 having a twisted shape as shown in FIG. 13 is formed. In this case, the center of the relative rotation is located at the center of the forming starter member 20.

Since the starter surface 66 of the starter member 20 is generally U-shaped, the shape of the formed piece can be changed by rotating the forming starter member 20 and the partition member 14 relative to each other, about any desired position as the center of the relative rotation. Where the starter surface has a circular shape in its contour, the contour of the formed piece cannot be changed if the center of the relative rotation is located at the center of the circle of the starter surface. In this case, therefore, the center of the relative rotation should be offset from the center of the circle of the circular starter surface, to change the shape of the formed piece. Where the shape in the contour of the starter surface is not circular, the shape of the formed piece can be changed irrespective of the position of the center of the relative rotation.

If the center of the relative rotation is located outside the area of the formed piece 196, a piece having a spiral shape may be formed. If the forming starter member is replaced by a forming starter member having a starter surface whose shape is a relatively small circle, in this case, a spring may be formed. The three-dimensional motion device 18 is considered to include a relative rotation device.

Next, there will be briefly explained a case in which the cross sectional shape or area of the formed piece is changed, as viewed in the forming direction, by the sectional shape changing device 90.

Figure 14:
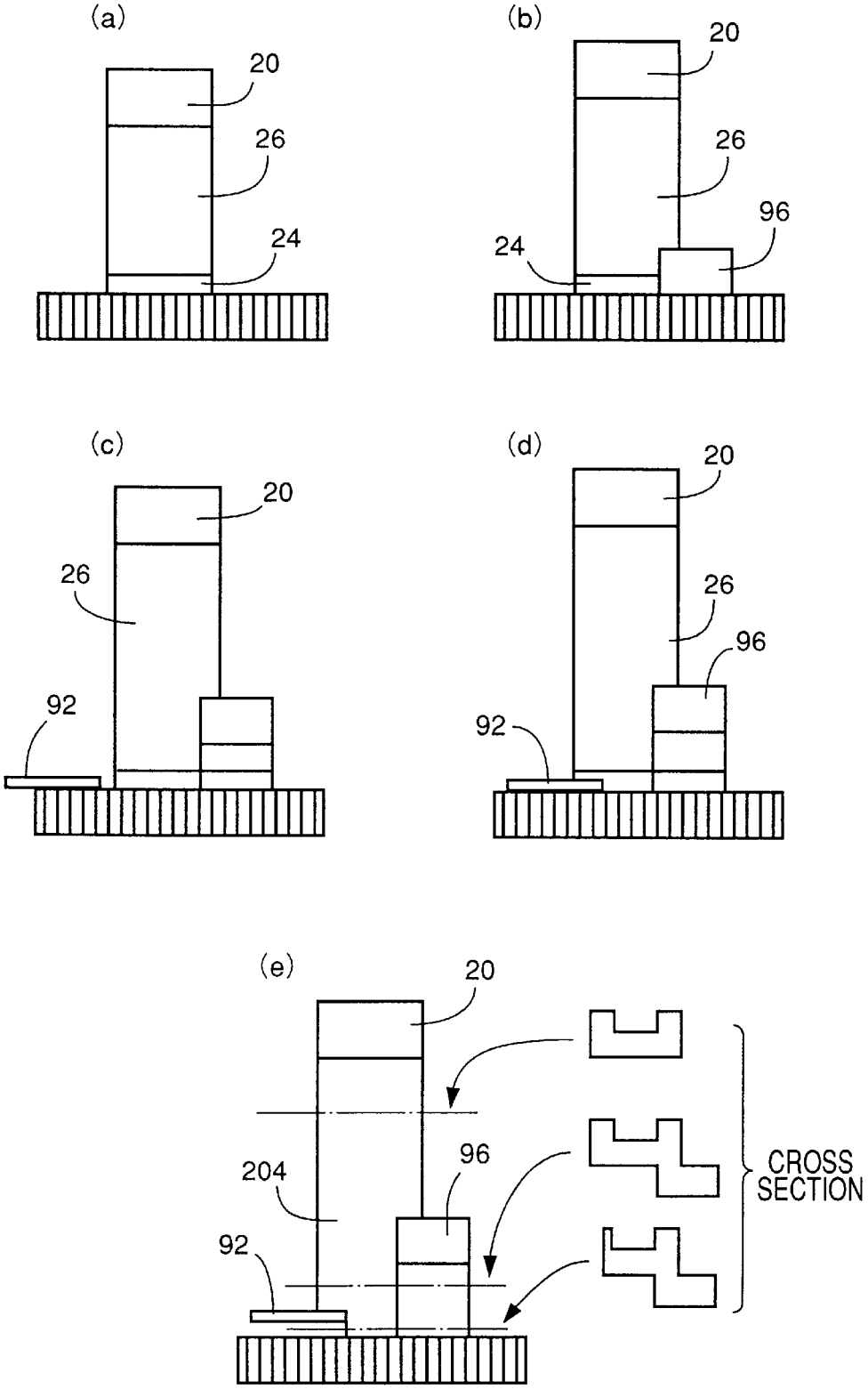
FIG. 14 is a view schematically showing steps in which the cross sectional area of the formed piece is reduced and increased by the sectional shape changing device.

The shielding member or members 92 is used to reduce the cross sectional area, while the auxiliary starter member or members 96 is used to increase the cross sectional area. The respective shapes of the shielding member 92 and auxiliary starter member 96 are determined depending upon the shape and dimensions of the reduction surface 142 or expansion surface of the formed piece. FIG. 14 shows a formed piece 204 which is formed by suitably using the shielding member 92 and the auxiliary starter member 96. It is noted that the shape of the reduction surface 142 can be changed by horizontally moving the shielding member 92, by moving the shielding member 92 from the advanced position in the horizontal direction.

Figure 15:
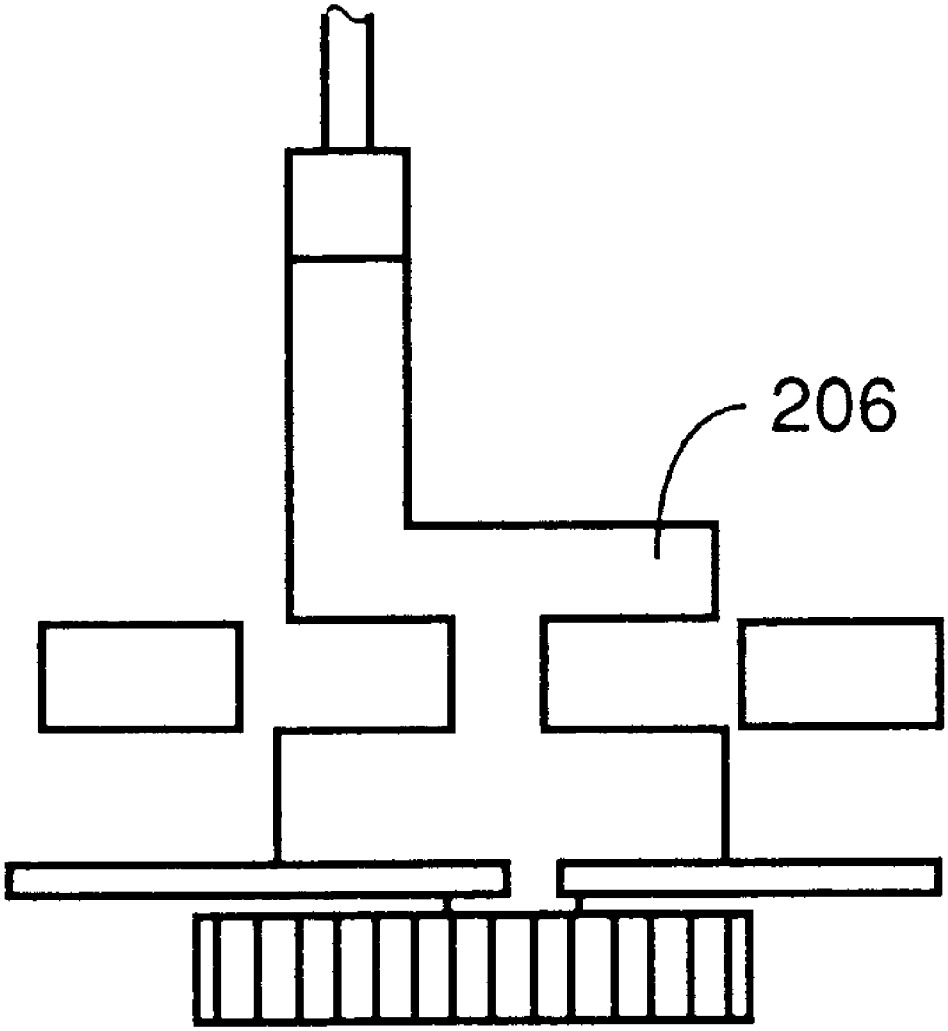
FIG. 15 is a view schematically showing a state in which the cross sectional area of the formed piece is reduced and increased on the same side of the formed piece, by the sectional shape changing device.

A formed piece 206 shown in FIG. 15 is formed by using the auxiliary starter member 96 and the shielding member 92 on the same side of the formed piece.

Where the cross sectional area is increased by using the auxiliary starter member 96, the auxiliary starter member 96 does not need to be separated together with the forming starter member 20 from the partition member 14, throughout the forming process. That is, after the drawn molten metal 26 located between the auxiliary starter member 96 and the partition member 14 has been solidified integrally with the drawn molten metal 26 located between the forming starter member 20 and the partition member 14, the molten metal 12 may be continuously drawn up also from ones of the segmental surfaces 34 at which the auxiliary starter member 96 used to be located, as the forming starter member 20 is separated from the partition member 14.

In the present embodiment, since the auxiliary starter member 96 and the shielding member 92 are adapted to be removably attached to the respective members, it is possible to form the expansion surface and the reduction surface, depending upon the respective shapes of the auxiliary starter surface 140 and the shielding member 92. Further, the shielding member 92 and the auxiliary starter member 96 can act on the same side surface of the formed piece, thereby permitting a wider range of variations in changing the shape of the formed piece 28, and leading to an increased degree of freedom of design of the formed piece.

Figure 16:
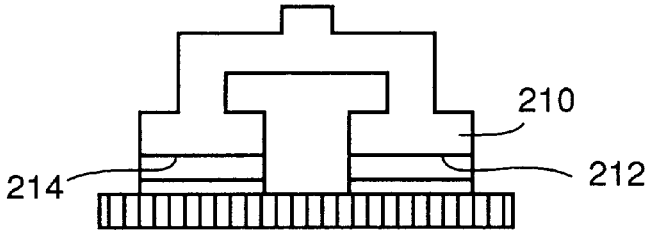
FIG. 16 is a view schematically showing steps in which a piece having separate portions is formed by the sectional shape changing device.
Figure 16:
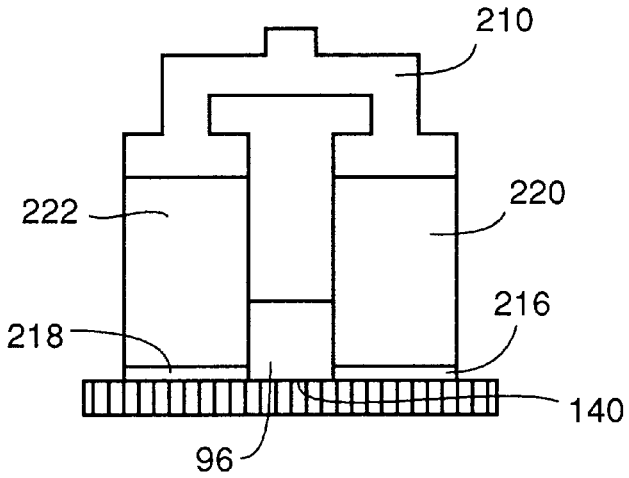
Figure 16:
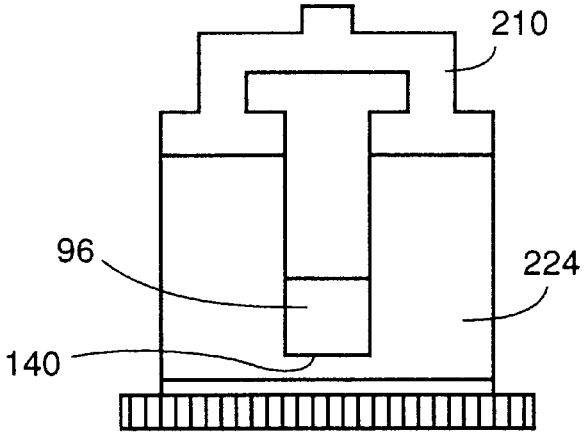

Next, there will be explained a case in which a piece having separate portions is formed by using the auxiliary starter member 96. The forming starter member 20 is first replaced by a forming starter member 210, as shown in FIG. 16, which has mutually independent two starter surfaces 212, 214. The molten metal 12 adheres to the starter surfaces 212, 214, and is drawn up as the starter member 210 is separated from the starter member 14, whereby drawn molten metals 216, 218 are solidified into respective formed pieces 220, 222 which are separate from each other. When the length of the formed pieces 220, 222 has increased to a predetermined value, the auxiliary starter member 96 is moved to an auxiliary start position in which the auxiliary starter member 96 is in contact with the drawn molten metals 216, 218 while the auxiliary starter surface 140 is in contact with the upper surface 16. Then, the auxiliary starter member 96 is separated together with the forming starter member 210 from the partition member 14. A drawn molten metal drawn by the auxiliary starter surface 140 is solidified integrally with the drawn molten metals 216, 218 drawn by the starter surfaces 212, 214. As a result, a U-shaped piece 224 is formed.

The auxiliary starter member 96 located at the auxiliary start position contacts the two drawn metals 216, 218 and the two formed pieces 220, 222. In this case, the auxiliary starter member 96 is considered to have two first surfaces.

In the present embodiment, the U-shaped piece 224 is formed by connecting the two formed pieces 220, 222. In this sense, the auxiliary separating device 98 may be referred to as a connection-purpose auxiliary separating device. The forming system including this connection-purpose auxiliary separating device may be referred to a formed-piece connecting system or a U-shaped-piece forming system.

Next, there will be explained a case in which a piece is formed by using a forming starter member which is a hollow-cylindrical-shaped member having a bottom wall which closes one of axial ends of the member.

Figure 17:
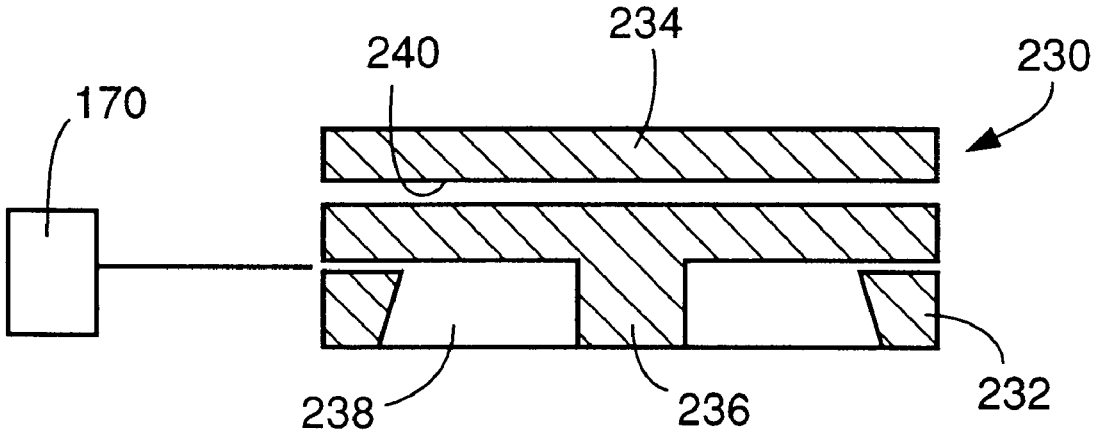
FIG. 17 is a cross sectional view of a forming starter member attached to the forming system.

The forming starter member 20 is replaced by a forming starter member 230, as shown in FIG. 17, which includes a cylindrical wall portion 232 and a bottom wall portion 234 closing one of axial ends of the forming starter member 230. A projecting portion 236 is provided to the bottom wall portion 234. The forming starter member 230 is connected to the starter-member-internal-pressure control device 170 which serves to control the pressure in a space 238 which is defined by the cylindrical wall portion 232 and the bottom wall portion 234. The bottom wall portion 234 further has a passage 240, which is supplied with water for cooling the forming starter member 230.

After the forming starter member 230 has been brought into contact with the partition member 14, the pressure in the space 238 is lowered by the starter-member-internal-pressure control device 170. As a result, the molten metal 12 is introduced into the space 238 from those ones of the segmental surfaces 34 which corresponds to the space 238, and the molten metal 12 within the space 238 is solidified.

Then, the forming starter member 230 and the partition member 14 are separated from each other, whereby a piece is formed between these members 230, 14. The shape of the end face of the formed piece is constituted by the molten metal which is introduced into and solidified in the space 238, and the end face of the forming starter member 230. That is, a cavity is formed at the center of the end face of the formed piece in the presence of the projecting portion 236.

The formed piece is not a hollow cylindrical body, but is a solid body, since the molten metal which is introduced into and solidified in the space 238 in the initial period of the forming process, also serves as the starter surface for drawing up the molten metal 12 from those ones of the segmental surfaces 34 which corresponds to the space 238.

The formed piece thus formed is desirably treated by a forging operation, for instance, since the portion of the formed piece which is formed of the molten metal drawn by the reduced pressure tends to have a composition different from that of the portion of the formed piece which is formed of the molten metal drawn during the vertical movement of the starter member. A plastic working such as the forging operation is effective to make the formed piece homogeneous.

The molten metal introduced into the annular space 238 under the lowered pressure exerts a force on the projecting portion 236 after having been solidified, whereby the adhesion of this molten metal to the forming starter member 230 is strengthened, preventing the removal from the forming starter member 230. Thus, the projecting portion 236 functions as an adhesion boss, and the forming starter member 230 is considered to have a removal preventing device.

The amount of the molten metal 12 introduced into the space 238 increases with a decrease in the pressure within the space 238. Accordingly, the shape of the end face of the formed piece may be changed by controlling the pressure in the space 238.

The surfaces of the bottom wall portion 234 and the cylindrical wall portion 232 may be recessed, raised or otherwise shaped, to give a designed shape to the end face of the formed piece, and to increase the resistance to the removal of the molten material from the forming starter member.

After the forming process, the formed piece may be cut off to remove the portion which has been introduced into and solidified in the space 238. In this case, too, the projecting portion 236 functions to prevent the removal of the molten material from the forming starter member.

Figure 18:
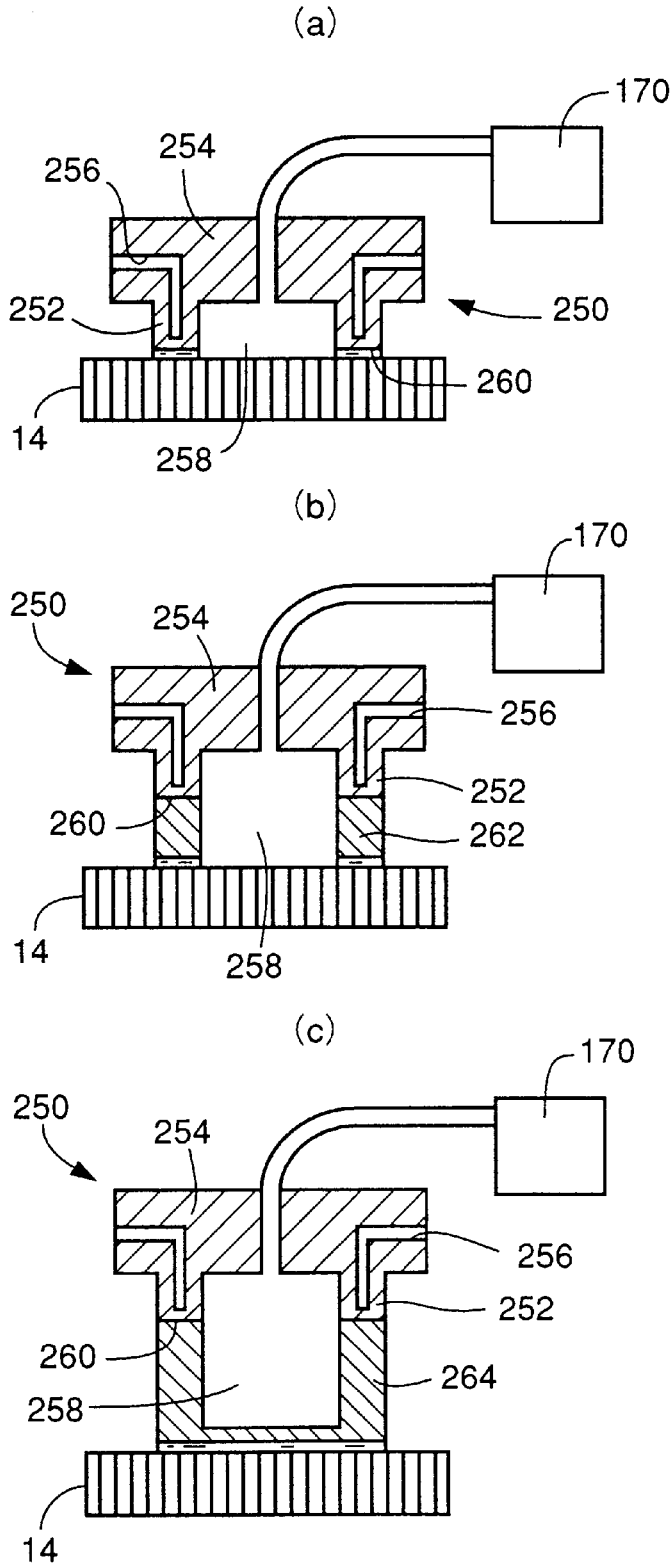
FIG. 18 is a view schematically showing steps of forming a hollow-cylindrical-shaped piece which has a bottom closing one of axial ends of the piece, by using a hollow-cylindrical-shaped forming starter member which has a bottom closing one of axial ends of the member and which is attached to the forming system.

Next, there will be explained a case in which a forming starter member 250 as shown in FIG. 18 is used to form a hollow cylindrical piece which has a bottom wall closing one axial end of the piece. Like the forming starter member 230, the forming starter member 250 includes a cylindrical wall portion 252, and a bottom wall portion 254 which closes one end of the forming starter member 250. The cylindrical wall portion 252 has a passage 256 formed therein. A space 258 is connected to the starter-member-internal-pressure control device 170.

After the molten metal adheres to a starter surface 260 of the forming starter member 250, the forming starter member 250 and the partition member 14 are separated from each other while the pressure in the space 258 is kept at the atmospheric pressure or a level slightly higher than the atmospheric pressure. The molten metal is drawn up from those ones of the segmental surfaces 34 which correspond to the starter surface 260, and the drawn molten metal is solidified into a hollow cylindrical piece 262 which has the same cross sectional shape as the starter surface 260. When the length of the hollow cylindrical piece 262 has increased to a predetermined value, further separation of the forming starter member 250 and the partition member 14 from each other is effected with the pressure in the space 258 being lowered. As a result, the molten metal 12 is introduced into the space 258 from those ones of the segmental surfaces 34 which correspond to the space 258, and is solidified to form a hollow cylindrical piece 264 having a bottom wall portion which closes one end of the piece.

In the process of forming the hollow cylindrical piece 262, the pressure in the space 258 is kept at the atmospheric pressure or a level slightly higher than the atmospheric pressure, in order to prevent the molten metal 12 from being introduced into the space 258 from those ones of the segmental surfaces 34 which correspond to the space 258.

If the separation of the forming starter member 250 and the partition member 14 from each other is continued such that the pressure in the space 258 is not lowered but kept at the atmospheric pressure or a level slightly higher than the atmospheric pressure, the hollow cylindrical piece 262 is obtained by cutting off the drawn molten metal.

Thus, the use of the forming starter member 250 and the suitable adjustment of the pressure in space 258 by the starter-member-internal-pressure control device 170 permit selective formation of the two types of formed pieces, namely, the hollow cylindrical piece 264 having the bottom wall portion, and the hollow cylindrical piece 262.

Since the passage 256 is formed to extend to a point adjacent to the starter surface 260, the molten metal 12 adhering to the starter surface 260 can be rapidly solidified.

As described above, the present forming system is capable of obtaining formed pieces having various shapes, by simply replacing the forming starter member 20 by other forming starter members, without changing the partition member 14. Further, the use of the shielding members 92 and auxiliary starter members 96 having different shapes, in addition to the forming starter member 20, makes it possible to increase the variety of the shape of the pieces formed by the present forming system.

The shape of the partition member 14 is not limited to that illustrated in the above-described first embodiment, but may be modified as desired. For instance, the partition member 14 may be replaced by a partition member having an inclined portion formed on the material exit surface, such as partition members 280–282 of FIGS. 19–21.

Where the partition member has the inclined portion formed on the material exit surface, it is possible to change the number and positions of the effective partition walls which actually divide the upper surface 16, by changing the relative height of the partition member 280–282 and the upper surface 16. Thus, it is possible to change the cross sectional shape of the formed piece, or to change the cross sectional size of the formed piece while maintaining the cross sectional shape.

Figure 19:
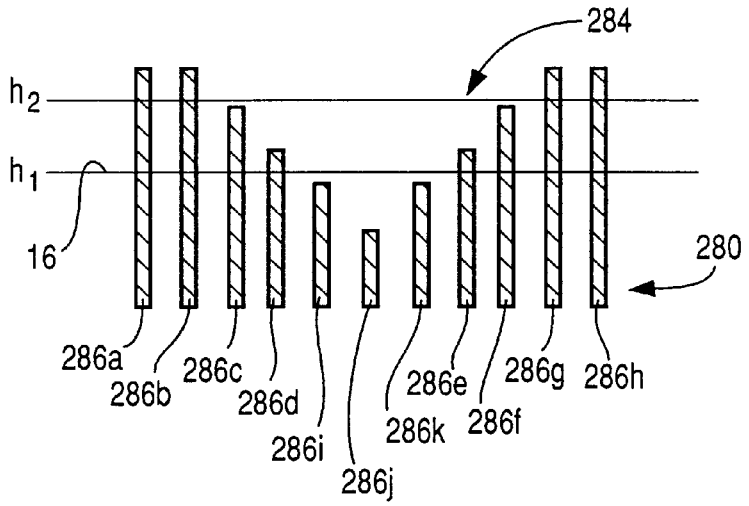
FIG. 19 is a cross sectional view schematically showing a first modification of the partition member.

The partition member 280 of FIG. 19 has a conical recess 284 formed on the material exit surface. Accordingly, the number of the effective partition walls decreases as the height of the upper surface 16 is raised relative to the partition member 280. The area inside the effective partition walls increases (the upper surface 16 is divided by the partition walls located closer to the outer peripheral portion of the partition member 280) as the height of the upper surface 16 is raised relative to the partition member 280. When the height of the upper surface 16 is raised, a portion of the upper surface 16 which has been divided by the partition walls 286 is no longer divided by the partition walls 286, whereby the area of the upper surface 16 from which the molten metal 12 is drawn up is expanded. When the height of the upper surface 16 is lowered relative to the partition member 280, on the other hand, the number of the effective partition walls is increased, and the area inside the effective partition walls decreases (the upper surface 16 is divided by not only the partition walls located closer to the outer peripheral portion of the partition member 280 but also the partition walls located closer to the center of the partition member 280). A portion of the upper surface 16 which has not been divided by the partition walls 286 is divided by the partition walls 286, whereby the area of the upper surface 16 from which the molten metal 12 is drawn up is reduced. The starter surface of the starter member should be smaller than the area inside the partition walls 286*d* and 286*f*.

When the upper surface 16 has a relative height $h_1$ with respect to the partition member 280, the upper surface 16 is divided by the partition walls 286*a*–286*h*, and the molten metal 12 is drawn from an area inside the partition walls 286*d* and 286*e*. In this case, the partition walls 286*a*–286*h* serve as the effective partition walls, and the area inside the partition walls 286*d* and 286*e* can be considered to be a single segmental surface. When the upper surface 16 has a relative height $h_2$ with respect to the partition member 280, the upper surface 16 is divided by the partition walls 286*a*, 286*b*, 286*g* and 286*h*, and the molten metal 12 is drawn up from an area (segmental surface) inside the partition walls

286*b* and 286*g*. In this case, the partition walls 286*a*, 286*b*, 286*g* and 286*h* serve as the effective partition walls.

In the partition wall 280, both the area inside the partition walls 286*d* and 286*e* and the area inside the partition walls 286*b* and 286*g* are circular, and the latter area has a larger radius than the former area. Therefore, a tapered piece can be formed if the height of the upper surface 16 relative to the partition member 280 is continuously changed. That is, the radius of the formed piece can be increased during the forming process. Further, if the height of the upper surface 16 relative to the partition member 280 is changed in steps, a piece including large and small diameter portions can be formed.

When the upper surface 16 has the relative height $h_1$, the area of the upper surface 16 inside the partition walls 286*d* and 286*e* can be considered to be a single segmental surface. If there is not a case in which the partition walls 286*i*–286*k* serve as the effective partition walls, the partition walls 286*i*–286*k* may be eliminated. However, the partition walls 286*i*–286*k* function as a filter, even though the partition walls 286*i*–286*k* do not function as the effective partition walls. It will be understood that the partition walls need not be arranged over the entire area of the partition member 280, and are disposed only at the desired positions.

Figure 20:
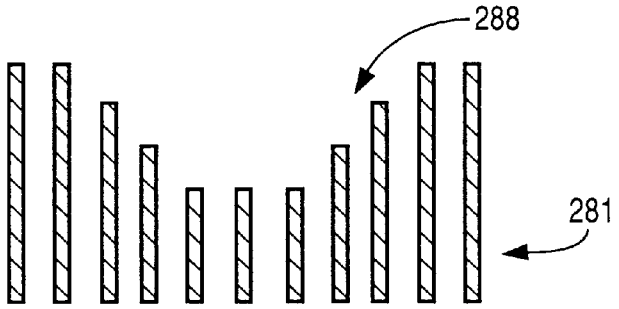
FIG. 20 is a cross sectional view schematically showing a second modification of the partition member.

In the partition member 281 of FIG. 20, the material exit surface has a semi-spherical recess 288. Also in this case, it is possible to control the cross sectional shape and dimensions of the formed piece, by controlling the height of the upper surface 16 relative to the partition member 281, as in the above case.

Since the partition member 281 has the inclined portion whose shape is different from that of the partition member 280, the taper angle of the piece formed by changing the height of the upper surface 16 relative to the partition member 281 is different from that of the piece formed by changing the height of the upper surface 16 relative to the partition member 280 at the same rate of change as in the case of the partition member 281.

Figure 21:
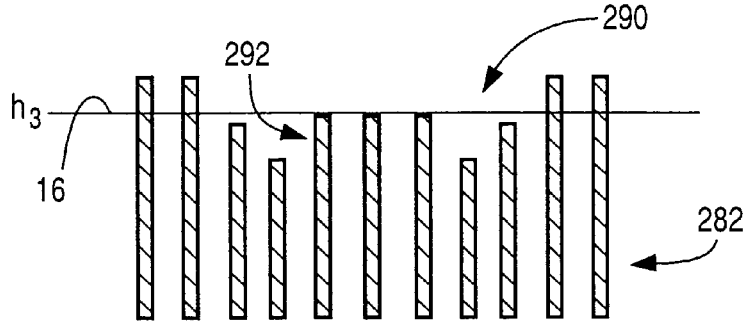
FIG. 21 is a cross sectional view schematically showing a third modification of the partition member.

In the partition member 282 of FIG. 21, the material exit surface has a conical recess 290 and a central projecting portion 292. When the upper surface 16 has a relative height larger than a level $h_3$, a solid piece is formed. When the upper surface 16 has a relative height smaller than the $h_3$, a hollow cylindrical piece is formed.

Each perforation of the partition member does not necessarily have to have a square cross sectional shape, but may have a circular or any other cross sectional shape. Further, the dimensions of the perforation and the thickness of the partition wall are not limited to those in the above-illustrated first embodiment, but may be respectively enlarged where the cross sectional area of the formed piece 28 is large.

Figure 22:
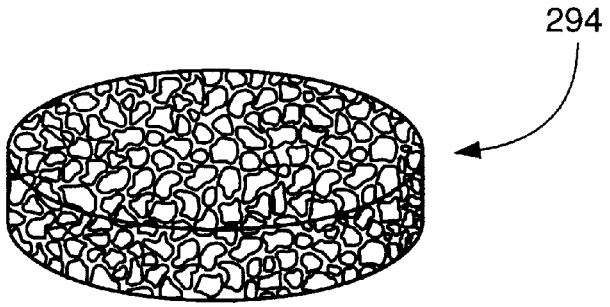
FIG. 22 is a perspective view showing a fourth modification of the partition member.

Further, it is possible to use a partition member 294 having a network-structured partition walls, as shown in FIG. 22. Also in this case, a deviation of the cross sectional shape of a formed piece from the cross sectional shape of the starter member can be reduced, by reducing the spacing dimension of the partition walls to thereby reduce the size of each segmental surface. Thus, the partition walls need not have an uniform shape, but may have respective different shapes .

In the above-illustrated first embodiment, the partition member 14 is made of a material including cordierite and mullite. However, the partition member 14 may be made of metal oxides such as alumina, zirconia, ferrite and silicate; or carbides such as silicon carbide and boron carbide; or nitrides such as silicon nitride and aluminum nitride; borides such as titanium boride and chromium boride; or a mixtures of two or more materials selected from the metal oxides, carbides, nitrides and borides indicated above. The partition member 14 need not be entirely made of a ceramic material, as long as at least the surface contacting the molten metal is covered by a ceramic material. That is, the partition member may be made of a metallic material, or a composition including a metallic material and a ceramic material, which has a low degree of reactivity with respect to the molten material, and which withstands the temperature of the molten metal (which has fire resistance or heat resistance).

Although the metallic material is used as the molten material in the above-illustrated first embodiment, a ceramic material or a plastic material may be used as the molten material. Where a thermoplastic material is used as the molten material, the partition member may be made of a thermosetting plastic material having heat resistance. Where a ceramic material is used as the molten material, the partition member may be formed of a metallic material. In any case, the material of the partition member is determined depending upon the molten material. The partition walls 30 may be subjected to a suitable surface treatment. Similarly, the forming starter member, shielding member and auxiliary starter member may be subjected to a suitable surface treatment.

In the above-illustrated first embodiment, the formed piece 220 having two separate portions is formed by using the forming starter member 210 which has the two independent starter surfaces 212, 214, and the auxiliary starter member 96. However, such a formed piece having two separate portions may be formed by using the shielding member 92. In this case, the forming starter member has a starter surface whose shape is an integration of the respective shapes of the starter surfaces 212, 214 and the auxiliary starter surface 140. The shielding member 92 is advanced to a position which is located in an intermediate portion of the drawn molten metal 26, so that the molten metal 12 is drawn up through two separate portions of the partition member. The two drawn masses of the molten metal are solidified independently of each other, whereby the piece having the two separate portions is formed. In this case, the width of the shielding member 92 is preferably smaller than a half of the cross section of the drawn molten metal 26.

In the above-illustrated first embodiment, the forming starter member is brought into contact with the partition member 14 such that the starter surface is in contact with the upper surface 16. However, the starter member may be located in the vicinity of the partition member 14 while the starter surface is in contact with the upper surface 16. In this case, it is desirable that the relative height of the upper surface 16 with respect to the partition member 14 be slightly raised. The top ends of the partition walls 30 may be covered by the molten metal 12.

In the above-illustrated embodiment, the shielding member 82 is rotated so as to have the vertical attitude when it is separated from the drawn molten material 26 to its retracted position. However, the shielding member 82 moved to its retracted position may have the horizontal attitude. The sectional shape changing device 90 includes four sets of the shielding members 92, shielding-member moving devices 94, auxiliary starter members 96 and auxiliary separating devices 98. However, the provision of the four sets is not essential, provided that at least one set is provided. Where only one set is provided, it is possible to arrange the forming system such that the partition member 14 is rotatable together with the forming starter member 20, so that the relative position of the formed piece 28 and the sectional shape changing device 90 can be changed. In this arrangement, the partition member 14 and the forming starter member 20 are rotated to an appropriate position so that the sectional shape changing device 90 is opposed to a desired portion of the formed piece 28 at which the cross sectional shape of the formed piece 28 is changed by the sectional shape changing device 90.

The forming system need not be arranged to permit both the shielding member 92 and the auxiliary starter member 96 to act on the same side of the formed piece 28. The forming system may be modified such that only one of the shielding member 92 and the auxiliary starter member 96 acts on one side of the formed part.

The auxiliary starter member 96 and the shielding member 92 may be adapted to be rotatable about respective vertical axes. In this case, the auxiliary starter member 96 is rotated about the vertical axis between its auxiliary starting and non-operating positions, while the shielding member 92 is rotated about the vertical axis between its advanced and retracted positions. In the above-illustrated first embodiment, the shielding member 92 is rotatable about a horizontal axis and linearly movable in the horizontal direction. However, the shielding member 92 need not be rotatable about the horizontal axis, provided that it is linearly movable in the horizontal direction.

Figure 23:
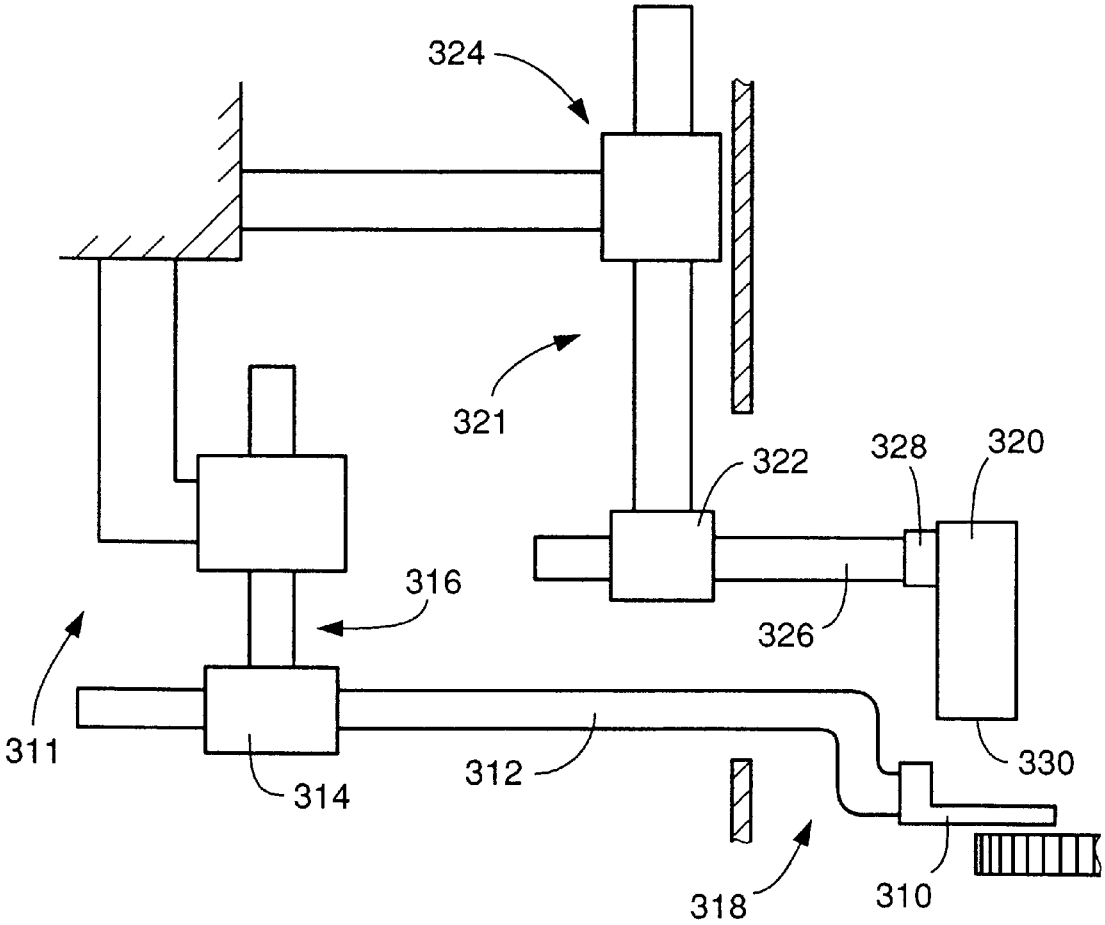
FIG. 23 is a side view of a modification of the sectional shape changing device.
Figure 24:
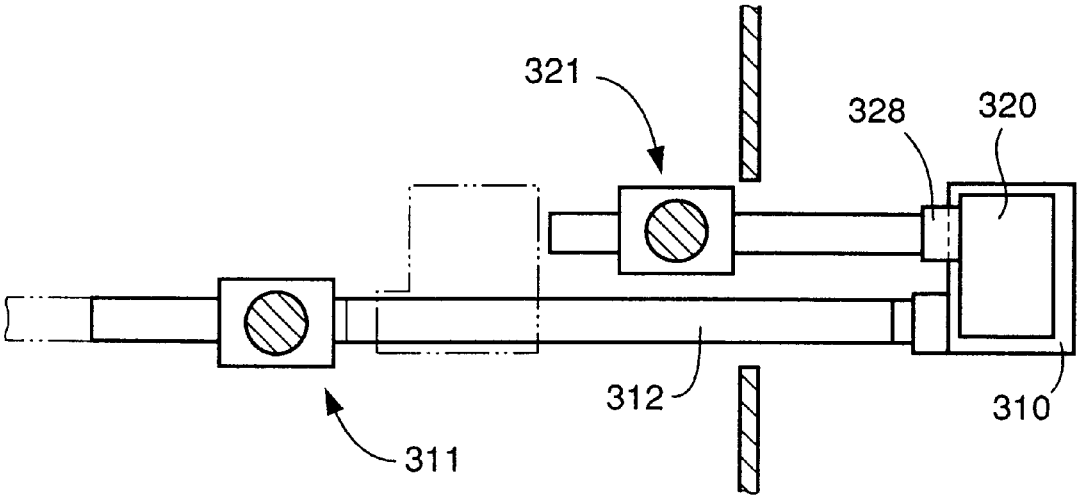
FIG. 24 is a plan view of the sectional shape changing device of FIG. 23.

FIGS. 23 and 24 show a sectional shape changing device including a shielding member 310 which is horizontally and vertically movably supported by a shielding-member moving device 311. The shielding member 310 is removably attached to a shielding-member drive shaft 312, which is supported by a horizontal linear motion device 314 such that the shielding-member drive shaft 312 is linearly movable in the horizontal direction. The body of the horizontal linear motion device 314 is vertically movably supported by a vertical motion device 316.

The shielding-member drive shaft 312 has a generally L-shaped bent portion 318 at one end portion thereof, to which the shielding member 310 is attached. Thus, the shielding member 310 is located a given distance below the intermediate portion of the shielding-member drive shaft 312, 50 that the shielding member 310 may contact the drawn molten metal 26, even when the height of the upper surface 16 is lowered due to the drawing of the molten metal 12, and the height of the material exit surface 38 of the partition member 14 is accordingly decreased relative to the accommodation container 10.

In the above-illustrated first embodiment, the relative height of the upper surface 16 with respect to the accommodation container 10 is kept substantially constant by the molten metal supply device 160, and the relative height of the drawn molten metal 26 with respect to the accommodation container 10 is also kept substantially constant. Therefore, the height of the shielding member 92 at its advanced position is not changed relative to the accommodation container 10, and the shielding-member drive shaft 102 does not have to include a bent portion.

The provision of the bent portion 318 to the shielding-member drive shaft 312 permits the shielding member 310 to be moved to its advanced position without an interference of the shielding-member drive shaft 312 with the accommodation container 10, even when the relative height of the upper surface 16 with respect to the accommodation container 10 is lowered. It is noted that the shielding member may be provided with a bent portion, instead of the provision of the bent portion 318 to the shielding-member drive shaft 312. This modified arrangement also provides the same effect.

An auxiliary starter member 320 is, as the auxiliary starter member 96 embodiment, linearly movable in the horizontal direction by a horizontal linear motion device 322 of an auxiliary separating device 321, and linearly movable in the vertical direction by a vertical linear motion device 324 of the auxiliary separating device 321.

The auxiliary starter member 320 has a mounting portion 328 at which the auxiliary starter member 320 is attached to an auxiliary-member drive shaft 326. The mounting portion 328 is formed at a position which is remotest from one surface of the auxiliary starter member 320. This one surface serves as an auxiliary starter surface 330, wherein the auxiliary starter member 320 is attached to the auxiliary-member drive shaft 326 such that the auxiliary starter surface 330 is located below the auxiliary-member drive shaft 326. In this arrangement, the auxiliary starter surface 330 can be contacted with the partition member 14 even when the partition member 14 is lowered.

When the cross sectional area of the formed piece is reduced by using the shielding member 310 in the present sectional shape changing device, the auxiliary starter member 320 is located at its non-operating position while the shielding member 310 is advanced to the advanced position.

When the cross sectional area of the formed piece is increased by using the auxiliary starter member 320, the shielding member 310 is moved to its retracted position as indicated by two-dot chain line, and the auxiliary starter member 320 is advanced to its auxiliary start position. The auxiliary starter member 320 can avoid interfering with the shielding member 310 during the movement of the auxiliary starter member 320.

Thus, the shielding member 310 need not be rotated, so that the shielding-member moving device 311 can be simplified in construction. Further, since the shielding member 310 is not rotatably supported, the shielding-member drive shaft 312 can be provided with the bent portion 318. In addition, the shielding member 310 and the auxiliary starter member 320 can be operated even when the height of the partition member 14 relative to the accommodation container 10 is more or less lowered. This arrangement makes it possible to operate the molten metal supply device 160 for supplying the accommodation container 10 with the molten metal when the amount of the molten metal 12 accommodated in the accommodation container 10 is decreased to a predetermined value, or makes it possible to eliminate the molten metal supply device 160. In the former case, the molten metal supply device 160 includes an intermittently supplying device.

Where the molten metal supply device 160 is adapted to intermittently supplying the accommodation container 10 with the molten metal, or where the molten metal supply device 160 is eliminated, the velocity of the relative movement of the forming starter member 20 and the partition member 14 is determined by the velocity of the upward movement of the forming starter member 20 and the velocity of the downward movement of the partition member 14. Therefore, the velocity of the relative movement is controlled by controlling both the three-dimensional motion device 18 and the partition-member elevating device 24. In this case, it is desirable that the partition-member elevating device 24 is controlled according to commands of the forming control device 62.

The relative height of the partition member 14 and the upper surface 16 can be controlled by moving the bottom wall of the accommodation container 10 or the entirety of the accommodation container 10 itself. In this case, the forming system requires a bottom-wall elevating device or an accommodation-container elevating device. The upper surface 16 can be moved relative to the forming starter member 20 and the partition member 14, by either of the above two devices.

The relative height of the partition member 14 and the upper surface 16 can be controlled by a surface-height adjusting device which includes a surface-height adjusting member and a volume varying device. The surface-height adjusting member is immersed in the molten material mass, and the volume of the surface-height adjusting member in the molten material mass can be changed by the volume varying device. The relative height of the partition member 14 and the upper surface 16 can be changed by changing the volume of the surface-height adjusting member in the molten material mass.

The heating and cooling devices 76–79 may be adapted to be movable in the drawing direction. In this case, the heating and cooling devices 76–79 are lowered as the upper surface 16 is lowered, so that the formed piece 28 can be heated and cooled at the same position. In the case where the devices 76–79 are stationary, the devices 76–79 should be controlled in an appropriate manner considering a change in the heating and cooling position of the formed piece 28 as the upper surface 16 is lowered. Where the heating and cooling devices 76–79 are lowered as the upper surface 16 is lowered, it is not necessary to consider the change in the heating and cooling position Where the formed piece 194 having a curved surface is formed in the above-illustrated first embodiment, the heating and cooling device 77 is operated as the cooling device while the heating and cooling device 76 is kept non-operated, so that the drawn molten metal 26 is cooled at different cooling velocities on the opposite sides on which the separating velocities are different from each other. However, the different cooling velocities can be provided also by operating the heating and cooling device 76 as the heating device while keeping the heating and cooling device 77 not operated. Where the heating and cooling devices 76, 77 are both operated, the temperature of the nitrogen gas supplied from the heating and cooling device 77 can be made lower than that of the nitrogen gas supplied from the heating and cooling device 76, or alternatively, the rate of supply of the nitrogen gas from the heating and cooling device 77 can be made higher than that of the nitrogen gas supplied from the device heating and cooling 76. Further, the heating and cooling devices 77 and 76 may be operated as the cooling and heating devices, respectively.

The cooling velocity on the side on which the separating velocity is relatively higher need not be higher than on the side on which the separating velocity is relatively lower. The provision of the heating and cooling devices 76–79 is not essential. Since the temperature of the drawn molten metal 26 is lower in the outer portion than in the inner portion, the solidification surface 82 adjacent to the partition member 14 is not likely to be convex even in the absence of positive cooling of the drawn molten metal 26.

In the molten-metal supply device 160, the volume of the supplied molten metal is controlled by controlling the electric current to be applied to the electromagnetic pump 166. However, the volume of the supplied molten metal may be controlled by controlling the pressure in the space located above the upper surface of the molten metal accommodated in the supply container 162. The volume of the supplied molten metal increases with an increase in the pressure in the space located above the upper surface. In this case, the electromagnetic pump is not necessary, and the pressure in the space located above the upper surface is controlled by a supply-container-internal-pressure control device.

Figure 25:
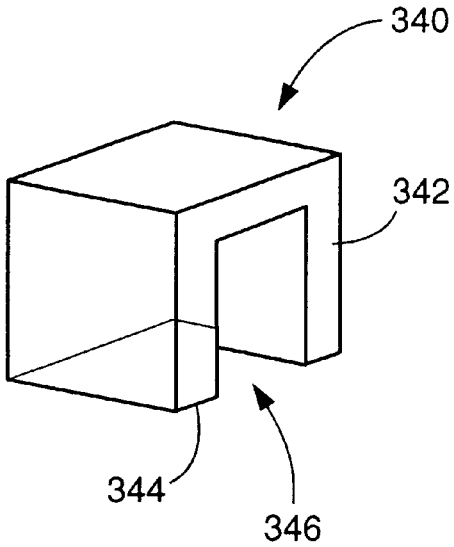
FIG. 25 is a perspective view of an auxiliary starter member attached to the sectional shape changing device.

The auxiliary starter member 96 may be replaced by a shape adding member 340 having a space, as shown in FIG. 25. The space is open in a first surface 342 and a second surface 344 which is adjacent to the first surface 342. The shape adding member 340 is positioned at the auxiliary start position at which the first surface 342 is in contact with the drawn molten metal 26 and the formed piece 28, while the second surface 344 is in contact with the partition member 14. In this condition, with the pressure in the space 346 being lowered by a shape-adding-member-internal-pressure control device not shown in the figure (or the starter-member-internal-pressure control device 170), the molten metal 12 is introduced into and solidified in the space 346. As a result, a formed piece having a shape corresponding to the space 346 of the shape adding member 340 is added to the formed piece 28. Since the structure of the added piece which has been introduced in and solidified in the space 346 is different from that of the formed piece 28, the piece is preferably subjected to a forging or other suitable plastic working process, after the forming process.

After the shape adding member 340 has been moved to the auxiliary start position, the shape adding member 340 may be separated together with the forming starter member 20 from the partition member 14.

The sectional shape changing device 90 is not essential. Even in the absence of the sectional shape changing device 90, the formed pieces 190, 192, 194, 196 can be formed.

The drawing distance m need not be held constant. Where the size of the opening of each perforation 32 of the partition member 14 is considerably small (where the spacing of the partition walls 30 is considerably small), the deviation of the cross sectional shape of the formed piece 28 from that of the starter surface 66 is small even when the drawing distance m is not held constant.

While the above-illustrated first embodiment includes the three-dimensional motion device 18 for three-dimensionally moving the forming starter member 20, the three-dimensional motion device 18 may be replaced by a device which is adapted to provide four motions including a vertical motion, a horizontal motion and a rotary motion. The device may be modified so as to provide only predetermined ones of the motions which are required for the operation, thereby simplifying the construction of the device.

The device for moving the forming starter member 20 may be capable of providing only the vertical motion, or alternatively the vertical motion and at least one of the horizontal and rotary motions.

The forming-starter-member attaching portion of the starter-member holding member 60 may be modified to hold a plurality of forming starter members 20, so that these forming starter members 20 can be simultaneously separated from the partition member 14, to form a plurality of pieces 28. In this case, the three-dimensional motion device 18 includes a plural-member separating device, a plural-piece simultaneously forming device, and a plural-member simultaneously separating device. The plurality of forming starter members having separate starter surfaces may be connected with each other, so as to cooperate with each other to have a single attaching portion.

A plurality of three-dimensional motion devices 18 may be provided for respective forming starter members for simultaneously forming respective pieces. In this case, the forming-starter members may be separated from the partition member at different times, by starting the operations of the three-dimensional motion devices at a predetermined time interval. Thus, the plurality of three-dimensional motion devices 18 can be considered to constitute an individually-simultaneously separating device.

Where a large number of forming starter members are used, or the total area of the starter surface or surfaces is large, the partition member should have an accordingly large surface area. However, it is more difficult to manufacture the partition member having a large surface area than the partition member having a small surface area, while assuring a sufficient strength of the partition member. To avoid this drawback, a plurality of partition members may be disposed adjacent to the upper surface 16. In this instance, two or more forming starter members and the respective partition members are separated from each other.

In this case, the starter surfaces of the forming starter members may have different shapes and sizes, or the same shape and size.

The partition member 14 need not be changed depending upon the cross sectional shapes of the formed pieces 28, as described above. Namely, the forming starter member may be brought into contact with any portion of the partition member 14, irrespective of the shape of the starter surface of the forming starter member. Accordingly, a plurality of forming starter members may be contacted with the single partition member 14.

The starter-member holding member 60 of the three-dimensional motion device 18 may be adapted to be able to directly hold the formed piece 28. In this case, after the formed piece 28 has grown to a maximum holdable length, the formed piece 28 is removed from the forming starter member 20, so that the formed piece 28 is directly held by the starter-member holding member 60 and separated by the same from the partition member 14. This arrangement eliminates a necessity of preventing the formed piece 28 from being removed from the forming starter member 20, whereby the removal preventing device is no longer necessary.

The forming starter member need not be formed of the same material as the molten material, but may be formed of any other material, particularly where the duration of the forming process is short, namely, where the molten material need not be prevented from being removed from the forming starter member. Where the forming starter member is formed of the same material as the molten material, on the other hand, the forming starter member can be considered to be a part of the formed piece.

The upper covering member 150 and the gas supply device 152 provided in the above-illustrated first embodiment are not essential. Where the molten material generally has a low degree of reactivity, or where the oxidation of the molten material is allowed, it is not necessary to insulate the molten material from oxygen. The absence of the upper covering member 150 makes it easier to remove the formed piece 28 from the forming system, and permits improved operating efficiency of the forming system.

Where the molten material has a considerably high degree of reactivity, a suitable inert gas such as argon rather than nitrogen gas is desirably supplied from the gas supply device 152. In this case, the quality of the formed piece 28 can be improved. A further improvement in the quality of the formed piece 28 is expected if the heating and cooling devices 76–79 are also adapted to supply an inert gas.

The stirring device 154 and the starter-member-internal-pressure control device 170 are not essential, either.

The forming control device 62 may be connected to an external information reading device, for receiving various kinds of information such as the desired shape of the piece to be formed. In this instance, one of various programs for forming respective pieces which programs are stored in the ROM is selected depending upon the information received, to control the three-dimensional motion device 18 and the other devices according to the selected control program.

A forming system constructed according to a second embodiment of the present invention will be explained on the basis of drawings. This forming system is capable of carrying out another forming method of the present invention.

Figure 26:
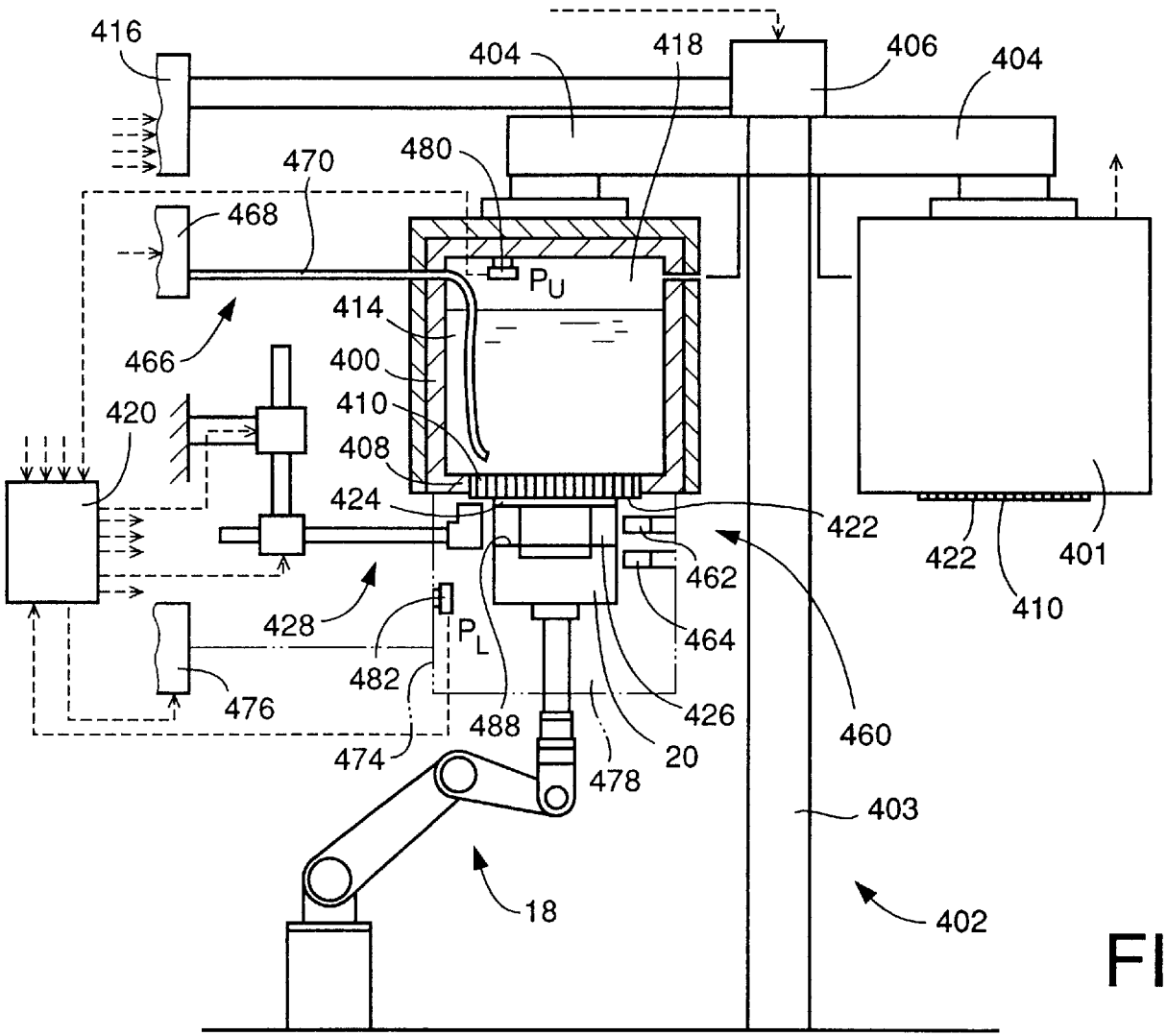
FIG. 26 is a view schematically showing a second embodiment of the present invention in the form of a forming system. This forming system is capable of carrying out another forming method of the present invention.

The present forming system shown in FIG. 26 has four accommodation containers. In FIG. 26, only two accommodation containers 400, 401 of them are shown. The four accommodation containers 400, 401, etc. are rotatably supported by an accommodation-container support device 402. The accommodation-container support device 402 includes a rotary support shaft 403 extending in the vertical direction so as to be fixed to a base, four arms 404 attached to the rotary support shaft 403, and a rotating device 406 for rotating the arms 404 about the axis of the rotary support shaft 403. The four accommodation containers 400, 401, etc. are held by the respective four arms 404, such that the accommodation containers are arranged along a circle having a center on the axis of the rotary support shaft 403. The four arms 404 are spaced apart from each other at the 90° angular interval about the axis of the rotary support shaft 403, and are intermittently rotated by the rotating device 406 about the rotary support shaft 403 by an angle of 90° at each time. Namely, the four accommodation containers 400, 401, etc. are moved in the direction perpendicular to the forming direction.

The accommodation container 400 has a bottom wall 408 in which there is fitted a partition member 410. (Since the four accommodation containers 400, 401, etc. have the same construction, only the accommodation container 400 will be explained, and the other accommodation containers 401, etc. will not be explained.) Thus, the partition member 410 constitutes a portion of the bottom wall 408. The partition member 410 has multiple partition walls whose spacing is smaller than that of the partition member 14, and a considerably lower degree of wettability than the partition ember 14. Since the present forming system is adapted such that a molten metal 414 is drawn in the downward direction, the size of the perforations of the partition member 410 is made smaller to prevent dripping of the molten metal 414.

An upper-space pressure control device 416 is connected to an upper section of the accommodation container 400, so that a pressure PU in an upper space 418 located above the upper surface of the molten material mass is held substantially constant. The upper-space pressure control device 416 is adapted to draw the gas within the upper space 418, and includes a vacuum pump and a motor which are not shown in the figure. The motor is provided for driving the vacuum pump. The motor is connected through a driver circuit not shown in the figure, to a forming control device 420 which will be described. In the accommodation container 400, as shown in the figure, the upper space 418 above the upper surface of the molten metal mass is kept air-tight.

To introduce the molten metal into the accommodation container 400, an accommodation container not shown and containing the molten metal 414 is brought into contact with the bottom wall 408 of the accommodation container 400, and the pressure PU within the accommodation container 400 is evacuated by the upper-space pressure control device 416. The molten metal is sucked and provided into the accommodation container 400 through the partition member 410, until the amount of the molten metal 414 in the accommodation container 400 is raised to a predetermined value. The pressure PU in the upper space 418 is kept at a vacuum level which is obtained when the amount of the molten metal 414 has reached the predetermined value. In this condition, the molten metal 414 does not drip through the partition member 410. The pressure PU in the upper space 418 is lower than the pressure in the vicinity of a material exit surface 422 of the partition member 414, by an amount not smaller than the head pressure of the molten metal 414.

The present forming system is equipped with the three-dimensional motion device 18 constructed as described above with respect to the first embodiment. The forming starter member 20 is removably attached to the three-dimensional motion device 18.

When the forming starter member 20 is separated by the three-dimensional motion device 18 from the partition member 410, the molten metal 414 is drawn downward through the partition member 410. The drawn molten metal 424 is solidified into a formed piece 426. In this forming system, the partition member 410 is fixed, and the forming starter member 20 is moved relative to the fixed partition member 410.

Figure 27:
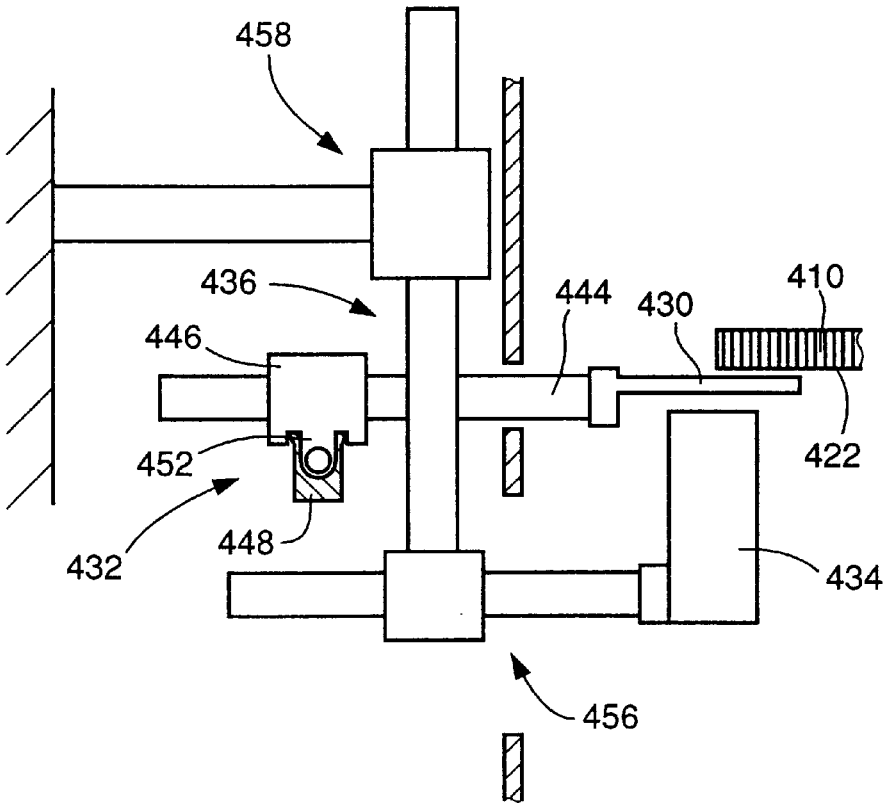
FIG. 27 is a side view of a sectional shape changing device provided in the forming system of the second embodiment.
Figure 28:
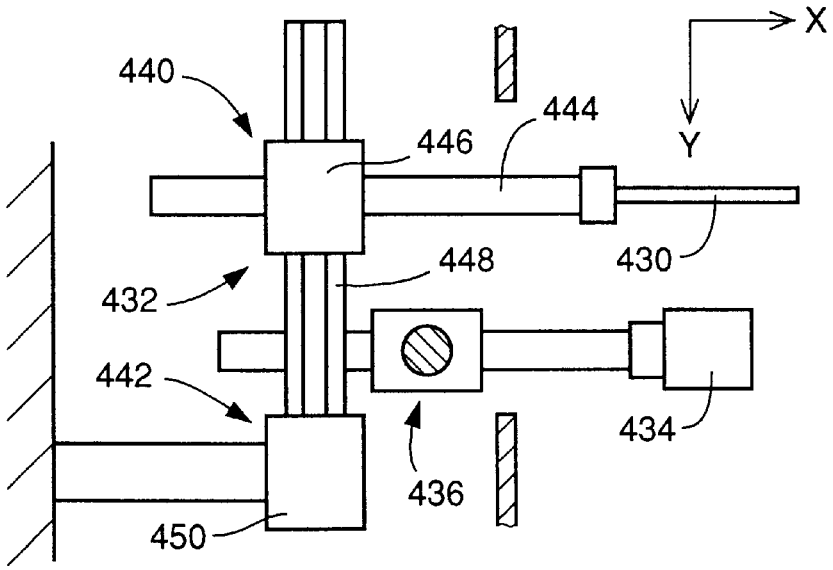
FIG. 28 is a plan view of the sectional shape changing device of FIG. 27.

A sectional shape changing device 428, as shown in FIGS. 27 and 28, includes a shielding member 430, a shielding-member moving device 432, an auxiliary starter member 434 and an auxiliary separating device 436.

The shielding member 430 is a rod-like member, which is moved by the shielding-member moving device 432 in two different directions perpendicular to the forming direction. In the present second embodiment, the shielding-member moving device 432 serves as a two-horizontal-direction motion device which moves the shielding member 430 in the two horizontal directions (X-axis direction and Y-direction) perpendicular to the forming direction. The two-horizontal-direction motion device includes a X-axis motion device 440 for moving the shielding member 430 in the X-axis direction, and a Y-axis motion device 442 for moving the shielding member 430 in the Y-axis direction.

The X-axis motion device 440 includes a shielding-member drive shaft 444 to which the shielding member 430 is attached, and a motion device 446 for moving the shielding-member drive shaft 444 in the X-axis direction. The Y-axis motion device 442 includes a guide rail 448 extending in a direction parallel to the Y-axis direction, a drive device 450 such as a motor for driving a feedscrew disposed adjacent to the guide rail 448, and an engaging portion 452 which is disposed on the body of the motion device 446 and which engages the feedscrew so as to be moved by rotation of the feedscrew.

In the X-axis motion device 440, the shielding member 430 is moved in the X-axis direction when the shielding-member drive shaft 444 is moved by the motion device 446 in the X-axis direction. In the Y-axis motion device 442, rotation of the feedscrew by the drive device 450 causes the body of the motion device 446 to be moved in the Y-axis direction, whereby the shielding member 430 is moved in the Y-axis direction.

As described above, the shielding member 430 is movable in the X-axis and Y-axis directions. Therefore, the shielding member 430 can be moved to its advanced position and its retracted position, by moving the shielding member 430 in either of the X-axis and Y-axis directions. In other words, the shielding member 430 can be moved from its retracted position to its advanced position, or from its advanced position to its retracted position, by moving the shielding member 430 in either of the X-axis and Y-axis directions.

In the present sectional shape changing device 428 wherein the shielding member 430 can be moved in the X-axis and Y-axis directions, i.e., in the same plane, the cross sectional area of the formed piece can be reduced as desired by the shielding member 430, without changing the shielding member 430 depending upon the shape of the reduction surface. The present sectional shape changing device 428 permits the reduction surface to have a shape defined by complicated curves.

Figure 29:
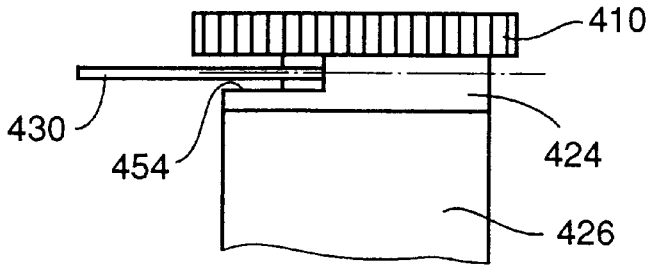
FIG. 29 is a side view schematically showing a state in which the cross sectional area of a formed piece is reduced by a shielding member of the sectional shape changing device of FIG. 27.
Figure 30:
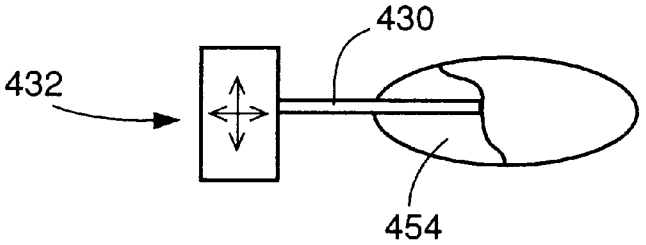
FIG. 30 is a plan view schematically showing the above-described state.

When the cross sectional area of the formed piece 426 is reduced by using the shielding member 430, the shielding member 430 is first advanced into the drawn molten metal 424, and then moved in at least one of the X-axis and Y-axis directions, as indicated in FIGS. 29 and 30, so that the reduction surface having a predetermined shape is formed. Thus, a portion of the drawn molten metal 424 is separated from the partition member 410 by the shielding member 430, so that the molten metal 414 is not drawn down from the portion of the partition member 410. In this case, the molten metal is supported on the formed piece 426 (reduction surface 454), the reduction surface 454 avoids being concaved due to insufficiency of the molten metal at the reduction surface 454.

Where the shielding member 430 is moved over the entire area of the cross section of the drawn molten metal 424, the drawn molten metal 424 is separated from the partition member 410, so that the formed piece 426 is cut off. That is, in the present second embodiment, after having been moved to the advanced position, the shielding member 430 is moved without parting from the drawn molten material 424.

As in the first embodiment, the auxiliary separating device 436 includes a horizontal linear motion device 456 for linearly moving the auxiliary starter member 434 in the horizontal direction, and a vertical motion device 458 for moving the auxiliary starter member 434 in the vertical direction.

As is clear from FIGS. 27 and 28, also in the present second embodiment as in the first embodiment, the shielding member 430 and the auxiliary starter member 432 can be operated on the same side of the formed piece 426. Further, the rod-like shape of the shielding member 430 permits the shielding member 430 and the auxiliary starter member 432 to be operated simultaneously, if the range of movements of the shielding member 430 is limited. Therefore, it is possible to provide the cross sectional area of the formed piece 426 with a reduction surface and an expansion surface at respective different positions, which are both located on the same side of the formed piece 426, at the same level as viewed in the forming direction.

Like the forming system of the first embodiment, the present forming system is equipped with a temperature adjusting device 460 for controlling the temperature of the drawn molten metal 424. The temperature adjusting device 460 has two pairs of heating and cooling devices, as in the first embodiment. In the figure, only two heating and cooling devices 462, 464 are shown. The heating and cooling device 462 has a nitrogen gas nozzle located about 10 mm below the partition member 410.

The present forming system further includes a gas supply and stirring device 466 for stirring the molten metal 414. This gas supply and stirring device 466 includes a stirring gas supply device 468, and a supply tube 470. The gas supply and stirring device 466 is adapted to introduce a nitrogen gas to a section of the accommodation container 400 in the vicinity of the bottom wall 408. With the nitrogen gas introduced near the bottom wall 408 of the accommodation container 400, the molten metal 414 in the vicinity of the bottom wall 408 flows upwards. As a result, a difference between the temperature near the bottom wall 408 and the temperature at the upper surface of the molten metal 414 is reduced. The gas supply and stirring device 466 is effective to prevent the temperature of the molten metal 414 in the lower portion of the accommodation container 400 from being lowered owing to convection with respect to the temperature in the upper portion.

In the above-illustrated first embodiment wherein the molten metal 12 is drawn upward from the upper surface 16 of the molten mass 12, the temperature in the lower portion which is lower than the temperature in the upper portion does not cause a problem. In the present second embodiment wherein the molten metal 414 is drawn downward from the lower surface, it is not desirable that the temperature in the lower portion is lower than that in the upper portion.

In the present forming system, a lower part covering member 474 is removably attached to the accommodation container 400, so as to cover the drawn molten metal 424. The lower part covering member 474 is connected to a lower-space-pressure control device 476, so that pressure PL in a lower space 478 within the lower part covering member 474 is controlled so as to have a suitable value. The lower-space-pressure control device 476 is adapted to increase the pressure PL by introducing a nitrogen gas into the lower space 478, and decrease the pressure PL by permitting the nitrogen gas to be discharged from the lower space 478. The lower-space-pressure control device 476 also functions to prevent oxidation of the drawn molten metal 424. In this respect, the lower-space-pressure control device 476 can be considered to function as an oxidation-preventing-gas supplying device. The lower part covering member 474 is gas-tightly sealed with respect to the sectional shape changing device 428 and the three-dimensional motion device 18.

The forming control device 420 is principally constituted by a computer including CPU, RAM, ROM, an input portion and an output portion. The input portion is connected to pressure sensors 480, 482. The pressure sensor 480 is disposed at an upper portion of the container 400, to detect the pressure PU in the upper space 418, while the pressure sensor 482 is disposed within the lower part covering member 474 to detect the pressure PL in the lower space 478. The output portion is connected through driver circuits not shown, to the upper-space-pressure control device 416, the lower-space-pressure control device 476, the gas supply and stirring device 466, the rotating device 406, the three-dimensional motion device 18, the sectional shape changing device 428 and the temperature adjusting device 460. The ROM stores various programs for forming pieces.

The lower-space-pressure control device 476 is controlled so as to regulate the pressure PL in the lower space 478 such that the pressure PL is higher by a suitable value than the pressure PU in the upper space 418, which is detected by the pressure sensor 480. This suitable value is determined so as to satisfy a predetermined condition. The lower-space-pressure control device 476 is also controlled to prevent oxidation of the drawn molten metal 424, and the temperature adjusting device 460 is controlled to cool the drawn molten metal 424.

An operation of the forming system constructed as described above will be described.

The relative position of the lower surface of the molten mass 414 and the partition member 410 is controlled by controlling the difference between the pressure PU in the upper space 418 and the pressure PL in the lower space 478. The relative position of the lower surface with respect to the partition member 410 is moved toward the material exit surface 422 as the pressure difference is reduced, and is backed away from the material exit surface 422 as the pressure difference is increased. In the present second embodiment, the pressure PU in the upper space 418 and the pressure PL in the lower space 478 are both controlled, whereby the pressure difference is controlled.

Upon initiation of the forming process, the pressure PU in the upper space 418 is controlled to be lower than the pressure PL in the lower space 478, by an amount slightly smaller than the head pressure of the molten metal 414 (by an amount corresponding to the vertical distance of 1 mm in the present embodiment). Then, the starter surface 488 of the forming starter member 20 is brought into contact with the partition member 410. Since the difference between the pressure PU in the upper space 418 and the pressure PL in the lower space 478 is smaller than the head pressure, the lower surface of the molten metal 414 projects downward from the material exit surface 422 of the partition member 410 due to the surface tension of the molten metal 414, whereby the molten metal 414 surely adheres to the starter surface 488.

Then, the forming starter member 20 is moved down (by a distance of about 2 mm in the present embodiment), while the above-indicated pressure difference is increased to a level substantially equal to the head pressure, in order to stabilize the shape of the molten metal adhering to the starter surface 488. Subsequently, the forming starter member 20 is further moved down. Throughout the forming process, the above-indicated pressure difference is kept at the level substantially equal to the head pressure. Accordingly, the molten metal 414 can be stably drawn downward without dripping of the molten metal 414 from the material exit surface 422, whereby the shape of the formed piece 426 is stabilized. In the present embodiment, the forming starter member 20 is moved at velocity of 10 mm/min while the drawing distance m is kept at about 2 mm.

The pressure PU in the upper space 418 is controlled by the upper-space-pressure control device 416, while the pressure PL in the lower space 478 is controlled by the lower-space-pressure control device 476.

The nitrogen gas introduced by the stirring gas supply device 468 into the upper space 418 is admitted into the molten material mass through the upper surface of the molten material mass, and the gas is constantly sucked by an mount corresponding to the amount of the admitted nitrogen gas, by means of the upper-space-pressure control device 416, so that the pressure PU in the upper space 418 is kept at a substantially constant reduced level.

On the other hand, a nitrogen gas is introduced by at least one of the heating and cooling devices 462, 464 into the lower space 478, so that the pressure PL is raised above the atmospheric pressure. The lower-space-pressure control device 476 may be activated to introduce a nitrogen gas into the lower space 478 upon initiation of the forming process, to replace the gas existing in the lower space 478 with the nitrogen gas for thereby preventing oxidation of the drawn molten metal 424, or to raise the pressure PL in the lower space 478. The pressure PL in the lower space 478 is lowered when the pressure control device 476 discharges the nitrogen gas out of the lower space 478.

In the present second embodiment, the pressure PU in the upper space 418 is kept at a substantially constant reduced level, while the pressure PL in the lower space 478 is controlled so that the pressure PL is higher than the pressure PU by substantially an optimum amount (, so that the difference between the pressure PU in the upper space 418 and the pressure PL in the lower space 478 is substantially equal to a optimum value). As the forming process progresses, the volume of the molten metal 414 remained in the accommodation container 400 is reduced, and the head pressure of the molten metal 414 is accordingly reduced, hereby the above-indicated optimum value is reduced.

The upper-space-pressure control device 416, the lower-space-pressure control device 476, the temperature adjusting device 460 and a portion of the forming control device 420 assigned to control the pressures constitute a pressure-difference establishing device. This pressure-difference establishing device serves as a head-pressure-difference establishing device during the forming process.

After the forming starter member 20 has been moved by a predetermined distance (after the formed piece 426 has been given a predetermined length), the velocity of the movement of the forming starter member 20 is increased (to 50 mm/min in the present embodiment), whereby the formed piece 426 is cut off. This movement velocity for cutting the formed piece 426 is determined by the surface tension of the molten metal and other factors. Where the temperature condition established by the temperature adjusting device 460 is constant, the drawing distance m increases with an increase in the movement velocity. If the surface tension of the molten metal is large enough to maintain the shape of drawn molten metal between the partition walls and the formed piece, the drawn molten metal is not cut off even when the drawing distance m is large. If the drawing distance m is too large for the molten metal to maintain its shape owing to the surface tension, the drawn molten metal is cut off. Therefore, if the velocity of the movement of the forming starter member 20 is too high for the molten metal to maintain its shape owing to the surface tension, the drawn molten metal 424 is cut off, namely, the formed piece 426 is cut off. Thus, the three-dimensional motion device 18 and a portion of the forming control device 420 assigned to control the movement velocity of the forming starter member 20 constitute a formed-piece cutting-off device and a high-velocity-relative-movement-cutting-off device.

The molten metal 414 is drawn downward from the partition member 410 even when the formed piece 426 is cut off, so that the molten metal is supported on the cut surface. Thus, the cut surface of the formed piece 426 is not concaved due to insufficiency of the molten metal 414 at the cut surface. After the formed piece 426 has been cut off, an opening and closing member which is not shown in the figure and which is provided at the lower portion of the lower part covering member 474 is opened, and the formed piece 426 is taken out of the lower space 478.

In the present second embodiment, as in the first embodiment, the forming starter member 20 can be moved in the horizontal direction, and rotated, as well as moved in the vertical direction. Thus, the present forming system is capable of forming a piece having an inclined shape, a piece having a twisted shape and a piece having a curved shape. Further, the cross sectional area of the formed piece 426 can be reduced or increased by the sectional shape changing device 428.

There will next be explained a case in which a piece is formed by using the molten metal accommodated in the plurality of accommodation containers 400, 401.

Figure 31:
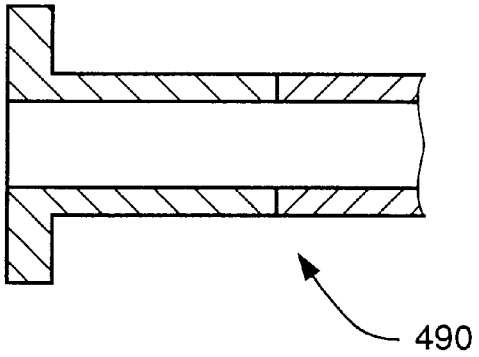
FIG. 31 is a cross sectional view showing a piece which consists of two longitudinal portions formed of respective different materials.
Figure 32:
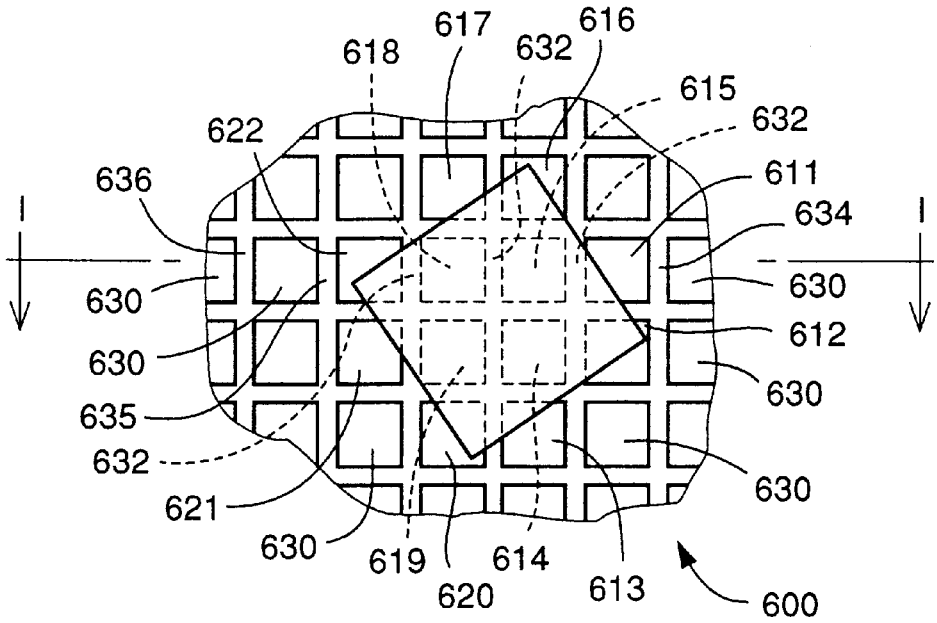
FIG. 32 is a plan view schematically showing a partition member which can be used in a forming system of the present invention, which forming system is capable of carrying out the forming method of the present invention.
Figure 33:
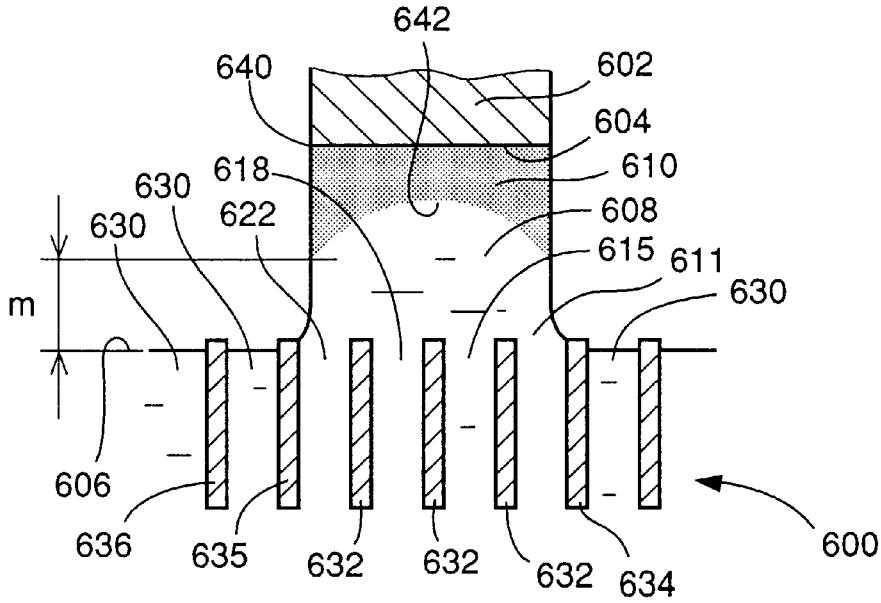
FIG. 33 is a cross sectional view taken along line I—I in FIG. 32.
Figure 34:
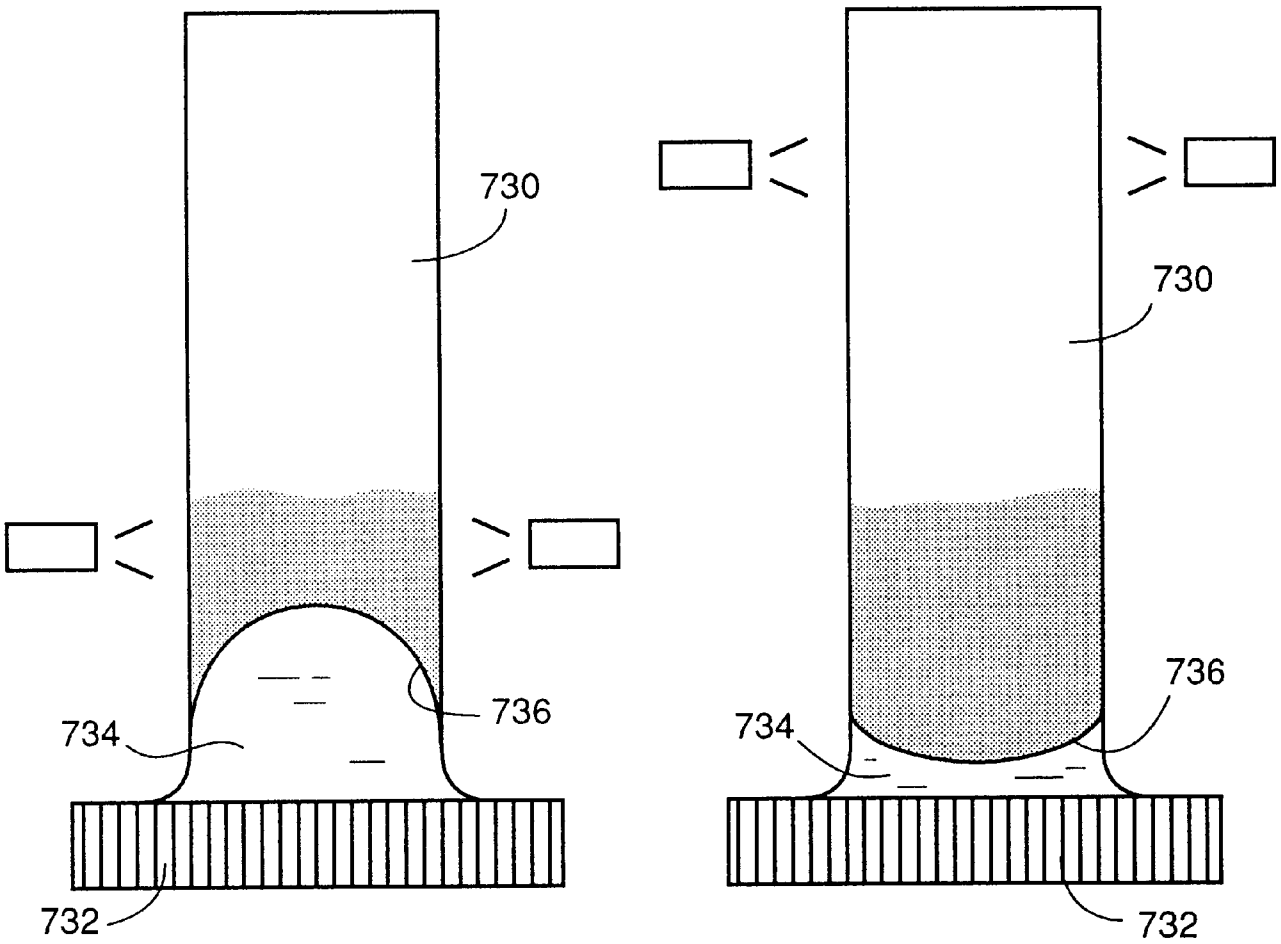
FIG. 34 is a view schematically showing a state in which a piece is formed by the forming system.

After the piece has been formed in the accommodation container 400, the lower part covering member 474 is removed, and the accommodation containers 400, 401 are rotated about the axis of the rotary support shaft 403. When the accommodation container 401 has been brought into the position at which the accommodation container 400 used to be located, the lower part covering member 474 is mounted. Then, the formed piece 426 is positioned by the three-dimensional motion device 18 such that the end face of the formed piece 426 is in contact with the partition member 410 of the accommodation container 401, similarly as described above. With the molten metal adhering to the end face of the formed piece 426, the forming starter member 20 is moved downward, whereby the piece is formed. In this manner, a forming operation is performed with the end face of the formed piece 426 serving as the starter surface. As a result, a formed piece which is formed by using the molten metal 414 accommodated in the accommodation container 410, is added to the formed piece 426. The accommodation-container support device 402 for rotatably supporting the accommodation containers 400, 401, and a portion of the forming control device 420 assigned to control the rotating device 406 cooperate to constitute an accommodation-container selecting device and a relative-rotation-type accommodation-container selecting device.

Where the molten metal accommodated in the accommodation container 401 is the same as the molten metal accommodated in the accommodation container 400, it is possible to form a piece having a large length, which cannot be formed by using only the molten metal accommodated in a single accommodation container.

Where the molten metal accommodated in the accommodation container 401 is different from the molten metal accommodated in the container 400, it is possible to form a piece 490 whose material is changed in steps as viewed in the longitudinal direction, as shown in FIG. 31. In other words, it is possible to connect pieces formed by using different materials, without a welding operation.

The formed piece 490, which is a cylindrical member, can be advantageously used where longitudinal portions thereof are exposed to different environments. Namely, these longitudinal portions can be formed of respective different materials that meet the respective environments. If the piece 490 is entirely formed of a single material, this material should withstand the severer environment, and the cost of the material tends to be increased. However, where the piece can be formed of different materials, the piece need not be entirely formed of the material which withstands the severer environment. Thus, the operation time is reduced if the material which withstands the severer environment requires a long time to be formed, and the operation cost is reduced if the material which withstands the severer environment is expensive.

In the forming system of the present second embodiment, the partition member 410 constitutes a portion of the bottom wall 408 of the accommodation container 400, and is kept at the same position even in the absence of the molten-metal supply device. Therefore, the present embodiment has an advantage that the sectional area changing device 428 does not require the bent portion 318 provided on the shielding-member drive shaft 312 as in the first embodiment.

Since the heating and cooling devices 462, 464 are insulated by the bottom wall 408 from the heated molten metal, and the cooling effect can be improved, and the life expectancy of the devices 462, 464 can be prolonged.

In the forming system of the present second embodiment, since the molten metal does not drip from the cut surface of the formed piece 426, the cut surface is more easily flattened than in the forming system of the first embodiment. In this sense, the pieces formed by using the respective plurality of accommodation containers 400, 401 can be suitably connected to each other.

While the plurality of accommodation containers 400, 401 are rotatably supported in the forming system of the present second embodiment, the arrangement to rotatably support the containers is not essential. That is, the three-dimensional motion device 18 may be adapted to move the formed piece 426 to a position in which the formed piece 426 is in contact with the partition member of another container. Further, both the containers and the formed piece 426 may be moved relative to each other, and the accommodation containers 400, 401, etc. may be linearly movably supported. Still further, the number of accommodation containers need not to be four, but may be any other number not smaller than two.

It is also noted that the provision of the plurality of accommodation containers 400, 401 is not essential. Namely, the present forming system may be provided with only one accommodation container. A suitable molten-metal supply device as provided in the first embodiment may be provided in the present forming system. In this case, the molten metal 414 may be stirred by a suitable device such as an electromagnetic coil, and the amount of the molten metal 414 may be kept substantially constant by the molten-metal supply device 160, so that the volume of the upper space 418 in the accommodation container 400 is kept constant. In this arrangement, the pressure PU in the upper space 418 can be kept constant, even if the pressure PU in the upper space 418 is not practically controlled by the upper-space-pressure control device 416. With the head pressure kept substantially constant, the pressure PL in the lower space 478 may be kept substantially constant.

The pressure sensor 482 may be replaced by a relative-height detector for detecting the relative height of the lower surface of the molten material mass and the partition member 410. In this case, it is possible to detect the height of the lower surface relative to the partition member 410 in a local area of the material exit surface 422 of the partition member 410 from which the molten metal is not drawn. If the height of the lower surface is larger than the optimum value, the pressure difference is reduced. If the height of the lower surface is smaller than the optimum value, the pressure difference is increased. Thus, the relative height of the lower surface and the partition member 410 can be maintained substantially constant.

In the above-illustrated second embodiment, the above-described pressure difference is controlled to be smaller than the head pressure upon initiation of the forming process, and is then increased to a level substantially equal to the head pressure. However, the pressure difference may be made larger than the head pressure, for causing a necking phenomenon of the drawn molten metal.

In the above-illustrated second embodiment, the shielding member 430 is movable in the two direction perpendicular to the forming direction. However, the shielding member 430 does not have to be movable both in the two directions, but may be movable in only one of the X-axis and Y-axis directions. In this case, the shielding member 430 is preferably movable in one of the two directions which is perpendicular to the longitudinal direction of the rod-like shielding member 430 (in the Y-axis direction in the figure).

The rod-like shielding member 430 may be replaced by a shielding member having a plate shape. In this case, the shielding member may be held at its advanced position. Namely, the shielding member need not be separated together with the forming starter member 20 from the partition member as in the above-illustrated second embodiment. In the present forming system wherein the molten metal is drawn downward, the reduction surface 454 is not concaved due to insufficiency of the molten metal at the cut surface.

In the above-illustrated second embodiment in which the molten metal 414 is drawn downward, the necessity to prevent the removal of the molten metal from the starter surface 488 is lower than in the first embodiment. Further, the necessity to rapidly solidify the molten metal adhering to the starter surface 488 is comparatively low in the second embodiment. Therefore, the forming starter member 20 need not be formed of the same material as the molten metal 414. For instance, the forming starter member 20 may be made of copper, and does not require the adhesion facilitating device including the passage 68 for facilitating the solidification of the molten metal adhering to the starter surface 488.

The downward movement of the forming starter member 20 may be replaced by upward movement of the accommodation container 400. The heating and cooling devices 462 may be modified to spout water, so as to serve as cooling devices. The spouted water does not drip into the accommodation container 400.

The stirring gas supply device 468, the lower-space-pressure control device 476 and the heating and cooling devices 462, 464 may use a common gas supply device which supplies these devices with the nitrogen gas. In this instance, a valve device is required for connecting the common gas supply device selectively to the nitrogen gas nozzles provided the lower covering member 474, the supply tube 470 and the heating and cooling devices 462, 464.

The lower covering member 474 may be modified to enclose the three-dimensional motion device 18 and the sectional shape changing device 428. This arrangement facilitates the gas-tightness of the forming system as a whole.

It will be understood that the features applied to the first embodiment are applicable to the second embodiment, while the features applied to the second embodiment are applicable to the first embodiment.

It will also be understood that the present invention may be embodied with various other changes and modifications, which may occur to those skilled in the art, without departing from the scope of the invention defined in the claims.

What is claimed is:

1. A forming method of forming a piece between a surface of a mass of a molten material and a starter surface of a forming starter member by gradually separating said surface of said mass and said starter surface from each other, after said starter surface has been brought into contact with said surface of said mass, said forming method being characterized by:

covering at least a portion of said surface of said mass which portion is wider than said starter surface, by a partition member having a plurality of partition walls which are spaced apart from each other by a spacing interval permitting said partition walls to divide a corresponding surface partially constituting said portion and corresponding to said starter surface, into a plurality of segmental surfaces, and then separating said partition member and said forming starter member from each other while keeping said partition member in a state for dividing said corresponding surface into said plurality of segmental surfaces, after said surface of said mass and said starter surface have been brought into contact with each other with said starter surface being held in contact with or proximity to said partition member.

2. A forming method according to claim 1, characterized by forming said piece by solidifying said molten material which has been drawn through said partition member, while controlling a distance between said surface of said mass and said molten material which has been drawn through said partition member such that said distance has a predetermined value.

3. A forming method according to claim 1, characterized by separating said forming starter member and said partition member from each other while keeping said starter surface of said forming starter member and a material exit surface of said partition member parallel to each other, said starter surface and said material exit surface being brought into contact with or proximity to each other upon initiation of a forming process.

4. A forming method according to claim 1, characterized by separating said forming starter member and said partition member from each other while rotating said forming starter member and said partition member relative to each other from a parallel state in which said starter surface of said forming starter member and a material exit surface of said partition member are parallel to each other, to a non-parallel state in which said starter surface and said material exit surface are inclined with respect to each other, said starter surface and said material exit surface being brought into contact with or proximity to each other upon initiation of a forming process.

5. A forming method according to claim 4, characterized by cooling said molten material which has been drawn through said partition member, such that one of opposite sides of said molten material on which said starter surface and said material exit surface are separated from each other at a velocity higher than that on the other of said opposite sides is cooled at a velocity higher than that of said other of said opposite sides.

6. A forming method according to claim 1, wherein said forming starter member is a hollow cylindrical member having a cylindrical wall portion and a bottom wall portion which closes one of opposite open ends of said hollow cylindrical member, said forming method being characterized by including a step of lowering a pressure in a space between said surface of said mass and said bottom wall portion so as to introduce said molten material into said space, after said forming starter member and said partition member have been brought into contact with or proximity to each other thereby bringing an end face of said cylindrical wall portion and said surface of said mass into contact with each other.

7. A forming method according to claim 6, characterized by lowering said pressure in said space located between said surface of said mass and said bottom wall portion, immediately after said end face of said cylindrical wall portion and said surface of said mass have been brought into contact with each other.

8. A forming method according to claim 6, characterized by forming a piece having a cylindrical shape by separating said cylindrical wall portion and said surface of said mass from each other after said end face of said cylindrical wall portion and said surface of said mass have been brought into contact with each other, and then lowering said pressure in said space located between said surface of said mass and said bottom wall.

9. A forming method according to claim 1, characterized by advancing a shielding member into a position located between said partition member and at least one portion of said molten material which has been drawn through said partition member.

10. A forming method according to claim 1, characterized by positioning an auxiliary starter member having a first surface and a second surface which is adjacent to said first surface, in an auxiliary start position in which said first surface contacts said molten material drawn through said partition member while said second surface contacts or is in proximity to said partition member, so that said second surface is brought into contact with said surface of said mass, and then implementing a step of separating said auxiliary starter member and said partition member from each other at a velocity substantially equal to a velocity at which said forming starter member and said partition member are moved relative to each other.

11. A forming method according to claim 1, wherein said molten material is accommodated in a plurality of accommodation containers, said forming method being characterized by bringing said piece formed by said molten material accommodated in one of said plurality of accommodation containers, into contact with or proximity to said partition member of the other of said plurality of accommodation containers, and implementing a step of separating said partition member of said other of said plurality of accommodation containers and said formed piece from each other, so as to add a newly formed piece to the previously formed piece.

12. A forming method according to claim 11, characterized in that said molten material accommodated in said one of said plurality of accommodation containers and said molten material accommodated in said other of said plurality of accommodation containers are of the same kind.

13. A forming method according to claim 11, characterized in that said molten material accommodated in said one of said plurality of accommodation containers and said molten material accommodated in said other of said plurality of accommodation containers are of different kinds.

14. A forming method according to claim 1, characterized by disposing said partition member in the vicinity of an upper surface of said mass provided by said molten material, and separating said partition member and said forming starter member from each other while controlling a relative height of said partition member and said upper surface to a predetermined value.

15. A forming method according to claim 1, wherein said partition member constitutes at least a portion of a bottom wall of an accommodation container which accommodates therein said molten material, said forming method being characterized by separating said partition member and said forming starter member from each other, while controlling at least one of pressures in respective upper space and lower space such that said pressure in said upper space is lower than said pressure in said lower space by a value satisfying a predetermined condition, said upper space being located above said molten material accommodated in said accommodation container, said lower space being located below said partition member.

16. A forming system which forms a piece between a surface of a mass of a molten material and a starter surface of a forming starter member by gradually separating said surface of said mass and said starter surface from each other, after said surface of said mass has been brought into contact with said starter surface, said forming system comprising:

a partition member having a plurality of partition walls dividing said surface of said mass into a plurality of perforations each defined by said partition walls such that at least 16 of said perforations are located within an area of 1000 $mm^2$ of said partition member;

a holding device which holds said partition member and said forming starter member such that said partition member and said forming starter member are movable relative to each other; and a relative movement device which brings said forming starter member and said partition member into contact with or proximity to each other and separates said forming starter member and said partition member from each other.

17. A forming system according to claim 16, further comprising a molten-material-drawing-distance control device which controls a distance between said surface of said mass and a solidification surface of said molten material which has been drawn through said partition member such that said distance has a predetermined value, while said surface of said molten material mass and said forming starter member are separated from each other.

18. A forming system according to claim 16, wherein said partition member has at least four partition walls per each line segment having a length of 100 mm.

19. A forming system according to claim 16, wherein said relative movement device includes a parallel separating device which separates said partition member and said forming starter member from each other while holding said partition member and said forming starter member in parallel to each other.

20. A forming system according to claim 16, wherein said relative movement device includes a non-parallel separating device which separates said forming starter member and said partition member from each other while rotating said forming starter member and said partition member relative to each other, the separation of said forming starter and partition members is from a parallel state in which said starter surface of said forming starter member and a material exit surface of said partition member are parallel to each other to a non-parallel state in which said starter surface and said material exit surface are inclined with respect to each other, said starter surface and said material exit surface being brought into contact with or in proximity to each other upon initiation of a forming process.

21. A forming system according to claim 20, further comprising an uneven-cooling-velocity applying device which cools said molten material which has been drawn through said partition member such that one of opposite sides of said molten material on which said starter surface and said material exit surface are separated from each other by said non-parallel separating device at a velocity higher than that on the other of said opposite sides is cooled at a velocity higher than that of said other of said opposite sides.

22. A forming system according to claim 16, further comprising a cross section changing device which changes a cross section of said piece as viewed in a forming direction of said piece, wherein said cross section changing device includes a relative-position control device which changes a relative position of said surface of said mass and said partition member, and said partition member includes an inclined portion, which is inclined to said surface of said mass in one of opposite surfaces thereof which is closer to said forming starter member.

23. A forming system according to claim 16, further comprising a cross section changing device which changes a cross section of said piece as viewed in a forming direction of said piece, wherein said relative movement device includes a motion device which moves said forming starter member relative to an accommodation container accommodating said molten material therein, and wherein said cross section changing device comprises:

a shielding member; and a shielding-member moving device which moves said shielding member relative to said accommodation container at least in a direction intersecting said forming direction, so as to move said shielding member to an advanced position in which said shielding member is interposed between at least a portion of said partition member and at least a portion of said molten material which has been drawn through said partition member, and to move said shielding member to a retracted position distant from said advance position.

24. A forming system according to claim 16, further comprising a cross section changing device which changes a cross section of said piece as viewed in a forming direction of said piece, wherein said relative movement device includes a motion device which moves said forming starter member relative to an accommodation container accommodating said molten material therein, and wherein said cross section changing device comprises:

an auxiliary starter member; and an auxiliary separating device which moves said auxiliary starter member relative to said accommodation container, so as to move said auxiliary starter member to an auxiliary start position in which a first surface of said auxiliary starter member is in contact with said molten material drawn through said partition member while a second surface of said auxiliary starter member which is adjacent to said first surface is in contact with or in proximity to said partition member, and so as to separate said auxiliary starter member and said partition member from each other in said forming direction at a velocity substantially equal to a velocity at which said forming starter member and said partition member are moved relative to each other, after said auxiliary starter member has been moved to an auxiliary start position.

25. A forming system according to claim 16, further comprising:

a plurality of accommodation containers which accommodates said molten material therein; and an accommodation-container selecting device which moves said plurality of accommodation containers and one of opposite end portions of said piece which is closer to said partition member, relative to each other in a direction intersecting said forming direction, thereby selecting one of said plurality of accommodation containers to be opposed to said one of said opposite end portions of said piece.

26. A forming system according to claim 16, further comprising:

a partition-member holding member which holds said partition member such that said partition member is located in the vicinity of an upper surface of said mass; and a relative-height control device which controls a relative height of said partition-member holding member and said upper surface of said molten material mass such that said relative height has a predetermined value.

27. A forming system according to claim 16, wherein said partition member constitutes at least a portion of a bottom wall of an accommodation container which accommodates therein said molten material.

28. A forming system according to claim 27, further comprising a pressure-difference establishing device which establishes a difference between a pressure in an upper space which is located above said molten material accommodated in said accommodation container and a pressure in a lower space which is located below said partition member, such that said difference has a predetermined value.

29. A forming system according to claim 16, further comprising a cross section changing device which changes a cross section of said piece as viewed in a forming direction of said piece, wherein said cross section changing device includes a molten-material-drawing-distance control device which controls a distance between said surface of said mass and a solidification surface of said molten material so as to control said area of said cross section, said molten-material-drawing-distance control device including at least one of temperature adjusting means for adjusting a temperature of said molten material drawn through said partition member and thereby controlling said distance between said surface of said mass and said solidification surface of said molten material, and relative-movement-velocity controlling means for controlling a velocity at which said partition member and said forming starter member are moved relative to each other and thereby controlling said distance between said surface of said mass and said solidification surface of said molten material.

* * * * *